US012774818B1

(12) United States Patent
Jeong et al.

(10) Patent No.: US 12,774,818 B1
(45) Date of Patent: Oct. 27, 2026

(54) COOKING APPLIANCE

(71) Applicant: LG Electronics Inc., Seoul (KR)

(72) Inventors: Jonghwan Jeong, Seoul (KR); Ugjin Kim, Seoul (KR); Jaehyeok Jung, Seoul (KR); Heechan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 19/576,910

(22) Filed: Mar. 24, 2026

Related U.S. Application Data

(63) Continuation of application No. PCT/KR2026/004403, filed on Mar. 18, 2026.

(60) Provisional application No. 63/929,106, filed on Dec. 2, 2025, provisional application No. 63/926,884, filed on Nov. 28, 2025, provisional application No. 63/931,748, filed on Dec. 5, 2025.

(51) Int. Cl.
*F24C 15/20* (2006.01)
*F24C 7/02* (2006.01)

(52) U.S. Cl.
CPC ..... *F24C 15/2042* (2013.01); *F24C 7/02* (2013.01)

(58) Field of Classification Search
CPC ..... F24C 7/02; H05B 6/642; H05B 6/6423
See application file for complete search history.

(56) References Cited

U.S. PATENT DOCUMENTS 4,143,646 A 3/1979 Sampsel
4,327,274 A 4/1982 White et al.
4,369,347 A 1/1983 Shin
5,018,158 A 5/1991 Okada et al.
5,690,848 A 11/1997 Lamberti
5,981,929 A 11/1999 Maeda et al.
6,018,158 A * 1/2000 Kang ..... H05B 6/6423 219/757
6,218,654 B1 4/2001 Braunisch
6,539,840 B2 4/2003 Choi et al.
6,621,058 B1 9/2003 Kim
6,797,930 B2 9/2004 Kim
6,930,295 B2 8/2005 Kim
7,629,561 B2 12/2009 Sohn et al.
11,079,118 B2 8/2021 Zhang et al.
2003/0116031 A1 6/2003 Choi et al.
(Continued)

FOREIGN PATENT DOCUMENTS

CN 1118666 C 8/2003
CN 203454227 U 2/2014
(Continued)

*Primary Examiner* — Ko-Wei Lin
(74) *Attorney, Agent, or Firm* — Fish & Richardson P.C.

(57) ABSTRACT

Disclosed is a cooking appliance including a main body having a cooking chamber and an upper space. The cooking appliance comprises an upper exhaust hole configured to open the upper space to an outside, an internal exhaust hole configured to provide a passage connecting the cooking chamber to at least one of a side space and the upper space, and an external exhaust hole configured to open, to an outside of the main body, at least one of the side space and the upper space that communicates with the internal exhaust hole. At least one of the internal exhaust hole and the external exhaust hole is disposed to face a direction different from a direction in which the upper exhaust hole faces with respect to a cavity, or is disposed on a surface other than a surface defining an upper boundary of the upper space.

20 Claims, 71 Drawing Sheets

(56) References Cited

U.S. PATENT DOCUMENTS

| | | | |
|---|---|---|---|
| 2004/0046454 | A1 | 3/2004 | Kang |
| 2004/0050841 | A1 | 3/2004 | Han et al. |
| 2004/0144774 | A1 | 7/2004 | Kim |
| 2005/0092746 | A1 | 5/2005 | Song et al. |
| 2005/0133503 | A1 | 6/2005 | Kim et al. |
| 2006/0011622 | A1 | 1/2006 | Lundstrom et al. |
| 2006/0081623 | A1 | 4/2006 | Cho |
| 2007/0102423 | A1 | 5/2007 | Kang |
| 2008/0105251 | A1 | 5/2008 | Yamauchi |
| 2008/0156313 | A1 | 7/2008 | Sohn et al. |
| 2008/0156792 | A1 | 7/2008 | Song et al. |
| 2008/0156793 | A1 | 7/2008 | Song et al. |
| 2009/0134155 | A1 | 5/2009 | Kim et al. |
| 2010/0089910 | A1 | 4/2010 | Park et al. |
| 2014/0318389 | A1 | 10/2014 | Kim |
| 2014/0322417 | A1 | 10/2014 | Kim |
| 2015/0257591 | A1 | 9/2015 | Armstrong et al. |
| 2015/0305095 | A1 | 10/2015 | Huang et al. |
| 2015/0373789 | A1 | 12/2015 | Meusburger et al. |
| 2016/0119982 | A1 | 4/2016 | Kang et al. |
| 2016/0165672 | A1 | 6/2016 | Imm et al. |
| 2016/0165674 | A1 | 6/2016 | Imm et al. |
| 2016/0165675 | A1 | 6/2016 | Imm et al. |
| 2016/0381741 | A1 | 12/2016 | Lee et al. |
| 2017/0082296 | A1 | 3/2017 | Jeong et al. |
| 2017/0119207 | A1 | 5/2017 | Kim et al. |
| 2017/0343220 | A1 | 11/2017 | Ha et al. |
| 2018/0153005 | A1 | 5/2018 | Peng et al. |
| 2019/0071347 | A1 | 3/2019 | Kim et al. |
| 2019/0110641 | A1 | 4/2019 | Lee et al. |
| 2019/0113241 | A1 | 4/2019 | Zhang et al. |
| 2019/0166658 | A1 | 5/2019 | Zhang et al. |
| 2021/0076714 | A1 | 3/2021 | Kim et al. |
| 2021/0315070 | A1 | 10/2021 | Sokovets et al. |
| 2022/0117440 | A1 | 4/2022 | Lee et al. |
| 2022/0279631 | A1 | 9/2022 | Fan et al. |
| 2022/0390120 | A1 | 12/2022 | Lee et al. |
| 2023/0003392 | A1 | 1/2023 | Lee et al. |
| 2023/0097488 | A1 | 3/2023 | Zhang et al. |
| 2023/0128533 | A1 | 4/2023 | Garuccio et al. |
| 2023/0276544 | A1 | 8/2023 | Zhang et al. |
| 2023/0276545 | A1 | 8/2023 | Zhang et al. |
| 2023/0276546 | A1 | 8/2023 | Zhang et al. |
| 2023/0383961 | A1 | 11/2023 | Kim et al. |
| 2024/0015859 | A1 | 1/2024 | Park et al. |
| 2024/0060652 | A1* | 2/2024 | Lee ..... F24C 15/20 |
| 2024/0064879 | A1 | 2/2024 | Jeong |
| 2024/0099508 | A1 | 3/2024 | Yun et al. |
| 2024/0107637 | A1 | 3/2024 | Yun et al. |
| 2025/0016895 | A1 | 1/2025 | Zhang et al. |
| 2025/0203724 | A1 | 6/2025 | Zhang et al. |
| 2025/0280473 | A1 | 9/2025 | Fan et al. |
| 2025/0294649 | A1 | 9/2025 | Kim et al. |

FOREIGN PATENT DOCUMENTS

| | | | |
|---|---|---|---|
| CN | 203837048 | U | 9/2014 |
| CN | 204153828 | U | 2/2015 |
| CN | 204153829 | U | 2/2015 |
| CN | 204153830 | U | 2/2015 |
| CN | 204240424 | U | 4/2015 |
| CN | 104676669 | A | 6/2015 |
| CN | 104676676 | A | 6/2015 |
| CN | 205026758 | U | 2/2016 |
| CN | 105402788 | A | 3/2016 |
| CN | 205137567 | U | 4/2016 |
| CN | 205447882 | U | 8/2016 |
| CN | 206310567 | U | 7/2017 |
| CN | 210463126 | U | 5/2020 |
| CN | 112914347 | A | 6/2021 |
| CN | 112944416 | A | 6/2021 |
| JP | H06-313558 | A | 11/1994 |
| JP | 2001-319766 | A | 11/2001 |
| JP | 2022-114064 | A | 8/2022 |
| KR | 20-1985-0006846 | U | 9/1985 |
| KR | 20-1989-0015628 | U | 8/1989 |
| KR | 10-2000-0003708 | A | 1/2000 |
| KR | 10-2000-0008035 | A | 2/2000 |
| KR | 10-2000-0009829 | A | 2/2000 |
| KR | 20-2000-0006011 | U | 4/2000 |
| KR | 20-2000-0009135 | U | 5/2000 |
| KR | 10-0323542 | B1 | 5/2002 |
| KR | 20040005178 | A * | 1/2004 |
| KR | 10-2004-0061356 | A | 7/2004 |
| KR | 10-2004-0061390 | A | 7/2004 |
| KR | 10-2004-0100039 | A | 12/2004 |
| KR | 10-2005-0046958 | A | 5/2005 |
| KR | 10-2005-0083399 | A | 8/2005 |
| KR | 10-2005-0100242 | A | 10/2005 |
| KR | 10-2005-0100248 | A | 10/2005 |
| KR | 10-2008-0060394 | A | 7/2008 |
| KR | 10-2008-0060395 | A | 7/2008 |
| KR | 10-2008-0063567 | A | 7/2008 |
| KR | 10-2008-0063568 | A | 7/2008 |
| KR | 10-2010-0009886 | A | 1/2010 |
| KR | 10-2010-0112339 | A | 10/2010 |
| KR | 10-2011-0018224 | A | 2/2011 |
| KR | 10-2011-0019838 | A | 3/2011 |
| KR | 10-2011-0062832 | A | 6/2011 |
| KR | 10-2011-0063929 | A | 6/2011 |
| KR | 10-2013-0036415 | A | 4/2013 |
| KR | 10-1263519 | B1 | 5/2013 |
| KR | 10-2016-0068576 | A | 6/2016 |
| KR | 10-2016-0068577 | A | 6/2016 |
| KR | 10-2017-0035455 | A | 3/2017 |
| KR | 10-2017-0050402 | A | 5/2017 |
| KR | 10-2017-0135619 | A | 12/2017 |
| KR | 10-1890433 | B1 | 8/2018 |
| KR | 10-2019-0027128 | A | 3/2019 |
| KR | 10-2019-0097607 | A | 8/2019 |
| KR | 10-2020-0042368 | A | 4/2020 |
| KR | 10-2022-0115074 | A | 8/2022 |
| KR | 10-2022-0136027 | A | 10/2022 |
| KR | 10-2022-0138157 | A | 10/2022 |
| KR | 10-2022-0150805 | A | 11/2022 |
| KR | 10-2022-0163229 | A | 12/2022 |
| KR | 10-2022-0163837 | A | 12/2022 |
| KR | 10-2023-0006358 | A | 1/2023 |
| KR | 10-2023-0006359 | A | 1/2023 |
| KR | 10-2023-0006360 | A | 1/2023 |
| KR | 10-2023-0007211 | A | 1/2023 |
| KR | 10-2023-0007212 | A | 1/2023 |
| KR | 10-2023-0007213 | A | 1/2023 |
| KR | 10-2023-0103500 | A | 7/2023 |
| KR | 10-2024-0084498 | A | 6/2024 |
| KR | 10-2024-0084499 | A | 6/2024 |
| KR | 10-2024-0084500 | A | 6/2024 |
| KR | 10-2024-0084501 | A | 6/2024 |
| KR | 10-2025-0086376 | A | 6/2025 |
| KR | 10-2025-0086377 | A | 6/2025 |
| KR | 10-2025-0091797 | A | 6/2025 |
| KR | 10-2025-0096268 | A | 6/2025 |
| KR | 10-2025-0121328 | A | 8/2025 |
| KR | 10-2025-0121329 | A | 8/2025 |
| KR | 10-2025-0121330 | A | 8/2025 |
| KR | 10-2025-0121331 | A | 8/2025 |
| KR | 10-2025-0121332 | A | 8/2025 |
| KR | 10-2025-0121333 | A | 8/2025 |
| KR | 10-2025-0157344 | A | 11/2025 |
| WO | WO 2017177890 | A1 | 10/2017 |
| WO | WO 2025121478 | A1 | 6/2025 |
| WO | WO 2025121479 | A1 | 6/2025 |
| WO | WO 2025121480 | A1 | 6/2025 |

* cited by examiner

COOKING APPLIANCE

CROSS-REFERENCE TO RELATED APPLICATIONS

This application claims priority under 35 U.S.C. § 119(e) to U.S. Provisional Patent Application No. 63/926,884, filed on Nov. 28, 2025, U.S. Provisional Patent Application No. 63/929,106, filed on Dec. 2, 2025, U.S. Provisional Patent Application No. 63/931,748, filed on Dec. 5, 2025, and is a continuation of International Application No. PCT/KR2026/004403, filed on Mar. 18, 2026, which claims priority to the same provisional applications. The entire contents of these applications are incorporated herein by reference in their entireties.

TECHNICAL FIELD

The present disclosure relates to a cooking appliance, and more particularly, to a cooking appliance providing both a cooking function and a hood function.

BACKGROUND

A cooking appliance is a home appliance for cooking food, and is an apparatus installed in a kitchen space to cook food according to a user's intention. Such cooking appliances may be variously classified according to a heat source or form to be used, and a type of fuel.

When the cooking appliances are classified according to a form of cooking food, the cooking appliances may be classified into an open type cooking appliance and a closed type cooking appliance according to a form of a space in which the food is placed. The closed type cooking appliance includes an oven, a microwave oven, and the like, and the open type cooking appliance includes a cooktop, a hob, and the like.

The closed type cooking appliance is a cooking appliance cooking food by shielding a space in which the food is located, and heating the shielded space. In the closed type cooking appliance, a chamber, that is, a cooking chamber, which is a space shielded when cooking food while the food is placed, is provided in an inside of a main body. Such a cooking chamber substantially becomes a space in which food is cooked. A heat source is provided in an inner or outer space of the cooking chamber to heat the cooking chamber.

Among the closed type cooking appliances, a microwave oven is a cooking apparatus heating an object to be cooked by generating microwaves using electricity, penetrating the microwaves into the object to be cooked accommodated inside the cooking chamber, and causing molecular movement therein.

The microwave oven is a kitchen utensil simultaneously heating an inside and an outside of food by irradiating a high frequency of a magnetron to the food, and is widely used due to advantages such as significantly shortening a cooking time of the food due to high thermal efficiency, reducing a loss of nutritional value during a process of cooking, defrosting, and heating the food, and enabling direct cooking while storing the food in a container.

Recently, a microwave oven combined with a hood having a hood function, also known as an OTR (Over-the-Range) type microwave oven, has been released. The microwave oven combined with a hood has a hood function of discharging air containing foreign substances (hereinafter referred to as "cooking gas") generated in a process of cooking food in a cooking appliance installed below the microwave oven to an exterior, or discharging the air to an indoor room after filtering.

SUMMARY

Technical Problems

One objective of the present disclosure is to provide a cooking appliance having an improved structure such that a plurality of exhaust airflows independently flow from each other inside the appliance.

Another objective of the present disclosure is to provide a cooking appliance having an improved structure so as to secure a required exhaust flow path volume while minimizing an increase in a total size of the appliance.

Another objective of the present disclosure is to provide a cooking appliance having an improved structure so as to alleviate a pressure change occurring inside a flow path during exhaust flow.

Another objective of the present disclosure is to provide a cooking appliance having an improved structure so as to reduce restrictions on an installation environment by diversifying a path of an airflow discharged to an exterior of the appliance.

Technical Solutions

A cooking appliance according to an embodiment of the present disclosure for achieving the above purpose includes an upper exhaust hole configured to open an upper space to an exterior, an internal exhaust hole configured to form a passage connecting a cooking chamber to at least one of a side space and the upper space, and an external exhaust hole configured to open, to an exterior of a main body, at least one of the side space and the upper space that communicates with the internal exhaust hole, wherein at least one of the internal exhaust hole and the external exhaust hole faces a direction different from a direction in which the upper exhaust hole faces with respect to a cavity, or is disposed on a surface other than a surface defining an upper boundary of the upper space.

Another aspect of the present disclosure is characterized in that at least one of the internal exhaust hole and the external exhaust hole faces the side space in a lateral direction, or is disposed on a surface defining the side space.

Another aspect of the present disclosure is characterized in that the external exhaust hole is provided on a side surface of a cabinet where the upper exhaust hole is not disposed, and the internal exhaust hole and the external exhaust hole are spaced apart to face each other in a lateral direction with the side space interposed therebetween.

Another aspect of the present disclosure is characterized by further including a guide duct configured to form a flow path therein for guiding a flow of air, which has flowed from the cooking chamber to the side space through the internal exhaust hole, toward the external exhaust hole, wherein at least a portion of the guide duct is accommodated in the side space.

Another aspect of the present disclosure is characterized by further including an extension plate configured to partition the side space such that a partial region of the side space is separated into an extended upper space, a passage portion formed in the extension plate to connect the internal exhaust hole and the external exhaust hole, and a guide wall protruding upward from the extension plate and configured to block between the extended upper space and the passage portion.

Another aspect of the present disclosure is characterized by further including, when the internal exhaust hole is disposed on an upper surface of the cavity, a guide duct configured to form a flow path in the main body for guiding a flow of air, which has flowed from the cooking chamber to the upper space through the internal exhaust hole, toward the side space, and a duct discharge hole formed in the guide duct to provide a lateral passage connecting the flow path and the external exhaust hole.

Another aspect of the present disclosure is characterized by including, when the internal exhaust hole faces the side space in a lateral direction and the external exhaust hole faces the upper space in an upward direction, a guide duct configured to form a flow path in the main body for guiding a flow of air, which has flowed from the cooking chamber to the side space through the internal exhaust hole, toward the upper space, wherein the guide duct comprises a duct body portion configured to form the flow path therein while surrounding the internal exhaust hole from an outside, and a passage portion formed in the duct body portion to provide a vertical passage connecting the flow path and the external exhaust hole.

Another aspect of the present disclosure is characterized in that the upper exhaust hole and the external exhaust hole are spatially separated and respectively opened to the exterior through physically disconnected flow paths.

Another aspect of the present disclosure is characterized in that the extension plate includes a plate portion configured to block between the upper space and the side space, thereby partitioning an exhaust flow space inside the main body into a zone for discharging an in-chamber discharge gas and a zone for general exhaust.

Another aspect of the present disclosure is characterized in that a side surface of the cavity and a side surface of the cabinet are spaced apart by a predetermined interval to form the side space, the internal exhaust hole is formed in the side surface of the cavity, and the external exhaust hole is formed in the side surface of the cabinet.

Another aspect of the present disclosure is characterized in that the guide duct is three-dimensionally combined including a first duct portion disposed in the upper space and a second duct portion disposed in the side space, thereby allowing an expanded internal flow path volume to act as a chamber buffering a pressure rise of an exhaust gas.

A cooking appliance according to an aspect of the present disclosure may comprise: a main body having a cooking chamber formed inside a cavity, a side space disposed at a lateral side of the cavity, and an upper space disposed above the cavity and connected to the side space; an upper exhaust hole configured to open the upper space to an exterior; an internal exhaust hole configured to form a passage connecting the cooking chamber to at least one of the side space and the upper space; and an external exhaust hole configured to open, to an exterior of the main body, at least one of the side space and the upper space that communicates with the internal exhaust hole.

Preferably, the upper exhaust hole faces the cavity in a vertical direction, or is disposed on a surface defining an upper boundary of the upper space.

Preferably, at least one of the internal exhaust hole and the external exhaust hole faces a direction different from a direction in which the upper exhaust hole faces with respect to the cavity, or is disposed on a surface other than the surface defining the upper boundary of the upper space.

Preferably, at least one of the internal exhaust hole and the external exhaust hole faces the side space in a lateral direction, or is disposed on a surface defining the side space.

Preferably, the side space is disposed between the internal exhaust hole and the external exhaust hole, and at least one of the internal exhaust hole and the external exhaust hole faces the side space in a lateral direction.

Preferably, a side surface of the cavity faces the side space in a lateral direction, and the internal exhaust hole is formed in the side surface of the cavity.

In addition, the main body may further comprise a cabinet disposed outside the cavity.

Preferably, the side space and the upper space are respectively disposed between the cavity and the cabinet, the internal exhaust hole is formed in the cavity, and the external exhaust hole is formed in the cabinet.

Preferably, the side space is disposed between a side surface of the cavity and a side surface of the cabinet, and the internal exhaust hole is formed in the side surface of the cavity, or the external exhaust hole is formed in the side surface of the cabinet.

In addition, an upper surface of the cabinet defines the upper boundary of the upper space, and the upper exhaust hole may be disposed on the upper surface of the cabinet.

Preferably, the external exhaust hole may be formed in the cabinet and is disposed on a surface different from a surface on which the upper exhaust hole is disposed.

Preferably, the external exhaust hole is formed in the side surface of the cabinet.

Preferably, the internal exhaust hole and the external exhaust hole are disposed to face each other in a lateral direction with the side space interposed therebetween.

Preferably, the side space is disposed between the side surface of the cavity and the side surface of the cabinet, and the internal exhaust hole is formed in the side surface of the cavity.

In addition, the present disclosure may further comprise a guide duct configured to form a flow path therein for guiding a flow of air, which has flowed from the cooking chamber to the side space through the internal exhaust hole, toward the external exhaust hole.

Preferably, at least a portion of the guide duct may be disposed in the side space.

In addition, at least a portion of the guide duct may be disposed in the side space, and the external exhaust hole may be formed in the side surface of the cabinet.

In addition, an upper surface of the cavity defines a lower boundary of the upper space, and the internal exhaust hole may be formed in the upper surface of the cavity.

In addition, the present disclosure may further comprise an extension plate configured to partition the side space such that a partial region of the side space is separated into an extended upper space.

In addition, the present disclosure may further comprise a passage portion formed in the extension plate to connect the internal exhaust hole and the external exhaust hole.

In addition, the present disclosure may further comprise a guide wall protruding upward from the extension plate and configured to block between the extended upper space and the passage portion.

In addition, the present disclosure may further comprise a guide duct configured to form a flow path in the main body for guiding a flow of air, which has flowed from the cooking chamber to the upper space through the internal exhaust hole, toward the side space, and a duct discharge hole formed in the guide duct to provide a lateral passage connecting the flow path and the external exhaust hole.

Preferably, the internal exhaust hole faces the side space in a lateral direction, and the external exhaust hole faces the upper space in an upward direction.

Preferably, the extension plate may comprise a plate portion configured to block between the upper space and the side space, and a passage portion formed in the plate portion to provide a vertical passage connecting the internal exhaust hole and the external exhaust hole.

In addition, the present disclosure may further comprise a guide duct configured to form a flow path therein for guiding a flow of air, which has flowed from the cooking chamber to the side space through the internal exhaust hole, toward the passage portion.

Preferably, the present disclosure further comprises a guide duct configured to form a flow path in the main body for guiding a flow of air, which has flowed from the cooking chamber to the side space through the internal exhaust hole, toward the upper space, wherein the guide duct comprises a duct body portion configured to form the flow path therein while surrounding the internal exhaust hole from an outside, and a passage portion formed in the duct body portion to provide a vertical passage connecting the flow path and the external exhaust hole.

Advantageous Effects

The cooking appliance of the present disclosure provides an effect of suppressing an exhaust resistance caused by a collision or interference between mutual airflows and preventing a backflow phenomenon by discharging an in-chamber discharge air discharged from the cooking chamber and a hood discharge air circulating inside the main body separately through independent exhaust flow paths without mixing with each other.

In addition, the present disclosure can discharge a large amount of cooking gas quickly and strongly without a bottleneck phenomenon while minimizing an increase in an overall size of the cooking appliance by actively utilizing the side space as an exhaust path rather than depending only on a limited space of an upper portion of the appliance or three-dimensionally expanding an exhaust volume through the guide duct.

In addition, the present disclosure can provide an advantage of effectively lowering dynamic pressure generated during exhaust flow and significantly reducing aerodynamic noise by configuring an exhaust flow path space expanded by the guide duct to serve as a chamber buffering a rapid pressure rise of the exhaust gas.

In addition, the present disclosure provides excellent installation compatibility without concern of thermal deformation or contamination of adjacent furniture even in a closely-adhered built-in installation environment lacking free space by allowing an exhaust path to flexibly bypass upwardly or laterally regardless of a position or an exhaust direction of the internal exhaust hole using the guide duct and the extension plate.

BRIEF DESCRIPTION OF DRAWINGS

The accompanying drawings constitute a part of the specification, illustrate one or more embodiments in the disclosure, and together with the specification, explain the disclosure, wherein.

DETAILED DESCRIPTION

Figure 1:
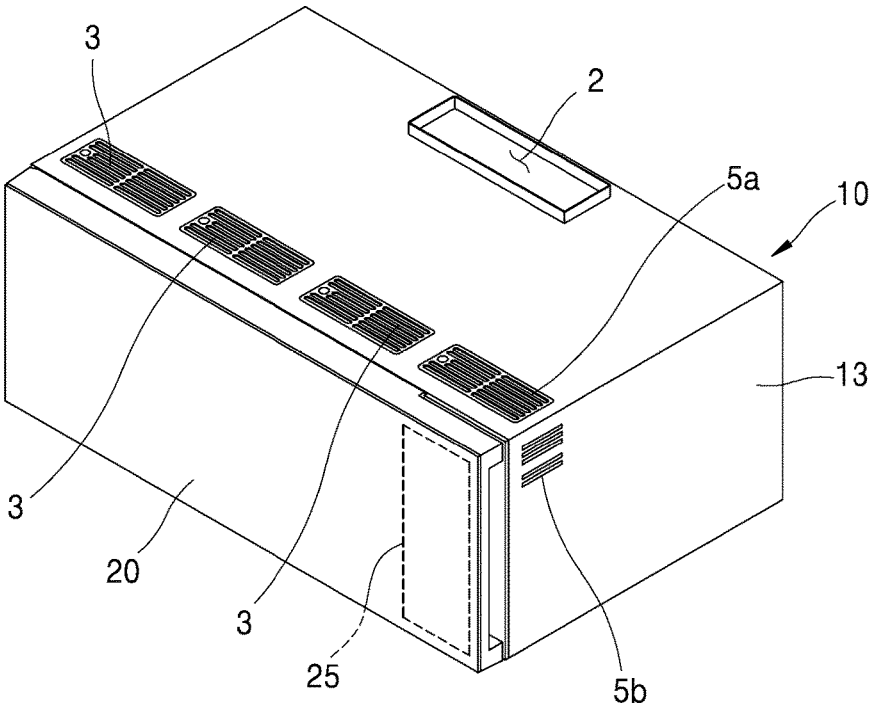
FIG. 1 is a perspective view illustrating a cooking appliance according to a first embodiment of the present disclosure.

The above-described aspects, features and advantages are specifically described hereafter with reference to accompanying drawings such that one having ordinary skill in the art to which the disclosure pertains can embody the technical spirit of the disclosure easily. In the disclosure, detailed description of known technologies in relation to the subject matter of the disclosure is omitted if it is deemed to make the gist of the disclosure unnecessarily vague. Hereafter, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components are not to be limited by the terms. Certainly, a first component can be a second component, unless stated to the contrary.

Embodiments are not limited to the embodiments set forth herein, and can be modified and changed in various different forms. The embodiments in the disclosure are provided such that the disclosure can be thorough and complete and fully convey its scope to one having ordinary skill in the art. Accordingly, all modifications, equivalents or replacements as well as a replacement of the configuration of any one embodiment with the configuration of another embodiment or an addition of the configuration of any one embodiment to the configuration of another embodiment, within the technical spirit and scope of the disclosure, are to be included in the scope of the disclosure.

The accompanying drawings are provided for a better understanding of the embodiments set forth herein and are not intended to limit the technical spirit of the disclosure. It is to be understood that all the modifications, equivalents or replacements within the spirit and technical scope of the disclosure are included in the scope of the disclosure. The sizes or thicknesses of the components in the drawings are exaggerated or reduced to ensure ease of understanding and the like. However, the protection scope of the subject matter of the disclosure is not to be interpreted in a limited way.

The terms in the disclosure are used only to describe specific embodiments or examples and not intended to limit the subject matter of the disclosure. In the disclosure, singular forms include plural forms as well, unless explicitly indicated otherwise. In the disclosure, the terms "comprise", "comprised of" and the like specify the presence of stated features, integers, steps, operations, elements, components or combinations thereof but do not imply the exclusion of the presence or addition of one or more other features, integers, steps, operations, elements, components or combinations thereof.

The terms "first", "second" and the like are used herein only to distinguish one component from another component, and the components are not to be limited by the terms.

When any one component is described as "connected" or "coupled" to another component, any one component can be directly connected or coupled to another component, but an additional component can be "interposed" between the two components or the two components can be "connected" or "coupled" by an additional component. When any one component is described as "directly connected" or "directly coupled" to another component, an additional component cannot be "interposed" between the two components or the two components cannot be "connected" or "coupled" by an additional component.

When any one component is described as being "on (or under)" another component, any one component can be directly on (or under) another component, and an additional component can be interposed between the two components.

Unless otherwise defined, all the terms including technical or scientific terms used herein have the same meaning as commonly understood by one having ordinary skill in the art. Additionally, terms such as those defined in commonly used dictionaries are to be interpreted as having a meaning that is consistent with their meaning in the context of the relevant art, and unless explicitly defined herein, are not to be interpreted in an ideal way or an overly formal way.

In the state where a cooking appliance stands on the floor, a direction in which a door is installed with respect to the center of the cooking appliance is defined as a forward direction. Accordingly, a direction toward the inside of the cooking appliance with the door open is defined as a rearward direction. For convenience, the forward direction and the rearward direction can be referred to as a first direction. Then the forward direction is referred to as one direction of the first direction, and the rearward direction is referred to as the other direction of the first direction.

Additionally, a gravitational direction can be defined as a downward direction, and a direction opposite to the gravitational direction can be defined as an upward direction.

Further, a horizontal direction across a front-rear direction of the cooking appliance, i.e., a widthwise direction of the cooking appliance that is seen in front of the door of the cooking appliance, can be referred to as a left-right direction. For convenience, the left-right direction can be referred to as a second direction. Then the right side can be referred to as one direction of the second direction, and the left side can be referred to as the other direction of the second direction.

Further, the widthwise direction of the cooking appliance can In addition be referred to as a lateral direction. Then the right side can also be referred to as one side of the lateral direction, and the left side can be referred to the other side of the lateral direction.

Additionally, an up-down direction can be referred to as a third direction. Then an upward direction can be referred to as one direction of the third direction, and a downward direction can be referred to as the other direction of the third direction.

Furthermore, the up-down direction can be referred to as a vertical direction. Then the front-rear direction and the left-right direction, i.e., the first direction and the second direction, can be referred to as the horizontal direction.

Throughout the disclosure, the terms "A and/or B" as used herein can denote A, B or A and B, and the terms "C to D" can denote C or greater and D or less, unless stated to the contrary.

[Entire Structure of Cooking Appliance]

Figure 2:
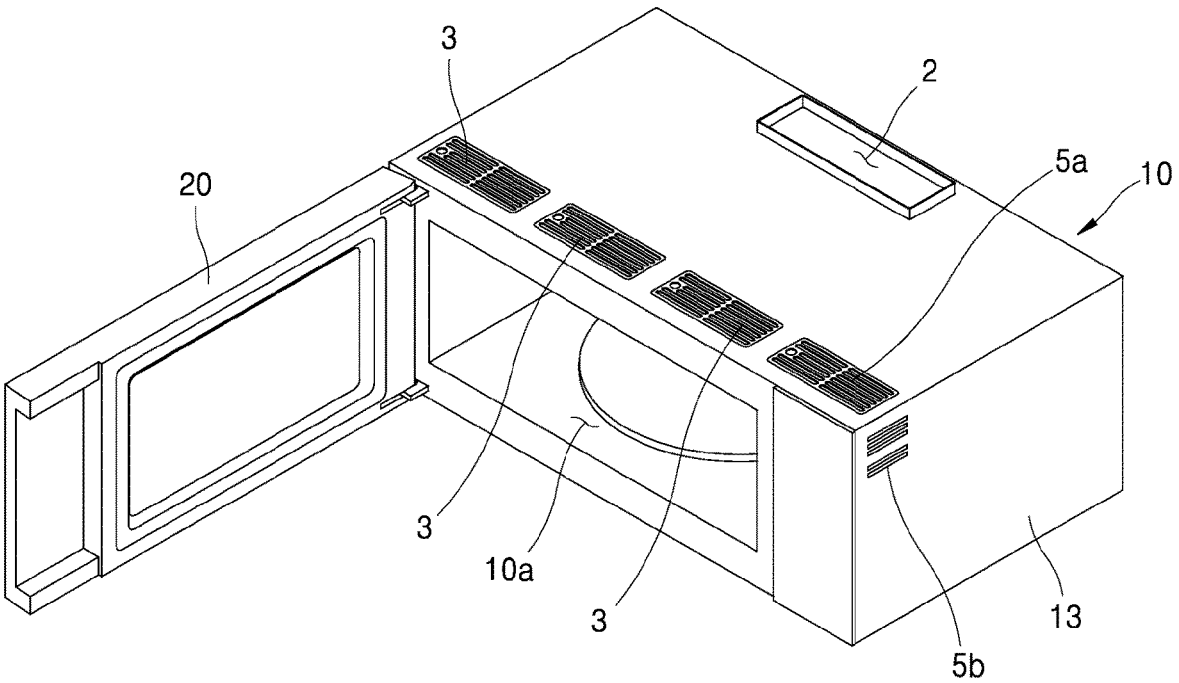
FIG. 2 is a view illustrating a cooking chamber opened state of the cooking appliance illustrated in FIG. 1.
Figure 3:
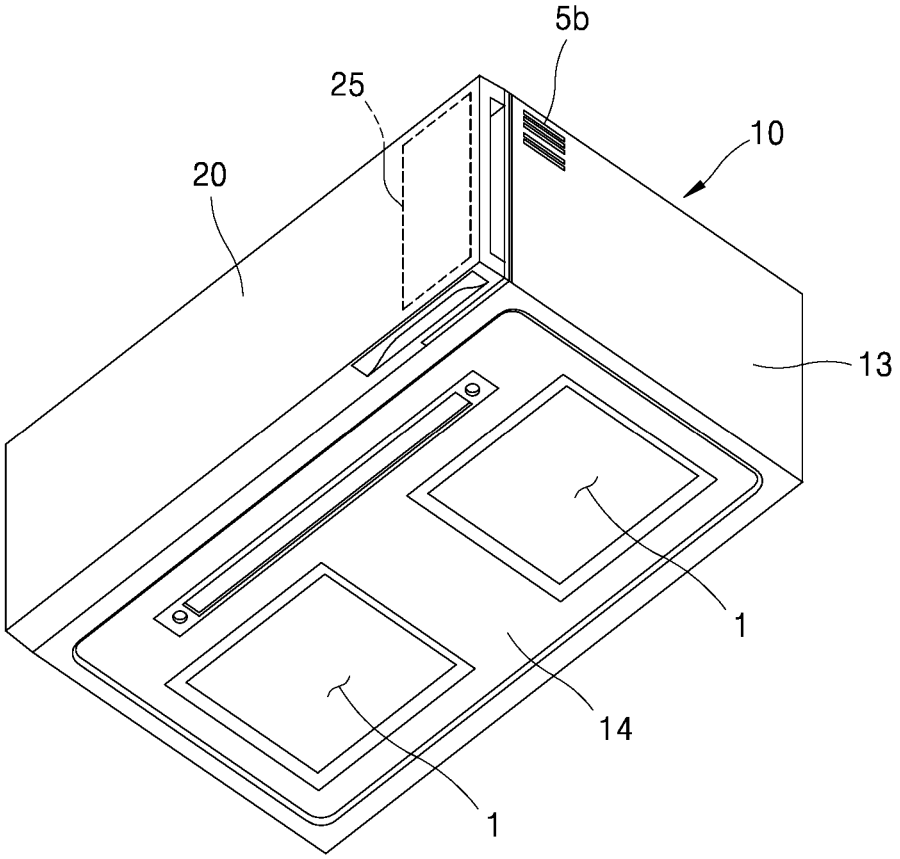
FIG. 3 is a bottom perspective view illustrating a bottom surface of the cooking appliance illustrated in FIG. 1.
Figure 4:
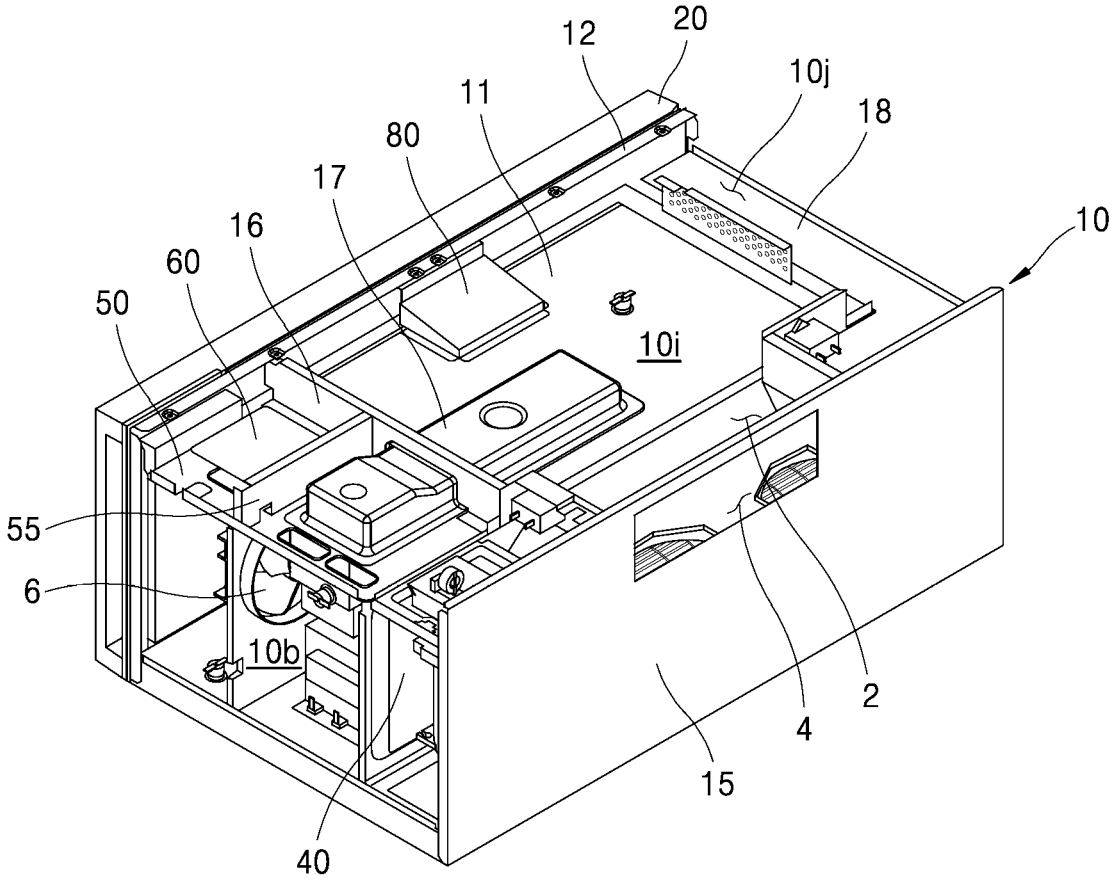
FIG. 4 is a rear perspective view illustrating a state in which a cabinet is removed from the cooking appliance illustrated in FIG. 1.

FIG. 1 is a perspective view illustrating a cooking appliance according to a first embodiment of the present disclosure, and FIG. 2 is a view illustrating a cooking chamber opened state of the cooking appliance illustrated in FIG. 1. Also, FIG. 3 is a bottom perspective view illustrating a bottom surface of the cooking appliance illustrated in FIG. 1, and FIG. 4 is a rear perspective view illustrating a state in which a cabinet is removed from the cooking appliance illustrated in FIG. 1.

Referring to FIGS. 1 to 4, a cooking appliance according to an embodiment of the present disclosure has an exterior formed by a main body 10. The main body 10 may be provided in a shape including a substantially rectangular parallelepiped shape, and may be formed of a material having a predetermined strength to protect a plurality of components installed in an inner space thereof. Such a main body 10 may include a cavity 11, a cabinet 13, and a base plate 14.

The cavity 11 may form an internal skeleton of the main body 10. Such a cavity 11 may be formed in a shape of a hexahedron with an open front surface. A cooking chamber 10*a* may be formed in an inside of the cavity 11. The cooking chamber 10*a* may be formed in a shape corresponding to an internal shape of the cavity 11, that is, a shape of a hexahedron with an open front surface.

The cooking chamber 10*a* may be formed in a shape of a hexahedron with an open front surface. In a state where such a cooking chamber 10*a* is shielded, cooking may be performed while an inner space of the cooking chamber 10*a* is heated. That is, in the cooking appliance, the inner space of the cooking chamber 10*a* is a space where food is substantially cooked.

A front plate 12 may be disposed in front of the cavity 11. Such a front plate 12 may form a front exterior of the main body 10 in front of the cavity 11. As an example, the front plate 12 may be provided in a shape of a metal plate with a hollow formed therein.

The cabinet 13 may form an exterior of the main body 10 at an outside of the cavity 11. Such a cabinet 13 covers the cavity 11 at an upper portion and a side portion, and may form the exterior of the main body 10.

The base plate 14 may be disposed below the cavity 11. Such a base plate 14 forms a bottom surface of the cooking appliance, and may cover the cavity 11 below the cavity 11.

In addition, the main body 10 may further include a rear plate 15. The rear plate 15 may be disposed at a rear side of the cavity 11. Such a rear plate 15 forms a rear surface of the cooking appliance, and may cover the cavity 11 at a rear side of the cavity 11.

The rear plate 15 may be formed integrally with the cabinet 13, or may be formed as a separate piece from the cabinet 13.

A door 20 selectively opening and closing the cooking chamber 10*a* may be pivotably provided in front of the main body 10. The door 20 may open and close the cooking chamber 10*a* in a side-swing manner in which the other lateral side pivots left and right centering on one lateral side.

Such a door 20 may entirely be formed in a hexahedral shape having a predetermined thickness. And a hinge may be installed between the main body 10 and the door 20. The hinge may be disposed on one lateral side of the main body 10 to rotatably couple one lateral side of the door 20 to the main body 10. The door 20 may be rotatably coupled to the hinge on a front surface of the main body 10, and may open and close the cooking chamber 10*a* while rotating centering on the hinge.

Also, a cooking chamber heat source for heating in the cooking chamber 10*a* is provided in an inside of the main body 10. The cooking chamber heat source may be implemented as a single type, and may also be implemented as two or more types.

In this case, the magnetron may be installed inside the main body 10, and may be installed to be located in an upper portion or a side portion of the cooking chamber 10*a*.

Also, an electronic/electrical component chamber 10*b*, 10*c*, 10*d* positioned in an upper portion or a side portion of the cooking chamber 10*a* within the main body 10 may be formed in an inside of the main body 10. In the present embodiment, the magnetron and the electronic/electrical component chamber 10*b*, 10*c*, 10*d* are exemplified as being disposed on a side portion of the cooking chamber 10*a*. An electronic/electrical component such as a magnetron, a high-voltage transformer, etc. may be installed in an inside of the electronic/electrical component chamber 10*b*, 10*c*, 10*d*.

In addition, a control panel 25 may be provided on a front side of the main body 10. As an example, the control panel 25 may be disposed on the door 20.

The control panel 25 may be formed in a shape of a hexahedron having a predetermined inner space, and an input unit in which a user inputs an operation signal for operating the cooking appliance may be provided on a front surface of the control panel 25. A plurality of operation switches are provided in the input unit, and through this, the user can directly input an operation signal.

As another example, the control panel 25 may be disposed on a front side of the cavity 11. Such a control panel 25 may be disposed in an area not overlapping the cooking chamber 10*a* in a front-rear direction. For example, the electronic/electrical component chamber 10*b*, 10*c*, 10*d* may be disposed on a side portion of the cooking chamber 10*a*, and the control panel 25 may be disposed on a front side of the electronic/electrical component chamber 10*b*, 10*c*, 10*d*.

In addition, the cooking appliance of the present embodiment may further include a blower 100, 200. And an air intake hole 1 and an exhaust hole 2, 3, 4 may be provided in the main body 10.

The blower 100, 200 is accommodated in an inside of the cooking appliance, and may suction a cooking gas through the air intake hole 1, and discharge the suctioned cooking gas to an exterior of the cooking appliance through the exhaust hole 2, 3, 4.

[Air Intake Hole, Exhaust Hole, Space]

Figure 5:
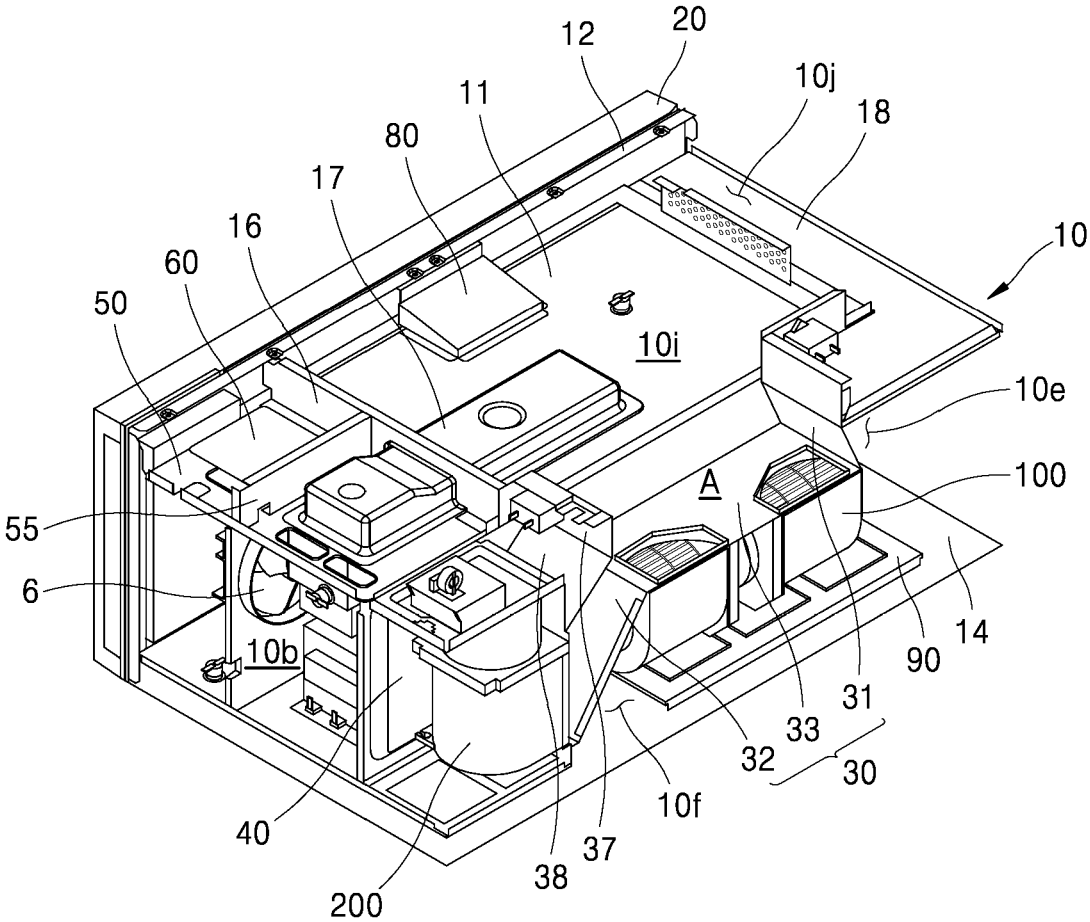
FIGS. 5 and 6 are rear perspective views illustrating a state in which a rear plate is removed from the cooking appliance illustrated in FIG. 4.
Figure 6:
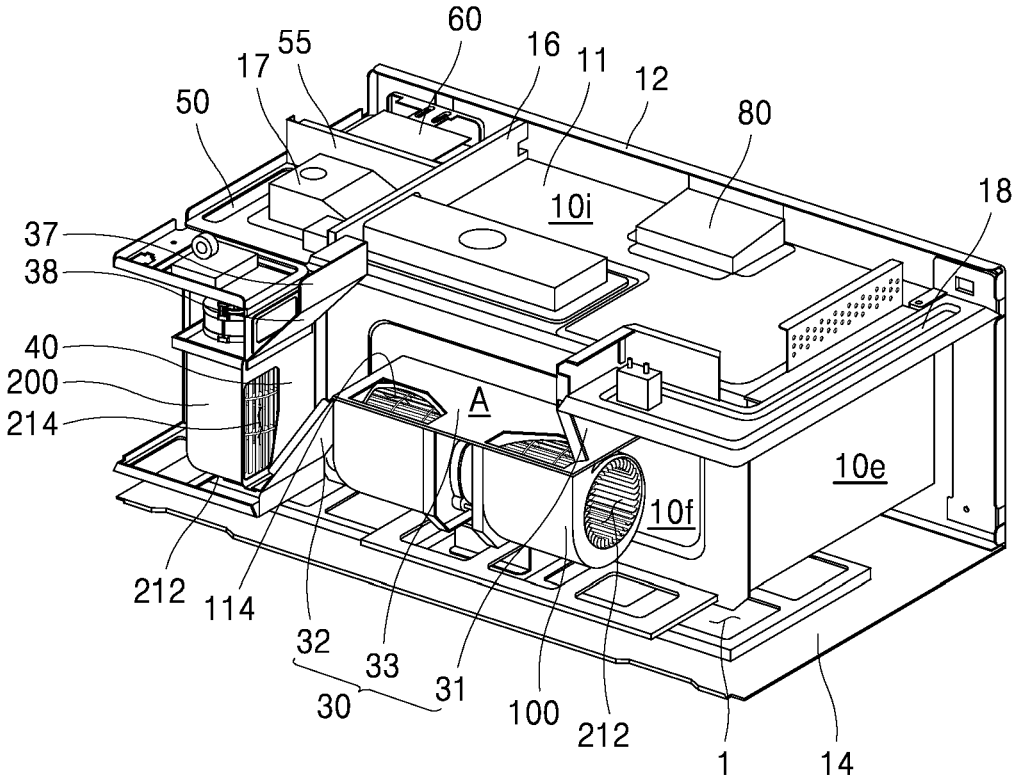
Figure 7:
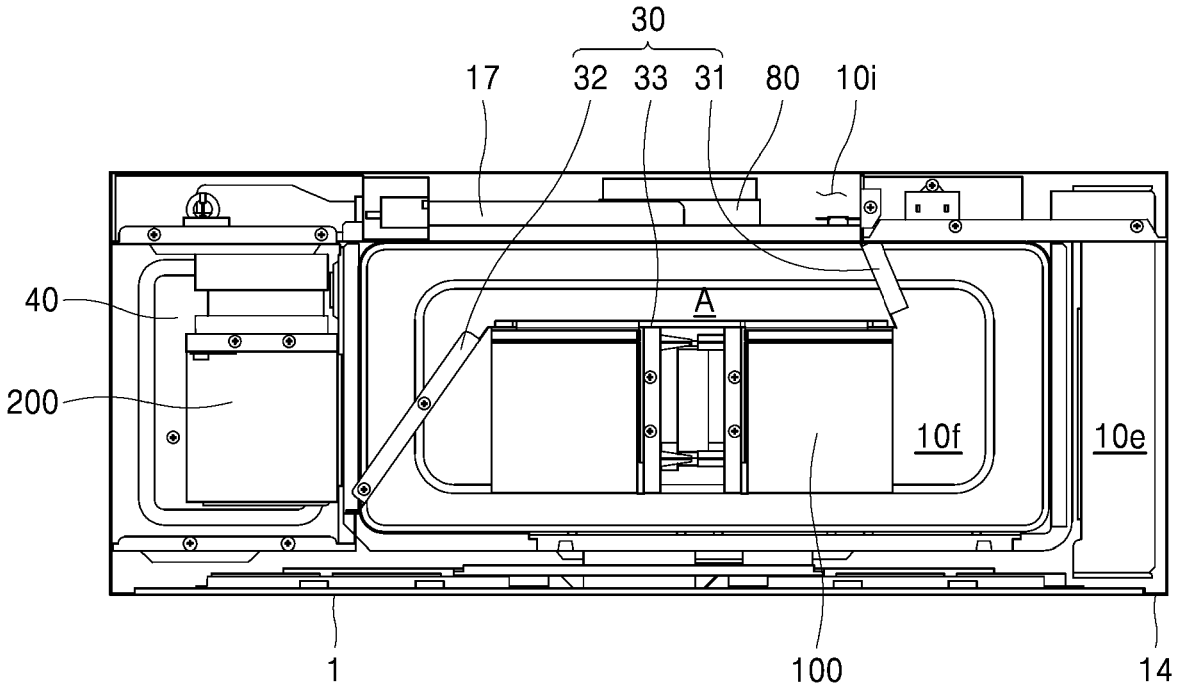
FIG. 7 is a rear view of the cooking appliance illustrated in FIG. 6.

FIGS. 5 and 6 are rear perspective views illustrating a state in which a rear plate is removed from the cooking appliance illustrated in FIG. 4, and FIG. 7 is a rear view of the cooking appliance illustrated in FIG. 6.

Referring to FIGS. 3 to 7, the air intake hole 1 may be disposed on a bottom surface of the cooking appliance. As an example, the air intake hole 1 may be provided in the base plate 14. Such an air intake hole 1 may form a passage for introducing the cooking gas into an inside of the cooking appliance at a lower end of the cooking appliance. In the present embodiment, it is exemplified that a pair of air intake holes 1 are disposed below the blower 100, 200.

The base plate 14 may be disposed to be spaced apart downward from a bottom surface of the cavity 11 by a predetermined interval. Accordingly, a lower space may be formed between the bottom surface of the cavity 11 and the base plate 14. By the lower space formed in this way, a space required for external air to flow into an inside of the cooking appliance through the air intake hole 1 may be provided above the air intake hole 1.

The exhaust hole 2, 3, 4 may be disposed above the cooking appliance. Such an exhaust hole 2, 3, 4 may be configured to form a passage for discharging the cooking gas suctioned into an inside of the cooking appliance to an exterior of the cooking appliance in an upper portion of the cooking appliance.

In the present embodiment, it is exemplified that a first exhaust hole 2, a second exhaust hole 3, and a third exhaust hole 4 are provided in the cooking appliance.

The first exhaust hole 2 and the second exhaust hole 3 may be disposed on an upper surface of the main body 10. Such a first exhaust hole 2 and a second exhaust hole 3 may be configured to form a passage for discharging the cooking gas suctioned into an inside of the cooking appliance to an exterior of the cooking appliance at an upper end of the cooking appliance.

As an example, the first exhaust hole 2 and the second exhaust hole 3 may be provided on an upper surface of the cabinet 13. Such a first exhaust hole 2 and a second exhaust hole 3 may be formed to pass through the upper surface of the cabinet 13 in a vertical direction.

Among them, the first exhaust hole 2 may be disposed at a rear side of the main body 10. And the second exhaust hole 3 may be disposed at a front side of the main body 10. That is, the second exhaust hole 3 is disposed on a side adjacent to the door 20, and may be disposed biased toward a front side compared to the first exhaust hole 2.

The first exhaust hole 2 may be configured to form a passage for discharging the cooking gas suctioned into an inside of the cooking appliance to outdoor. And the second exhaust hole 3 may be configured to form a passage for discharging the cooking gas suctioned into an inside of the cooking appliance to indoor.

As an example, the first exhaust hole 2 may be disposed in a region overlapping in a vertical direction with an upper cabinet installed above the cooking appliance. And the second exhaust hole 3 may be disposed at a position protruding forward than the upper cabinet.

Also, the first exhaust hole 2 may be disposed approximately at a lateral center of the main body 10. And on a front side of the main body 10, a plurality of second exhaust holes 3 may be disposed along a lateral direction.

In this case, the cooking gas may be discharged through the second exhaust hole 3 in a filtered state in an inside of the cooking appliance.

The third exhaust hole 4, like the first exhaust hole 2, may be configured to form a passage for discharging the cooking gas suctioned into an inside of the cooking appliance to outdoor. The third exhaust hole 4 may be disposed to face a wall surface on which the cooking appliance is installed. Such a third exhaust hole 4 may be installed on the wall surface and connected to an exhaust pipe connected to the outdoor.

The third exhaust hole 4 is disposed on a rear surface of the cooking appliance, and may be disposed above the blower 100, 200. As an example, the third exhaust hole 4 may be provided in the rear plate 15. Such a third exhaust hole 4 may be formed to pass through the rear plate 15 in a front-rear direction.

A space may be formed in an inside of the main body 10. Such a space may be disposed between the cavity 11 and the cabinet 13.

The space may be divided into a side space 10*e* and a rear space 10*f* The side space 10*e* may be respectively disposed on both lateral sides of the cavity 11. And the rear space 10*f* may be disposed at a rear side of the cavity 11.

For example, the side space 10*e* may be a space respectively formed between a side surface of the cavity 11 and a side surface of the cabinet 13. And the rear space 10*f* may be a space formed between a rear surface of the cavity 11 and the rear plate 15.

The side space 10*e* and the rear space 10*f* may communicate with the lower space. The side space 10*e* and the rear space 10*f* may be connected to the lower space in a vertical direction, or may be connected in a lateral direction. The air intake hole 1 communicates with the lower space, and the side space 10*e* and the rear space 10*f* may communicate with the air intake hole 1 through the lower space.

An electronic/electrical component chamber 10*b*, 10*c*, 10*d* may be disposed in any one of the side spaces 10*e*. In the present embodiment, it is exemplified that the electronic/electrical component chamber 10*b*, 10*c*, 10*d* is provided in a side space disposed at a rear side of the control panel 25.

Also, a space disposed at a rear side of the cavity 11 and at a lateral side of the cavity 11 may be formed in an inside of the main body 10. Such a space may be the rear space 10*f*, the side space 10*e*, or the electronic/electrical component chamber 10*b*, 10*c*, 10*d*.

For example, the space may be disposed in a rear corner portion inside the main body 10. Hereinafter, the space disposed at a rear side of the electronic/electrical component chamber 10*b*, 10*c*, 10*d* will be referred to as a corner space 10*g*, 10*h*. The rear space 10*f* and the side space 10*e*, more specifically, the rear space 10*f* and the electronic/electrical component chamber 10*b*, 10*c*, 10*d* may communicate through the corner space 10*g*, 10*h*.

The blower 100, 200 may be disposed in an inside of the main body 10. More specifically, the blower 100, 200 may be disposed in a space, that is, a space between the cavity 11 and the cabinet 13. The blower 100, 200 may include at least one fan assembly 100, 200.

The fan assembly 100, 200 may generate an airflow for suctioning a cooking gas outside the cooking appliance and then discharging it to an exterior of the cooking appliance. Such a fan assembly 100, 200 can introduce a cooking gas into an inside of the main body 10 through the air intake hole 1 and discharge the introduced cooking gas through the exhaust hole 2, 3, 4.

At least one of the fan assemblies 100, 200 provided in the blower 100, 200 may be disposed in the rear space 10*f*. Accordingly, the cooking gas introduced into an inside of the main body 10 through the air intake hole 1 may be discharged through the first exhaust hole 2 or the second exhaust hole 3 after passing through the rear space 10*f*. A specific arrangement structure of the fan assembly 100, 200 will be described later.

In addition, an upper space 10*i* may be further provided in an inside of the main body 10. The upper space 10*i* may be disposed above the cavity 11.

For example, the upper space 10*i* may be formed between an upper surface of the cavity 11 and an upper surface of the cabinet 13. Such an upper space 10*i* may be connected to the rear space 10*f*.

That is, air introduced into the rear space 10*f* may pass through the upper space 10*i* and be discharged to an exterior of the cooking appliance through the exhaust hole 2, 3, 4. Also, air introduced into the side space 10*e* may pass through the rear space 10*f* and the upper space 10*i*, and be discharged to an exterior of the cooking appliance through the exhaust hole 2, 3, 4.

[Fan Assembly]

Figure 8:
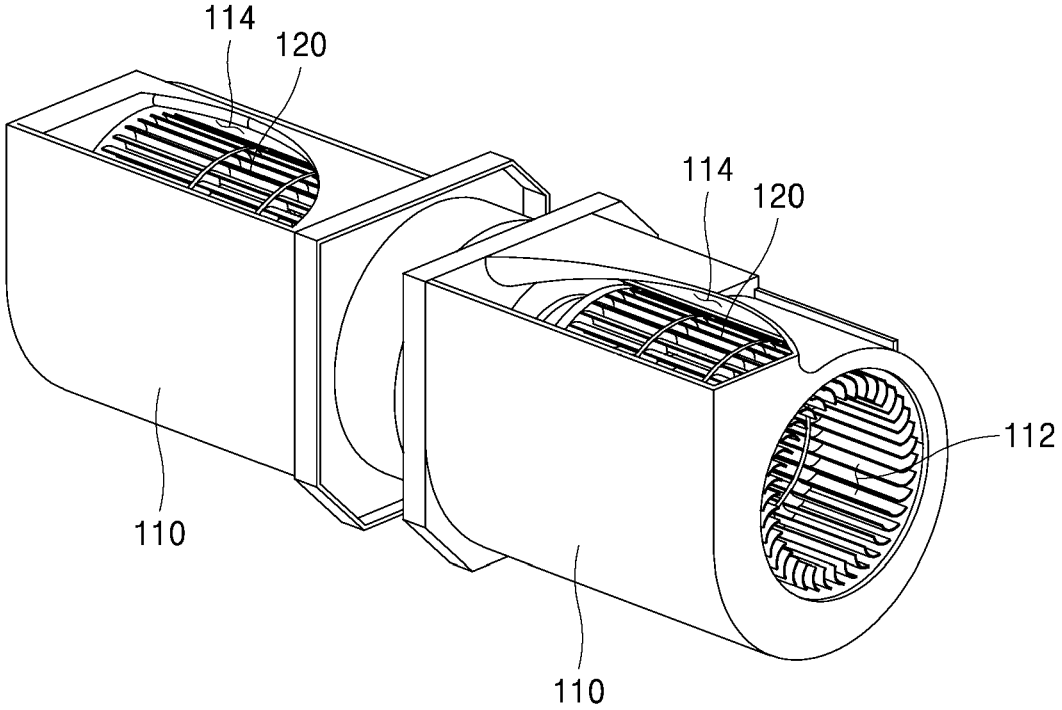
FIG. 8 is a perspective view illustrating a rear fan assembly illustrated in FIG. 6 in an exploded state.
Figure 9:
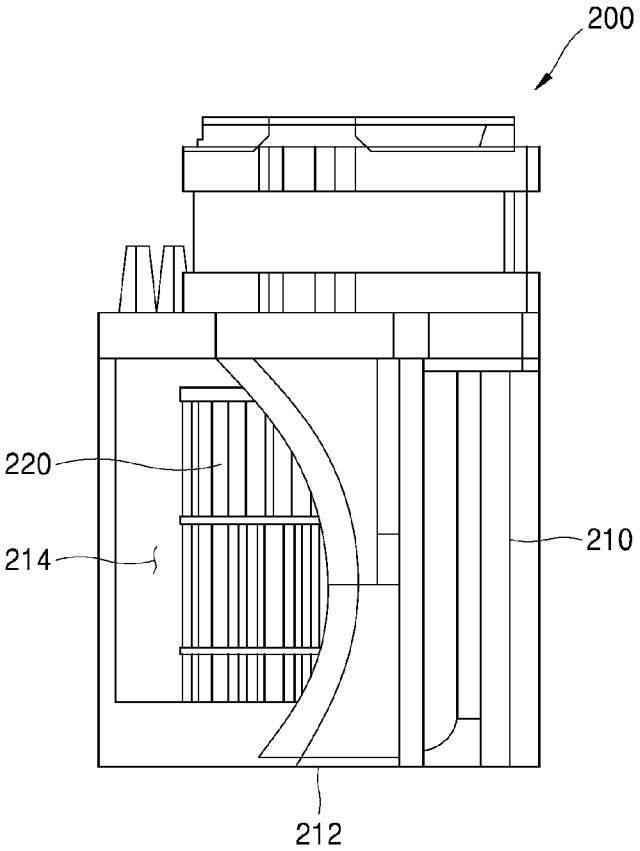
FIG. 9 is a perspective view illustrating a corner fan assembly illustrated in FIG. 6 in an exploded state.

FIG. 8 is a perspective view illustrating a rear fan assembly illustrated in FIG. 6 in an exploded state, and FIG. 9 is a perspective view illustrating a corner fan assembly illustrated in FIG. 6 in an exploded state.

Referring to FIG. 1 and FIGS. 7 to 8, the blower 100, 200 may include at least one fan assembly 100, 200. As an example, the blower 100, 200 may include a rear fan assembly 100.

The rear fan assembly 100 may include a fan housing 110, an impeller 120, and a fan motor.

The fan housing 110 forms an exterior of the rear fan assembly 100, and may accommodate the impeller 120 therein. A first suction hole 112 may be formed at a side portion of the fan housing 110. The first suction hole 112 may form a passage required for air outside the rear fan assembly 100 to be suctioned into an inside of the impeller 120 in the fan housing 110.

In the present embodiment, the fan housing 110 is exemplified as being formed in a shape including a lying cylindrical shape whose both side portions are open, and opened both side portions of the fan housing 110 may be provided as the first suction hole 112.

An accommodation space accommodating the impeller 120 may be formed in an inside of the fan housing 110. And an inner circumferential surface of the fan housing 110 facing the accommodation space may be formed as a curved surface surrounding an outer circumferential surface of the impeller 120.

A first discharge hole 114 may be provided above the fan housing 110. The first discharge hole 114 forms a passage through which air suctioned into the accommodation space where the impeller 120 is accommodated is discharged to an exterior of the blower 100, 200.

The first discharge hole 114 may be formed in a shape penetrating the fan housing 110 in a vertical direction. Accordingly, air suctioned laterally into an inside of the fan housing 110 through the first suction hole 112 may be discharged to above the fan housing 110 through the first discharge hole 114.

The impeller 120 is provided to be rotatable around an axis extending laterally. A space portion into which air suctioned through a side portion of the impeller 120 flows is formed in an inside of the impeller 120.

The impeller 120 may be connected to a rotation shaft of the fan motor. The rotation shaft of the fan motor rotates around an axis extending laterally, and the impeller 120 connected to the rotation shaft of such a fan motor may rotate together with the rotation shaft of the fan motor around the axis extending laterally.

The rear fan assembly 100 provided as described above is disposed inside the main body 10, and may be disposed in at least one of the rear space 10*f* and the corner space 10*g*, 10*h*. In the present embodiment, it is exemplified that the rear fan assembly 100 is disposed in the rear space 10*f*.

As an example, the rear fan assembly 100 may be provided in a shape including a pair of impellers 120. Such a rear fan assembly 100 may be provided in a shape in which the fan motor is disposed between a pair of impellers 120 arranged laterally.

In the rear fan assembly 100, the fan motor may rotate together a pair of impellers 120 disposed on both sides thereof. And each impeller 120 may be accommodated in an inside of a pair of fan housings 110 disposed on both sides of the fan motor.

As described above, the rear fan assembly 100 including one fan motor and a pair of impellers 120 and fan housings 110 may suction air through a pair of first suction holes 112 respectively disposed on both lateral sides of the rear fan assembly 100, and discharge air through a pair of first discharge holes 114 disposed above the rear fan assembly 100.

The rear fan assembly 100 may be provided in a shape in which a pair of impellers 120 and fan housings 110 are disposed on both sides of the fan motor. Hereinafter, an assembly of the impeller 120 and the fan housing 110 will be referred to as a "fan module". According to this, it can be said that each rear fan assembly 100 is provided in a shape in which a pair of fan modules are connected to both sides of the fan motor.

The rear fan assembly 100 may be disposed in the rear space 10*f*, that is, a space formed between a rear surface of the cavity 11 and the rear plate 15. Such a rear fan assembly 100 may be disposed in a space communicating with the air intake hole 1 and the exhaust hole 2, 3, 4, suction air through the air intake hole 1, and discharge air toward the exhaust hole 2, 3, 4.

Also, the rear fan assembly 100 may be disposed at a lateral center of the rear space 10*f*. That is, the rear fan assembly 100 may be disposed approximately at a rear center side inside the cooking appliance.

According to the present embodiment, the first exhaust hole 2 is disposed approximately at a lateral center of the main body 10, and may be disposed at a position biased rearward on an upper surface of the cabinet 13. Also, the first exhaust hole 2 may be disposed in a region overlapping in a vertical direction with the fan assembly 100, 200. That is, the first exhaust hole 2 may be disposed in a region overlapping in a vertical direction with the rear space 10*f* and the rear fan assembly 100.

Also, the third exhaust hole 4 is disposed approximately at a lateral center of the main body 10, and may be disposed at a position biased upward in the rear plate 15. That is, the third exhaust hole 4 is disposed on a rear surface of the main body 10, and may be disposed at a position adjacent to the first exhaust hole 2.

In the cooking appliance of the present embodiment, the first exhaust hole 2, the third exhaust hole 4, and the rear fan assembly 100 are all disposed in the rear space 10*f*, and on the rear space 10*f*, the first exhaust hole 2 and the third exhaust hole 4, particularly the first exhaust hole 2, may be arranged with the rear fan assembly 100 in a vertical direction.

That is, the rear fan assembly 100, the rear space 10*f*, the first exhaust hole 2, and the third exhaust hole 4 may be disposed at positions overlapping in a vertical direction. Preferably, the rear fan assembly 100, the rear space 10*f*, the first exhaust hole 2, and the third exhaust hole 4 may be arranged in a line along a vertical direction.

Accordingly, a flow of air generated by an operation of the rear fan assembly 100 may be made in a same straight direction as an arrangement direction of the rear fan assembly 100, the rear space 10*f*, the first exhaust hole 2, and the third exhaust hole 4.

When a flow of air is made in a straight direction like this, a resistance to air flow is lowered proportionally, enabling the flow of air to be made more smoothly. Accordingly, air suction and discharge performance by the rear fan assembly 100 can be improved, so cooking gas removal performance of the cooking appliance can be improved proportionally.

The blower 100, 200 of the present embodiment may include a plurality of fan assemblies 100, 200 arranged laterally. As an example, the blower 100, 200 may further include a corner fan assembly 200 as illustrated in FIGS. 7 and 9. The rear fan assembly 100 and the corner fan assembly 200 may be arranged laterally in the rear space 10*f*.

The corner fan assembly 200 may be provided in a shape in which one fan module is connected to a fan motor. As an example, the corner fan assembly 200 may be provided in a shape in which one fan module is connected below a fan motor.

In such a corner fan assembly 200, an impeller 220 may rotate centering on a vertical axis. And a second suction hole 212 is disposed below a fan housing 210, and a second discharge hole 214 may be disposed on a side portion of the fan housing 210.

That is, the corner fan assembly 200 may be provided in a shape similar to a shape in which approximately half of the rear fan assembly 100 is erected longitudinally.

In the rear space 10*f*, the rear fan assembly 100 and the corner fan assembly 200 may be disposed together. As an example, the rear fan assembly 100 and the corner fan assembly 200 may be arranged laterally in the rear space 10*f*.

For example, the corner fan assembly 200 may be disposed on a side adjacent to the electronic/electrical component chamber 10*b*, 10*c*, 10*d*, and the rear fan assembly 100 may be disposed on a side adjacent to an opposite side space 10*e*.

At least a portion of the corner fan assembly 200 may be disposed in the corner space 10*g*, 10*h*. As an example, most areas of the corner fan assembly 200 may be disposed in the corner space 10*g*, 10*h*, and the second suction hole 212 of the corner fan assembly 200 may also be disposed in the corner space 10*g*, 10*h*. The corner fan assembly 200 may be disposed to be spaced apart laterally by a predetermined interval from the rear fan assembly 100.

According to the present embodiment, the blower 100, 200 may include a rear fan assembly 100 and a corner fan assembly 200 together instead of including only a plurality of rear fan assemblies 100.

As the rear fan assembly 100 and the corner fan assembly 200 are applied together to the blower 100, 200 like this, a lateral length of an entirety of the blower 100, 200 can be reduced compared to a case where the blower 100, 200 includes only a plurality of rear fan assemblies 100.

For example, a lateral length of a blower 100, 200 including one rear fan assembly 100 and one corner fan assembly 200 can be measured to be shorter compared to a blower 200 including a pair of laterally arranged rear fan assemblies 100.

The corner fan assembly 200 not only includes some of fan modules included in the rear fan assembly 100, but is provided in a shape including a longitudinally erected fan module. Therefore, a lateral length of the corner fan assembly 200 is inevitably very short compared to the rear fan assembly 100.

Considering this point, it can be said that the blower 100, 200 of the present embodiment including such a corner fan assembly 200 can be provided in a significantly smaller size compared to the rear fan assembly 100 or a blower including only the rear fan assembly 100.

When a blower 100, 200 of such a shape is applied to a cooking appliance, a size of the cooking appliance, especially a lateral length of the cooking appliance, can be reduced as much as a space occupied by the blower 100, 200 is reduced.

Considering this point, when a size of the cooking appliance is slightly small to arrange a plurality of rear fan assemblies 100 in an inside of the cooking appliance, it can be said that the blower 100, 200 of the present embodiment is very suitable to be applied to this cooking appliance.

Also, in the corner fan assembly 200, a second suction hole 212 may be disposed below a fan housing 210. Accordingly, the second suction hole 212 may be disposed at a lowermost end of the corner fan assembly 200, and may be disposed at a position very adjacent to the air intake hole 1 provided at a lower end of the cooking appliance.

Considering a point that as a distance between the second suction hole 212 and the air intake hole 1 becomes closer, suction performance of the fan assembly relative to an output of the fan motor can be significantly improved, it can be seen that suction performance of the corner fan assembly 200 can be improved to a considerable level as the second suction hole 212 of the corner fan assembly 200 becomes closer to the air intake hole 1 in this way.

That is, although performance of the corner fan assembly 200 may be lower compared to the rear fan assembly 100, such a performance difference can be mostly offset by a performance improvement value obtained due to shortening of the distance between the second suction hole 212 and the air intake hole 1.

Considering this point, the blower 100, 200 of the present embodiment can be evaluated as being capable of providing an effect of contributing to miniaturization of the cooking appliance while providing cooking gas removal performance of an equal level or higher compared to blowers of other shapes.

The cooking appliance of the present embodiment including the blower 100, 200 as described above can provide improved cooking gas removal performance while maintaining a compact size.

Meanwhile, referring to FIGS. 5 to 7, the rear fan assembly 100 and the corner fan assembly 200 may be disposed at a position overlapping in a front-rear direction with the cavity 11. That is, the rear fan assembly 100 and the corner fan assembly 200 may be disposed between an upper surface and a lower surface of the cavity 11 with respect to a vertical direction.

In order for air introduced into an inside of the main body 10 through the air intake hole 1 to smoothly move toward the rear fan assembly 100 or the corner fan assembly 200, a certain distance should be secured between the rear fan assembly 100 and the corner fan assembly 200 and the air intake hole 1.

Also, in order for air discharged from the rear fan assembly 100 and the corner fan assembly 200 to smoothly move toward the upper space 10*i*, it is preferable that the rear fan assembly 100 and the corner fan assembly 200 are disposed at a position lower than the upper space 10*i*.

When the rear fan assembly 100 and the corner fan assembly 200 are disposed at a position higher than the upper space 10*i*, a problem that a passage between the first discharge hole 114 of the rear fan assembly 100 or the corner fan assembly 200 and the upper space 10*i* becomes too narrow may occur.

Considering this point, in the present embodiment, the rear fan assembly 100 and the corner fan assembly 200 are disposed at a position where a space between the rear fan assembly 100 and the corner fan assembly 200 and the air intake hole 1, and a space between the rear fan assembly 100 and the corner fan assembly 200 and the upper space 10*i* can be properly spaced apart.

Accordingly, a flow of air from the air intake hole 1 to the rear fan assembly 100 and the corner fan assembly 200 and a flow of air from the rear fan assembly 100 and the corner fan assembly 200 to the upper space 10*i* can be made smoothly.

Also, the corner fan assembly 200 may be disposed at a position closer to the air intake hole 1 than the exhaust hole 2, 3, 4. Accordingly, the second suction hole 212 of the corner fan assembly 200 can be disposed at a position very adjacent to the air intake hole 1. Through this, suction performance of the corner fan assembly 200 having a relatively small size and low output compared to the rear fan assembly 100 can be effectively improved.

[Example of Flow Path Defining Member]

Figure 10:
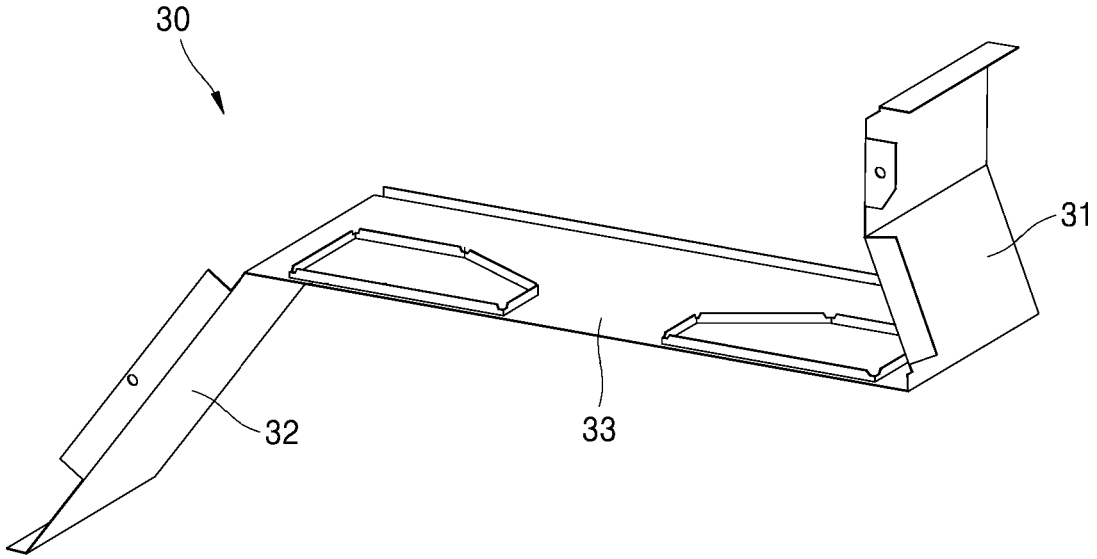
FIG. 10 is a rear perspective view illustrating a flow path defining member illustrated in FIG. 6 in an exploded state.
Figure 11:
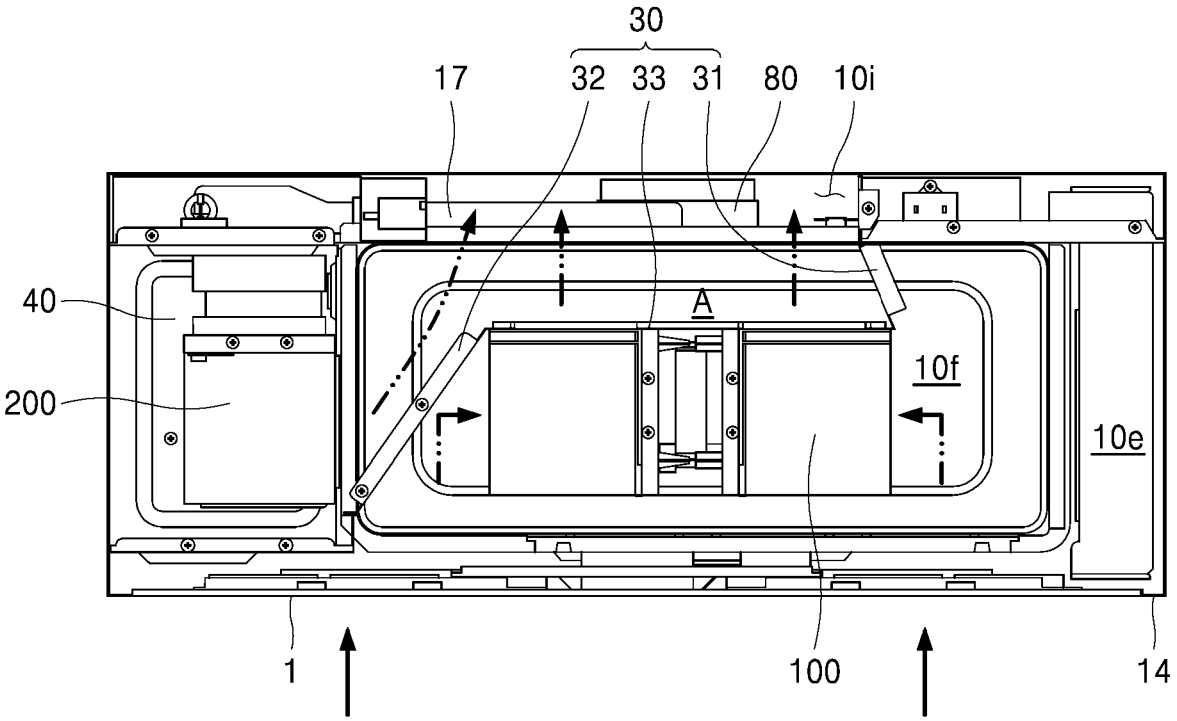
FIG. 11 is a rear view illustrating an air flow state in the cooking appliance according to the first embodiment of the present disclosure.

FIG. 10 is a rear perspective view illustrating a flow path defining member illustrated in FIG. 6 in an exploded state, and FIG. 11 is a rear view illustrating an air flow state in the cooking appliance according to the first embodiment of the present disclosure.

Referring to FIGS. 5 to 7 and FIG. 10, the cooking appliance may include a flow path defining member 30. The flow path defining member 30 is provided to guide a flow of air discharged from the blower 100, 200.

The flow path defining member 30 may form an exhaust flow path A in an inside of the cooking appliance. The exhaust flow path A may connect between the blower 100, 200 and the upper space 10*i*, and is provided to guide an air flow from at least one of the rear fan assembly 100 and the corner fan assembly 200 to the upper space 10*i*. Such an exhaust flow path A may guide a flow of air discharged from the blower 100, 200 toward the exhaust hole 2, 3, 4.

As an example, the exhaust flow path A may be disposed in the rear space 10*f*. An inlet of such an exhaust flow path A may be opened toward the blower 100, 200. For example, the inlet of the exhaust flow path A may be opened toward the first discharge hole 114 of the rear fan assembly 100 and the second discharge hole 214 of the corner fan assembly 200. And an outlet of the exhaust flow path A may be opened toward the upper space 10*i*.

The exhaust flow path A may form a flow path guiding an air flow from the first discharge hole 114 of the rear fan assembly 100 to the upper space 10*i* in an inside of the cooking appliance. Also, the exhaust flow path A may form a flow path guiding an air flow from the second discharge hole 214 of the corner fan assembly 200 to the upper space 10*i* in an inside of the cooking appliance.

As an example, at least a portion of the exhaust flow path A may be formed by a first flow path plate 31. The first flow path plate 31 may form a wall blocking between the first suction hole 112 and the first discharge hole 114 of the rear fan assembly 100.

Such a first flow path plate 31 is disposed in the rear space 10*f*, and may be disposed above the rear fan assembly 100. That is, the first flow path plate 31 may form a wall blocking between the first suction hole 112 and the first discharge hole 114 from above the rear fan assembly 100.

According to the present embodiment, the rear fan assembly 100 and the corner space 10*g*, 10*h* may be arranged laterally in the rear space 10*f*. In the rear space 10*f*, the first suction hole 112 may be respectively disposed on both lateral sides of the rear fan assembly 100. And the first discharge hole 114 is disposed between a pair of first suction holes 112 spaced apart from each other by a predetermined interval laterally, and may be disposed on an upper surface of the rear fan assembly 100.

Assuming that any one disposed on a side closer to the corner space 10*g*, 10*h* among the pair of first suction holes 112 is a left first suction hole 112, the first flow path plate 31 is provided to form a wall blocking between the first discharge hole 114 and a right first suction hole 112. Such a first flow path plate 31 may be disposed at a position biased toward the right first suction hole 112 from a lateral center of the rear fan assembly 100, that is, a position adjacent to the right first suction hole 112.

Hereinafter, a direction toward the electronic/electrical component chamber 10*b*, 10*c*, 10*d* along a lateral direction from a lateral center of the cooking appliance will be referred to as a left side, and a direction toward the side space 10*e* located on an opposite side thereof will be referred to as a right side.

The first flow path plate 31 may form a longitudinal wall extending upwardly toward the upper space 10*i* from an upper surface of the rear fan assembly 100 in which the first discharge hole 114 is formed. Such a first flow path plate 31 may define a right boundary surface of the exhaust flow path A.

Meanwhile, the cooking appliance of the present embodiment may further include an extension plate 18. The extension plate 18 may be configured to partition the side space 10*e* such that a partial region of the side space 10*e* is separated into an extended upper space. The extension plate 18 may be disposed to block between the upper space 10*i* and the rear space 10*f*.

At least a portion of the extension plate 18 may be disposed in the rear space 10*f*. At least a portion 18*b* (hereinafter referred to as a "rear partition portion") of the extension plate 18 disposed at a corresponding position may be disposed between the rear fan assembly 100 and the upper space 10*i* with respect to a vertical direction. Also, the rear partition portion 18*b* of the extension plate 18 may be disposed between a rear surface of the cavity 11 and the rear plate 15 with respect to a front-rear direction.

The rear partition portion 18*b* of the extension plate 18 disposed in this way covers a partial area of the rear space 10*f* at a position higher than the rear fan assembly 100, and blocks between a partial area of the rear space 10*f* and the upper space 10*i*.

In the present embodiment, it is exemplified that between a right area of the rear space 10*f* and the upper space 10*i* is blocked by the extension plate 18.

In this case, a lateral passage formed in this case may connect between a right area covered by the extension plate 18 of the rear space 10*f* and an upper area of the rear fan assembly 100 where the exhaust flow path A is formed.

The first flow path plate 31 may form a longitudinal wall extending upwardly from the rear fan assembly 100 toward the extension plate 18. As an example, the first flow path plate 31 may form a longitudinal wall connecting between an upper surface of the rear fan assembly 100 and a lateral end of the extension plate 18. At least a portion of such a first flow path plate 31 may protrude above the extension plate 18.

The first flow path plate 31 connected to the extension plate 18 as described above may form a longitudinal wall blocking a lateral passage formed between the rear fan assembly 100 and the extension plate 18. That is, the first flow path plate 31 may form a wall in the rear space 10*f* blocking an air flow between a right area of the rear space 10*f* and the exhaust flow path A.

Also, the flow path defining member 30 may further include a second flow path plate 32. The second flow path plate 32 may form a wall blocking between the first suction hole 112 and the first discharge hole 114 of the rear fan assembly 100.

The second flow path plate 32 may be disposed on a left side of the rear fan assembly 100. According to this, with respect to a lateral direction, the rear fan assembly 100 may be disposed between the first flow path plate 31 and the second flow path plate 32.

With respect to a lateral direction, the second flow path plate 32 may be disposed between the rear fan assembly 100 and the corner fan assembly 200. Such a second flow path plate 32 forms a wall blocking between the first suction hole 112 and the first discharge hole 114, and at a same time, may form a wall blocking between the second discharge hole 214 of the corner fan assembly 200 and the first suction hole 112 of the rear fan assembly 100.

In the corner fan assembly 200, the second suction hole 212 is disposed toward the air intake hole 1, that is, downward. And the second discharge hole 214 is disposed toward a direction toward the rear fan assembly 100, that is, laterally, more specifically toward a right side, and may be connected to the exhaust flow path A.

In this case, a lower boundary surface of the exhaust flow path A defined by the second flow path plate 32 may form an inclined surface whose height changes along a lateral direction.

According to the present embodiment, the second discharge hole 214 may be disposed facing the first suction hole 112 disposed to face the corner fan assembly 200. And the first discharge hole 114 may be disposed above the first suction hole 112, and may be disposed above the second discharge hole 214.

As an example, the second flow path plate 32 may form an inclined surface extending laterally from below the second discharge hole 214 toward above the first suction hole 112. For example, the second flow path plate 32 may extend inclinedly upwardly in a lateral direction toward the rear fan assembly 100 from one lateral end adjacent to the corner fan assembly 200.

One lateral end of such a second flow path plate 32 may be disposed below the second discharge hole 214. For example, a left end of the second flow path plate 32 may be disposed at a lower position than the second discharge hole 214.

Also, the other lateral end of the second flow path plate 32 may be disposed above the first suction hole 112. For example, a right end of the second flow path plate 32 may be disposed at a higher position than the first suction hole 112.

The second flow path plate 32 may form an inclined wall blocking between the first suction hole 112 and the first discharge hole 114, and between the first suction hole 112 and the second discharge hole 214. That is, the second flow path plate 32 may form an inclined wall between the rear fan assembly 100 and the corner fan assembly 200, and this wall not only blocks between the first suction hole 112 and the first discharge hole 114, but also blocks between the first suction hole 112 and the second discharge hole 214.

Accordingly, between the rear fan assembly 100 and the corner fan assembly 200, air discharged from the first discharge hole 114 does not flow into the first suction hole 112, and air discharged through the second discharge hole 214 does not flow into the first suction hole 112.

That is, the second flow path plate 32 may form a wall blocking an air flow from the first discharge hole 114 and the second discharge hole 214 to the first suction hole 112 between the rear fan assembly 100 and the corner fan assembly 200.

According to the present embodiment, an exhaust flow path A may be formed on a left side of the first flow path plate 31 and above the second flow path plate 32. The air intake hole 1 may be disposed below this exhaust flow path A. Also, with respect to a vertical direction, the first suction hole 112 and the second suction hole 212 are disposed between the air intake hole 1 and the exhaust flow path A, and the first discharge hole 114 and the second discharge hole 214 may be disposed between the air intake hole 1 and the upper space 10*i*.

The first discharge hole 114 and the second discharge hole 214 may be connected to the exhaust flow path A. The first discharge hole 114 is disposed facing upwardly, and may be connected to the exhaust flow path A. And the second discharge hole 214 is disposed facing laterally, and may be connected to the exhaust flow path A.

In addition, the second flow path plate 32 may form a flow path guiding air inflow into the first suction hole 112.

As an example, the second flow path plate 32 is disposed above the air intake hole 1, and may be disposed on a left side and above the first suction hole 112. Such a second flow path plate 32 may form a left boundary surface and an upper boundary surface of a flow path connecting between the air intake hole 1 and the first suction hole 112. By the second flow path plate 32 provided in this way, air inflow into the first suction hole 112 from a left side of the rear fan assembly 100 can be effectively guided.

Meanwhile, the flow path defining member 30 may further include a fastening plate 33. The fastening plate 33 may be installed on the rear fan assembly 100.

As an example, the fastening plate 33 opens the first discharge hole 114 upwardly, and may be coupled to an upper surface of the rear fan assembly 100. Such a fastening plate 33 is disposed above the first suction hole 112, and may also be disposed above the second suction hole 212 and the second discharge hole 214.

According to the present embodiment, the first flow path plate 31 may be provided in a shape extending upwardly from the fastening plate 33. Also, the second flow path plate 32 may be provided in a shape extending downwardly from the fastening plate 33. That is, an upper end of the second flow path plate 32 may be connected to the fastening plate 33.

The first flow path plate 31 and the second flow path plate 32 connected to the fastening plate 33 in this way may be coupled to the rear fan assembly 100 via the fastening plate 33.

Also, the fastening plate 33 is disposed between the first flow path plate 31 and the second flow path plate 32, and may connect the first flow path plate 31 and the second flow path plate 32. As an example, the flow path defining member 30 may be provided in a shape in which the first flow path plate 31, the second flow path plate 32, and the fastening plate 33 are formed integrally.

In the flow path defining member 30 provided in this shape, the first flow path plate 31 and the second flow path plate 32 do not need to be separately coupled to the rear fan assembly 100 respectively, and installation of the first flow path plate 31 and the second flow path plate 32 can be performed easily and quickly by the fastening plate 33 coupled to the rear fan assembly 100.

A discharge hole (reference numeral omitted) may be formed in the fastening plate 33. The first discharge hole 114 may be exposed above the fastening plate 33 through this discharge hole, that is, to an inside of the exhaust flow path A.

Also, the cooking appliance of the present embodiment may further include a support member 40. The support member 40 is provided to support the corner fan assembly 200. At least a portion of such a support member 40 may be disposed in the corner space 10*g*, 10*h*.

As an example, the support member 40 may include a lateral support portion 41. The lateral support portion 41 may be disposed at a lateral side of the corner fan assembly 200. The lateral support portion 41 may form a side surface of the support member 40, more specifically, a right side surface of the support member 40.

The lateral support portion 41 may form a longitudinal wall covering the corner fan assembly 200 laterally. For example, the lateral support portion 41 may form a longitudinal plane orthogonal to a lateral axis. Such a lateral support portion 41 may form a wall blocking between the corner fan assembly 200 and the rear fan assembly 100 in the rear space 10*f*.

The lateral support portion 41 may be disposed between the corner fan assembly 200 and the second flow path plate 32. Such a lateral support portion 41 may define a left boundary surface of the exhaust flow path A.

A discharge hole (reference numeral omitted) may be formed in the lateral support portion 41. The second discharge hole 214 may be exposed to a right side of the lateral support portion 41 through this discharge hole, that is, to an inside of the exhaust flow path A.

In addition, the cooking appliance of the present embodiment may further include a connection flow path defining member 37, 38. The connection flow path defining member 37, 38 may be disposed above the corner fan assembly 200. Such a connection flow path defining member 37, 38 may partition the rear space 10*f* such that a partial area around the support member 40 of the rear space 10*f* is separated into a connection flow path portion 39.

As an example, the connection flow path defining member 37, 38 may include a first partition portion 37 and a second partition portion 38.

The first partition portion 37 may form a longitudinal wall disposed to be spaced apart by a predetermined interval laterally of the support member 40. As an example, the first partition portion 37 may form a longitudinal wall disposed to be spaced apart by a predetermined interval laterally of the lateral support portion 41. With respect to a lateral direction, the first partition portion 37 may be disposed between the corner fan assembly 200 and the rear fan assembly 100.

The second partition portion 38 may form a wall connecting the lateral support portion 41 and the first partition portion 37. As an example, the first partition portion 37 may be disposed at a position spaced apart to a right side by a predetermined interval from the lateral support portion 41. The second partition portion 38 may form a wall connecting between a lower end of such a first partition portion 37 and the lateral support portion 41.

As an example, the second partition portion 38 may be disposed above the second flow path plate 32. A left end of such a second partition portion 38 may be coupled to the lateral support portion 41. Also, a left end of the second partition portion 38 may be disposed to be spaced apart vertically from a left end of the second flow path plate 32 with the second discharge hole 214 interposed therebetween.

As an example, the second partition portion 38 may form an inclined surface parallel to the second flow path plate 32. Such a second partition portion 38 defines a left boundary surface of the exhaust flow path A together with the lateral support portion 41, and may guide a flow of air discharged into the exhaust flow path A from the second discharge hole 214 to a lateral center side of the exhaust flow path A.

The first partition portion 37 may extend upwardly from the second partition portion 38, and may define a left boundary surface of the exhaust flow path A together with the lateral support portion 41 and the second partition portion 38. Such a first partition portion 37 may guide a flow of air flowing through the exhaust flow path A toward the upper space 10*i*.

When an operation of the blower 100, 200 starts, as illustrated in FIGS. 8 to 10 and FIG. 11, a suction airflow for suctioning air outside the cooking appliance into an inside of the cooking appliance may be formed. The suction airflow formed in this way acts on external air that is an object to be suctioned through the air intake hole 1 disposed at a lower end of the cooking appliance. External air around the air intake hole 1, that is, a cooking gas, may pass through the air intake hole 1 and be suctioned into an inside of the main body 10 by a suction airflow acting in this way.

And the cooking gas suctioned into an inside of the main body 10 in this way may flow into an inside of the rear space 10*f* among space portions inside the main body 10. The cooking gas introduced into an inside of the rear space 10*f* in this way may be respectively suctioned into an inside of the rear fan assembly 100 and the corner fan assembly 200 through first suction holes 112 respectively disposed on both sides of the rear fan assembly 100 and a suction hole disposed below the corner fan assembly 200.

In this case, air suction into an inside of the rear fan assembly 100 may be guided by at least a portion of the flow path defining member 30. Specifically, air suction to the first suction hole 112 disposed on a left side of the rear fan assembly 100 may be guided by the second flow path plate 32.

Air suctioned into the rear fan assembly 100 and the corner fan assembly 200 may be respectively discharged through the first discharge hole 114 and the second discharge hole 214. A flow of air discharged in this way may be guided by the exhaust flow path A.

Air discharged from the second discharge hole 214 of the corner fan assembly 200 may pass through the rear space 10*f* through the exhaust flow path A and flow toward the upper space 10*i*. Around the second discharge hole 214, the exhaust flow path A may form an inclined passage facing upwardly to a right side from the second discharge hole 214.

A passage of an upwardly-right shape formed in this way lowers a resistance to air flow in the exhaust flow path A, and enables a flow loss inside the cooking appliance to be minimized. Such a passage of an upwardly-right shape may be formed by the second flow path plate 32 defining a lower boundary surface of the exhaust flow path A and the connection flow path defining member 37, 38 defining a left boundary surface of a flow path on a right side of the second discharge hole 214.

In this case, the exhaust flow path A may guide an air flow such that air discharged through the first discharge hole 114 does not spread to surroundings and can flow toward the upper space 10*i*.

[Air Suction and Discharge Structure of Cooking Appliance]

Figure 12:
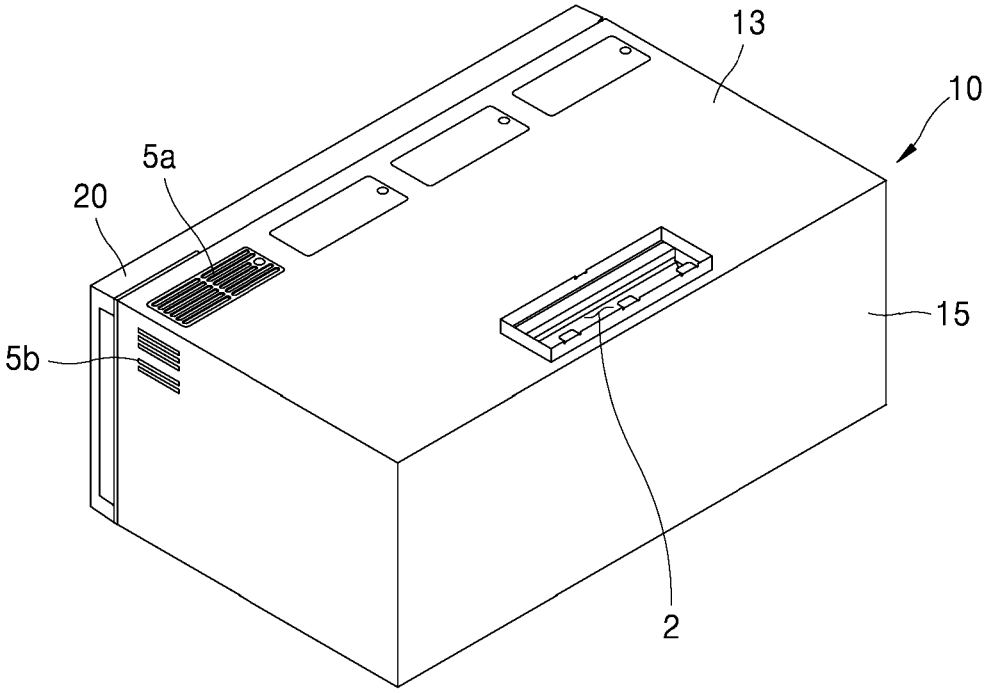
FIG. 12 is a rear perspective view illustrating a first state of the cooking appliance according to the first embodiment of the present disclosure.
Figure 13:
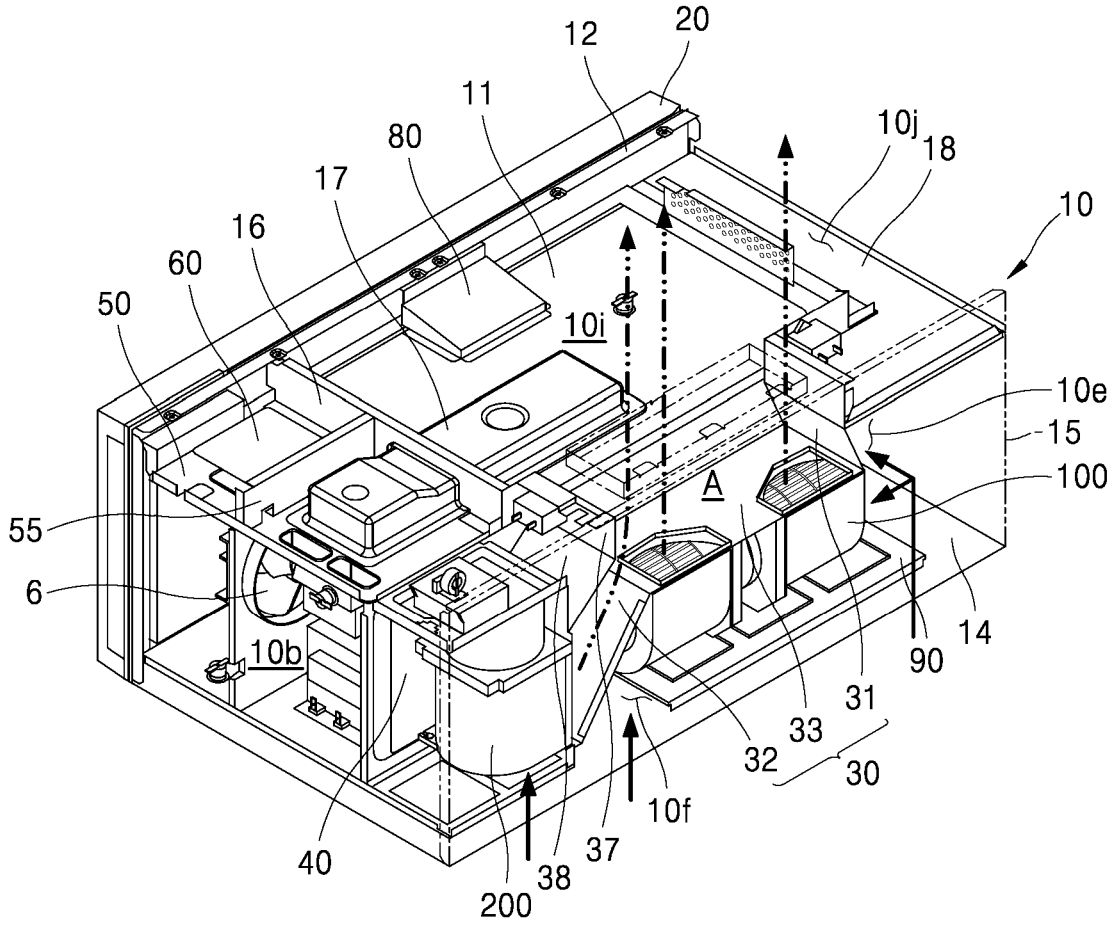
FIG. 13 is a view illustrating an air flow state in the cooking appliance illustrated in FIG. 12.
Figure 14:
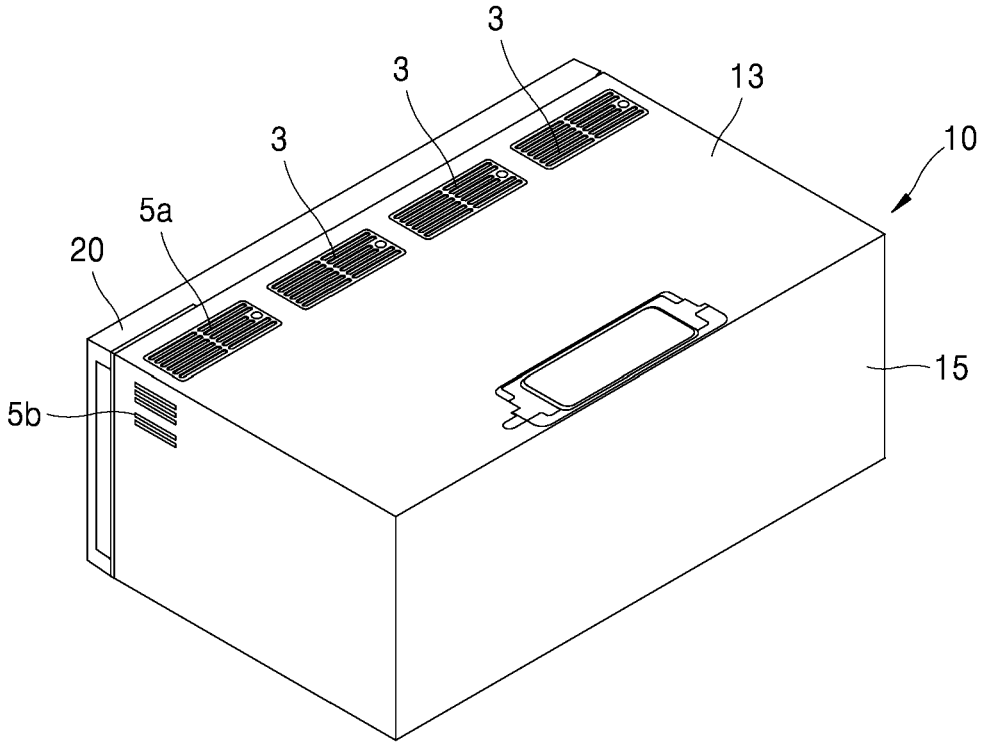
FIG. 14 is a rear perspective view illustrating a second state of the cooking appliance according to the first embodiment of the present disclosure.
Figure 15:
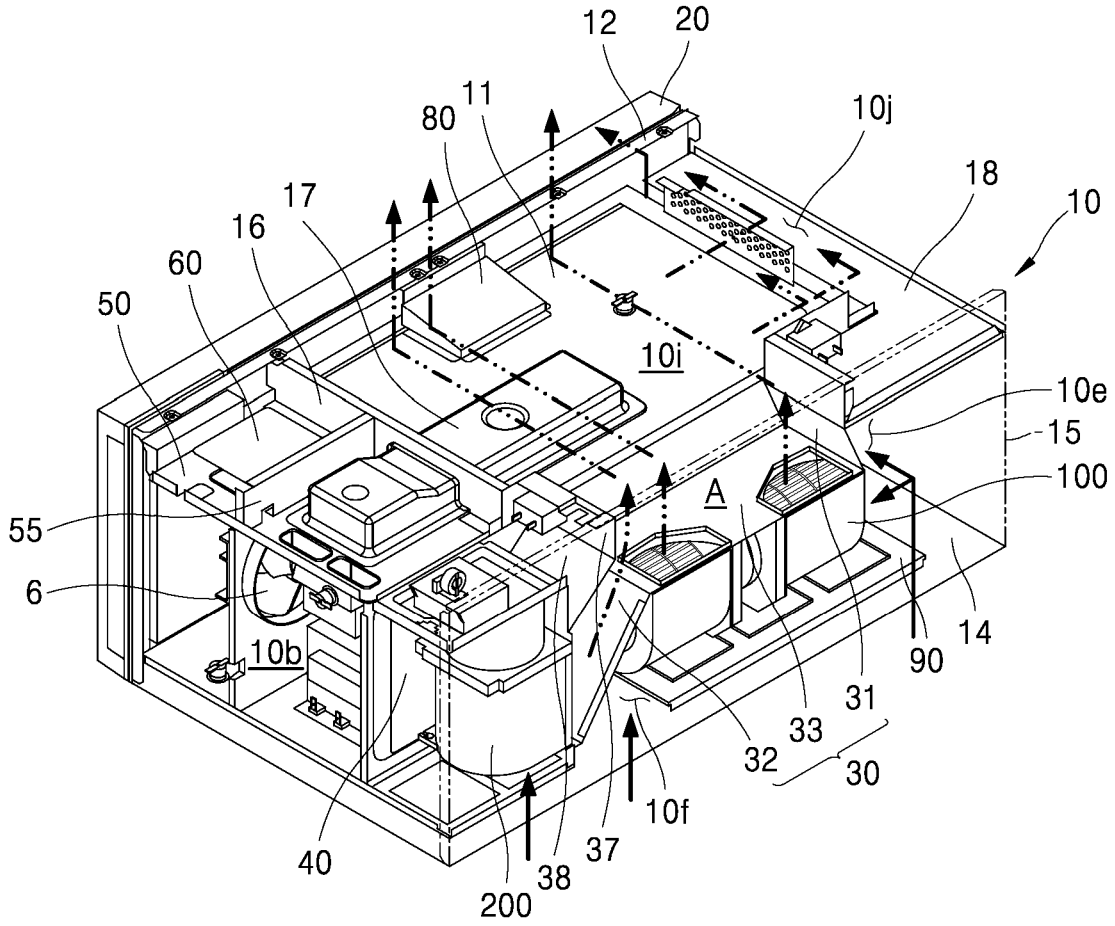
FIG. 15 is a view illustrating an air flow state in the cooking appliance illustrated in FIG. 14.
Figure 16:
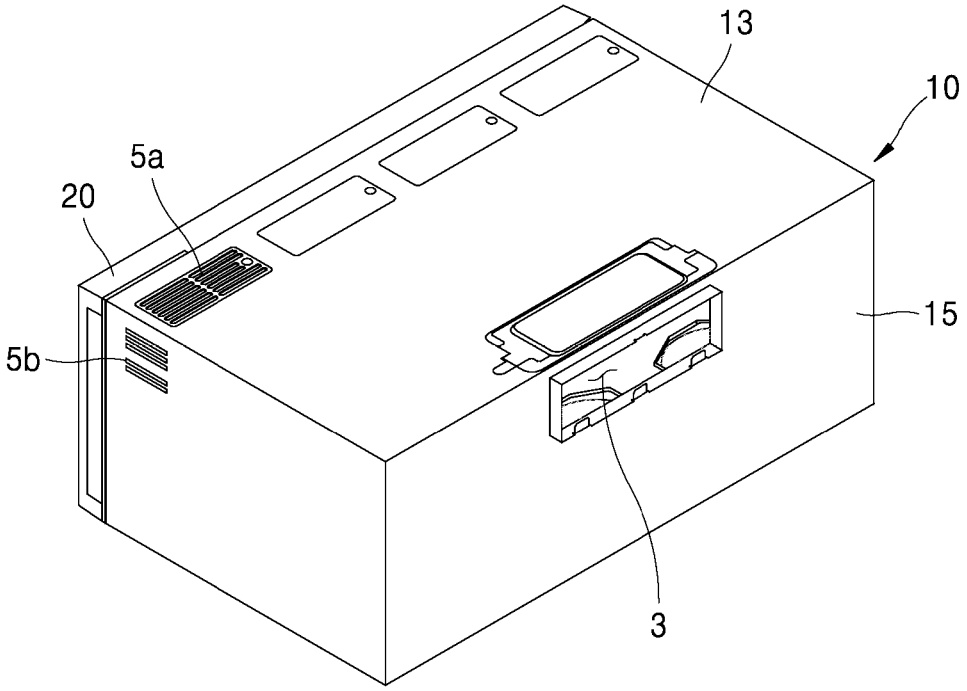
FIG. 16 is a rear perspective view illustrating a third state of the cooking appliance according to the first embodiment of the present disclosure.
Figure 17:
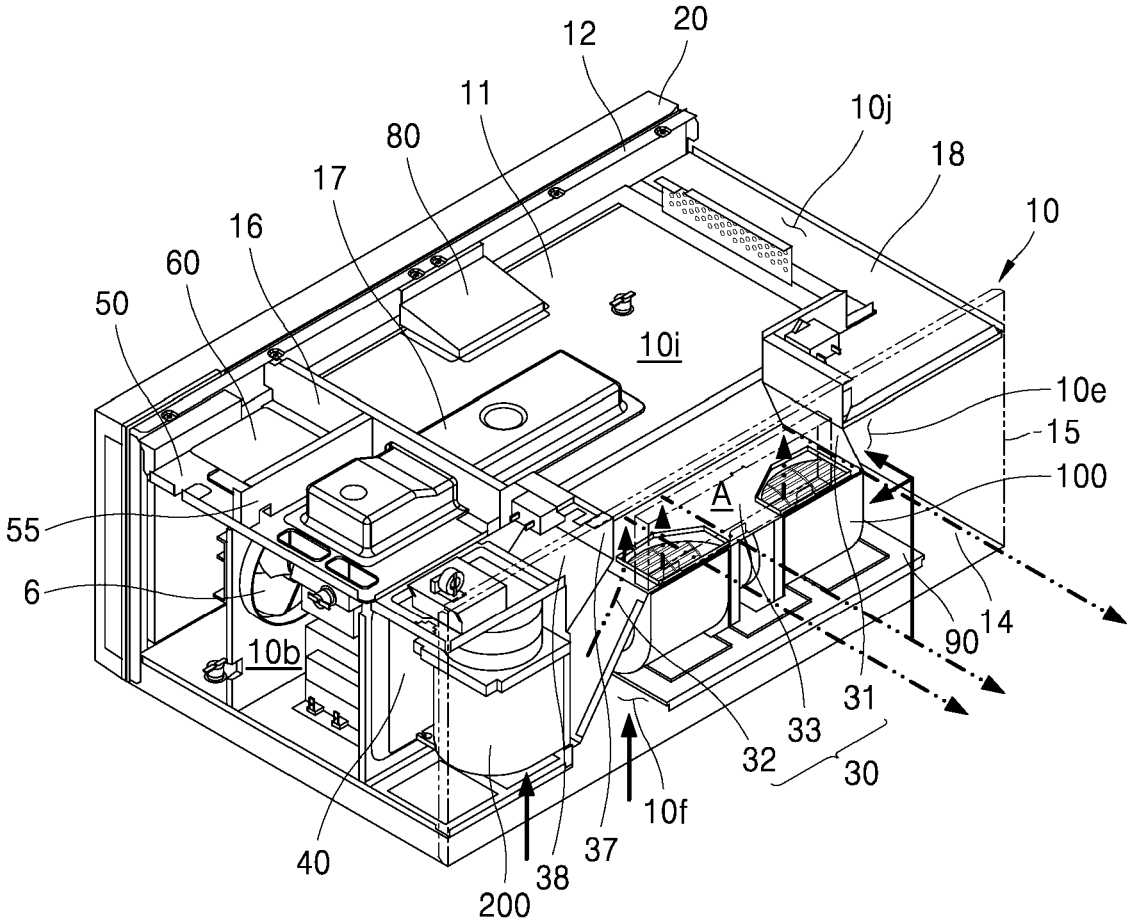
FIG. 17 is a view illustrating an air flow state in the cooking appliance illustrated in FIG. 16.

FIG. 12 is a rear perspective view illustrating a first state of the cooking appliance according to the first embodiment of the present disclosure, and FIG. 13 is a view illustrating an air flow state in the cooking appliance illustrated in FIG. 12. Also, FIG. 14 is a rear perspective view illustrating a second state of the cooking appliance according to the first embodiment of the present disclosure, and FIG. 15 is a view illustrating an air flow state in the cooking appliance illustrated in FIG. 14. Also, FIG. 16 is a rear perspective view illustrating a third state of the cooking appliance according to the first embodiment of the present disclosure, and FIG. 17 is a view illustrating an air flow state in the cooking appliance illustrated in FIG. 16.

Hereinafter, an air suction and discharge structure in the cooking appliance according to the present embodiment will be described with reference to FIGS. 11 to 17.

Referring to FIGS. 11 to 13, an air intake hole 1 may be provided at a lower end of the cooking appliance, and an exhaust hole may be provided at an upper end of the cooking appliance. A first exhaust hole 2 is disposed on an upper surface of the cabinet 13, and is disposed biased toward a rear side of the cooking appliance, and a second exhaust hole 3 may be disposed biased toward a front side of the cooking appliance. And a third exhaust hole 4 is disposed at a rear side of the cooking appliance, and may be disposed on the rear plate 15.

The blower 100, 200 includes a rear fan assembly 100 and a corner fan assembly 200, and the rear fan assembly 100 may be disposed in the rear space 10*f*. And the corner fan assembly 200 may be disposed in the rear space 10*f* or the corner space 10*g*, 10*h*.

When an operation of the rear fan assembly 100 and the corner fan assembly 200 starts, a suction airflow for suctioning air outside the cooking appliance into an inside of the cooking appliance may be formed. The suction airflow formed in this way acts on external air through the air intake hole 1 disposed at a lower end of the cooking appliance. External air around the air intake hole 1, that is, a cooking gas, may pass through the air intake hole 1 and be suctioned into an inside of the main body 10 by a suction airflow acting in this way.

And the cooking gas suctioned into an inside of the main body 10 in this way may flow into an inside of the rear space 10*f* through a lower space. For example, a cooking gas flowing into the lower space may flow into the rear space 10*f* and the corner space 10*g*, 10*h*.

A cooking gas flowing into the rear space 10*f* may be suctioned into an inside of the rear fan assembly 100 through first suction holes 112 respectively disposed on both sides of the rear fan assembly 100. A cooking gas suctioned into the rear fan assembly 100 in this way may be discharged upwardly through a first discharge hole 114 disposed above the rear fan assembly 100.

A cooking gas flowing into the corner space 10*g*, 10*h* may be suctioned into an inside of the corner fan assembly 200 through a second suction hole 212 disposed below the corner fan assembly 200. A cooking gas suctioned into the corner fan assembly 200 in this way may be discharged laterally of the corner fan assembly 200 through a second discharge hole 214 disposed at a side portion of the corner fan assembly 200.

The rear space 10*f* may connect between an air intake hole 1 disposed below the lower space and the upper space 10*i*. And an exhaust flow path A may be formed in such a rear space 10*f*. A flow of cooking gas discharged from the rear fan assembly 100 and the corner fan assembly 200 may be guided toward the upper space 10*i* by the exhaust flow path A.

When only the first exhaust hole 2 among exhaust holes 2, 3, 4 is opened and the second exhaust hole 3 and the third exhaust hole 4 are closed (hereinafter referred to as a "first state of a cooking appliance"), a cooking gas flowing upwardly through the exhaust flow path A may be discharged to outdoor through the first exhaust hole 2.

As an example, the first exhaust hole 2 may be connected to a duct (not shown) connected to outdoor. For example, a duct may be installed on an upper surface of the main body 10, and an inner space of this duct may be connected to the first exhaust hole 2.

The first exhaust hole 2 connected to a duct like this may form a passage connecting the upper space 10*i* to an exterior of the cooking appliance. Such a first exhaust hole 2 is disposed above the upper space 10*i*, and may be disposed at a position overlapping with the rear space 10*f* in a vertical direction.

That is, the rear fan assembly 100, the rear space 10*f*, and the first exhaust hole 2 may be disposed at a position overlapping in a vertical direction. Preferably, the rear fan assembly 100, the rear space 10*f*, and the first exhaust hole 2 may be arranged in a line along a vertical direction.

Also, the exhaust flow path A may be disposed between the blower 100, 200 and the first exhaust hole 2 in the rear space 10*f*. An inlet of such an exhaust flow path A is opened toward the blower 100, 200, and an outlet of the exhaust flow path A may be opened toward the upper space 10*i*. And the first exhaust hole 2 may be disposed in a region overlapping with an outlet of the exhaust flow path A in a vertical direction.

Accordingly, a flow of air generated by an operation of the rear fan assembly 100 may be made in a straight direction identical to an arrangement direction of the rear fan assembly 100, the rear space 10*f*, and the first exhaust hole 2.

When a flow of air is made in a straight direction like this, a resistance to air flow is lowered proportionally, enabling the flow of air to be made more smoothly. Accordingly, air suction and discharge performance by the rear fan assembly 100 can be improved, so cooking gas removal performance of the cooking appliance can be improved proportionally.

In this state, the cooking appliance of the present embodiment, as illustrated in FIGS. 14 and 15, may discharge a cooking gas suctioned into an inside of the cooking appliance to indoor. At this time, the cooking appliance may be in a state where only a second exhaust hole 3 among exhaust holes 2, 3, 4 is opened and a first exhaust hole 2 and a third exhaust hole 4 are closed (hereinafter referred to as a "second state of a cooking appliance").

In the second state of the cooking appliance, a passage for discharging a cooking gas suctioned into an inside of the cooking appliance to indoor may be provided by the second exhaust hole 3. That is, a cooking gas flowing into the rear space 10*f* through the air intake hole 1 may be discharged to indoor through the second exhaust hole 3 after passing through the upper space 10*i*.

As an example, a filter (not shown) may be disposed on a bottom surface of the cooking appliance. A filter is disposed at the air intake hole 1, and a cooking gas may be filtered by a filter while passing through the air intake hole 1.

As another example, a filter may be disposed in the upper space 10*i*. For example, a filter may be disposed in an inside of the main body 10, and may be disposed at the second exhaust hole 3. In this case, a cooking gas flowing from the rear space 10*f* to the upper space 10*i* passes through a filter, and may be discharged to indoor through the second exhaust hole 3 in a state filtered by a filter.

Hereinafter, air discharged to indoor through the second exhaust hole 3 in the second state of the cooking appliance will be distinguished from air discharged through other exhaust holes of the cooking appliance and referred to as "hood discharge air (Ventilation Air)".

The cooking appliance of the present embodiment, as illustrated in FIGS. 16 and 17, may discharge a cooking gas suctioned into an inside of the cooking appliance to outdoor through the third exhaust hole 4.

In this state, the cooking appliance may be in a state where only the third exhaust hole 4 among the exhaust holes 2, 3, 4 is opened and the first exhaust hole 2 and the second exhaust hole 3 are closed (hereinafter, referred to as a "third state of the cooking appliance").

As an example, the third exhaust hole 4 may be connected to a pipe or a duct (not shown) embedded in a wall surface on which the cooking appliance is installed. For example, a pipe or a duct may be coupled to the rear plate 15, and an inner space of this pipe or duct may be connected to the third exhaust hole 4.

The third exhaust hole 4 connected to the pipe or the duct in this way is disposed at a position closest to the blower 100, 200. Accordingly, in the third state of the cooking appliance, a distance between the blower 100, 200 and the exhaust hole 2, 3, 4 can become shortest. Also, since the third exhaust hole 4 is disposed on a rear surface of the cooking appliance facing the wall surface, the third exhaust hole 4 and the pipe or duct are not exposed to an exterior.

That is, in the cooking appliance in the third state, the cooking appliance can reduce an air flow distance inside the cooking appliance to reduce a flow resistance inside the cooking appliance, and can make an exterior of the cooking appliance be maintained simple and neat.

As described above, the cooking appliance of the present embodiment adopting a structure in which the blower 100, 200 is disposed in the rear space 10*f* allows a flow of air involved in suctioning the cooking gas and discharging it through the first exhaust hole 2 to be made in a straight direction, so that a flow loss inside the cooking appliance is minimized, and through this, a more improved cooking gas removal performance can be provided.

Also, the cooking appliance of the present embodiment can provide an effect of maintaining a compact size and making filtration and indoor discharge of the cooking gas be smoothly made by allowing an installation space of a filter to be effectively secured in the upper space 10*i*.

Meanwhile, a space portion inside the main body 10 may be divided into the side space 10*e*, the rear space 10*f*, and the upper space 10*i* as described above, and the blower 100, 200 of the present embodiment is disposed in the rear space 10*f* rather than the side space 10*e* or the upper space 10*i*.

Typically, a lateral length of the side space 10*e* where an electronic/electrical component chamber is not disposed is set shorter compared to a front-rear length of the rear space 10*f*. That is, the side space 10*e* can provide only a narrower space compared to the rear space 10*f*.

In the rear space 10*f*, various devices may be disposed according to a type of the cooking appliance. For example, in a case of a cooking appliance providing a convection function, a convection module may be disposed in the rear space 10*f*.

On the other hand, in the side space 10*e* that does not form an electronic/electrical component chamber 10*b*, 10*c*, 10*d*, it is very rare for any particular device to be disposed. Therefore, a lateral width of the side space 10*e* does not need to be unnecessarily increased. If a lateral length of the side space 10*e* is unnecessarily increased, only an overall size of the cooking appliance increases regardless of whether performance of the cooking appliance is improved.

Considering this point, it is preferable that the side space 10*e* is formed to be able to provide a narrower space compared to the rear space 10*f*.

In order to reduce costs, it is common for cooking appliances having a same cooking chamber volume to share a main body 10 of a same standard. For example, a cooking appliance providing both a high frequency function and a convection function may be manufactured using a main body 10 of a same standard as a cooking appliance providing only a high frequency function.

Accordingly, the main body 10 of the present embodiment may include the rear space 10*f* providing a space suitable for a convection module to be disposed, and the side space 10*e* may be formed in a shape providing only a narrower space compared to the rear space 10*f*.

Considering this point, the blower 100, 200 of the present embodiment may be disposed in the rear space 10*f* providing a more sufficient space compared to the side space 10*e*. By the blower 100, 200 being disposed in the rear space 10*f* in this way, a flow loss inside the cooking appliance can be reduced as described above, as well as a larger and higher-performance fan assembly can be applied to the blower 100, 200.

That is, the cooking appliance of the present embodiment including the blower 100, 200 disposed in the rear space 10*f* can provide a more improved cooking gas removal performance while suppressing an increase in a size of the cooking appliance by using a main body 10 of a commonly used standard.

[Support Member]

Figure 18:
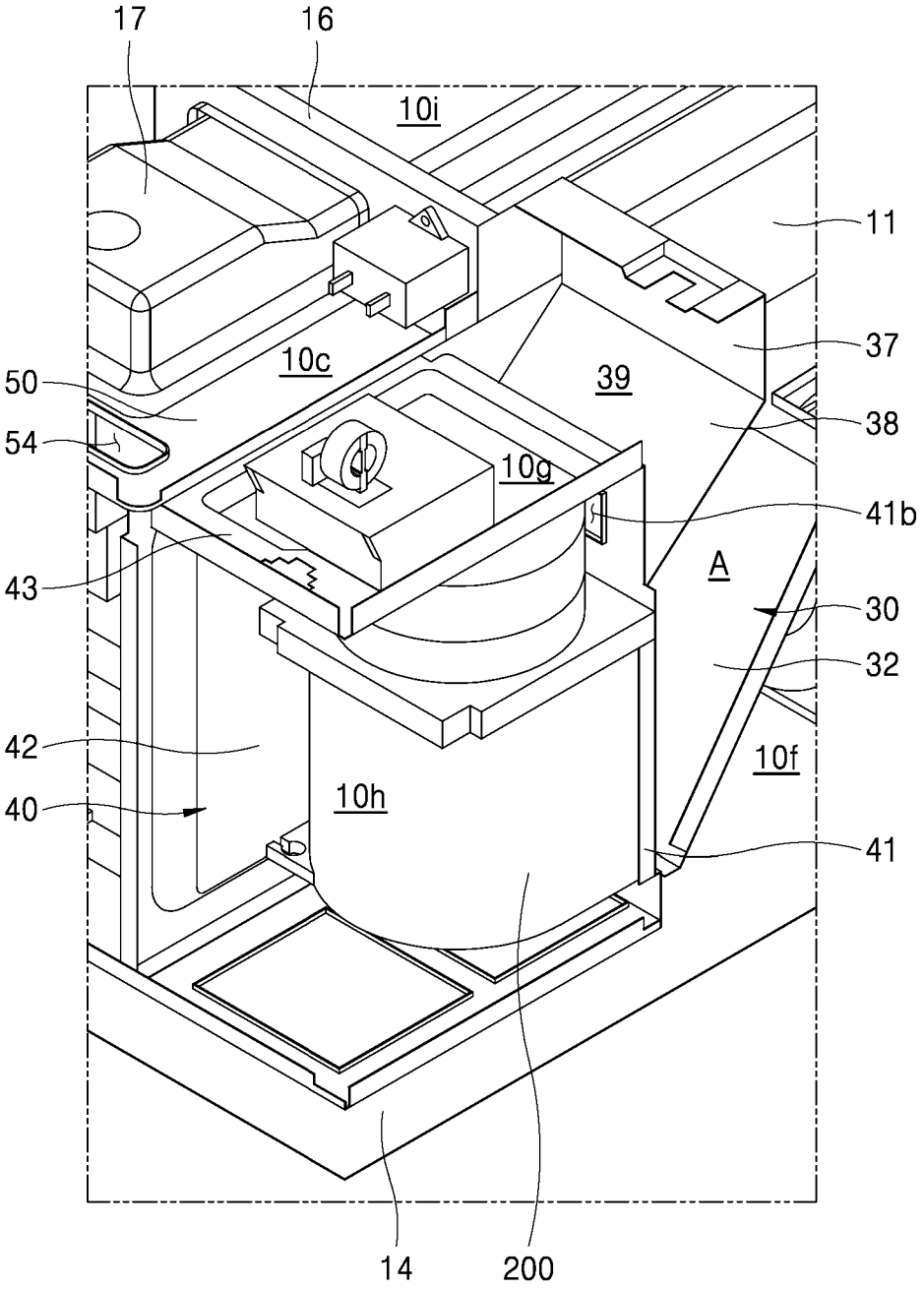
FIG. 18 is an enlarged view enlarging and illustrating the corner fan assembly and a surrounding thereof.
Figure 19:
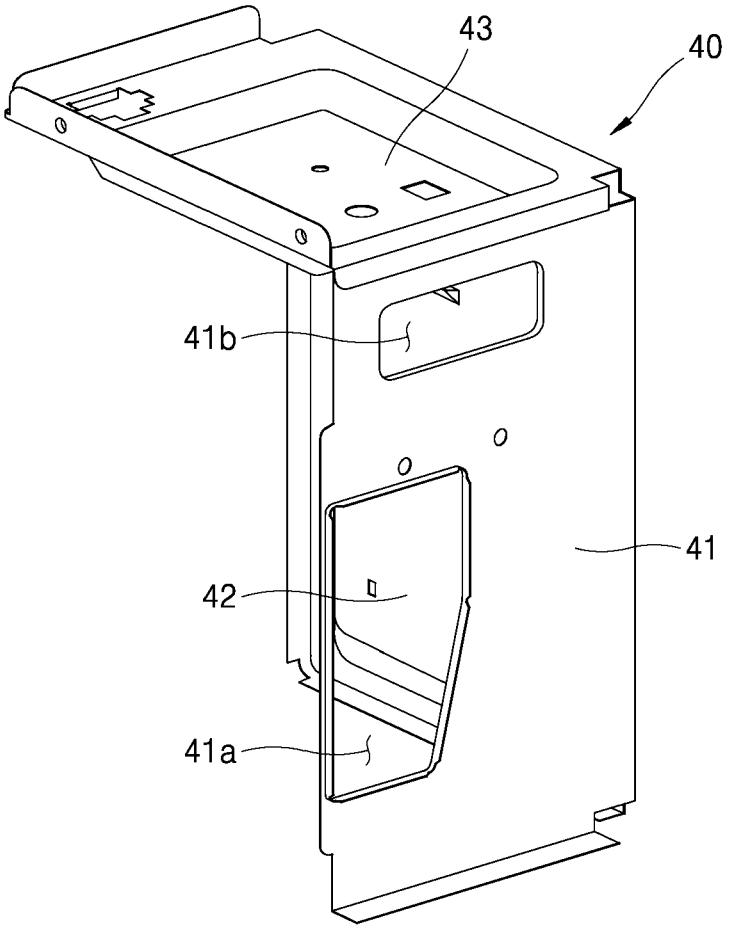
FIG. 19 is a rear perspective view illustrating a support member illustrated in FIG. 18 in an exploded state.

FIG. 18 is an enlarged view enlarging and illustrating a corner fan assembly and a surrounding thereof, and FIG. 19 is a rear perspective view illustrating a support member illustrated in FIG. 18 in an exploded state.

Referring to FIGS. 6, 18, and 19, the cooking appliance of the present embodiment may include a support member 40. The support member 40 may support the corner fan assembly 200 such that a flow of air discharged from the second discharge hole 214 may be guided toward the rear space 10*f*.

At least a portion of such a support member 40 may form a wall blocking between the side space 10*e* and the rear space 10*f*. That is, at least a portion of the support member 40 may form a wall blocking between the corner fan assembly 200 and the rear fan assembly 100 in the rear space 10*f*.

The support member 40 may form a wall partitioning the rear space 10*f* into two regions along a lateral direction. As an example, the support member 40 may partition a partial region of the rear space 10*f* adjacent to the side space 10*e* into a corner space 10*g*, 10*h*. Also, at least a portion of the support member 40 may form a wall covering the corner fan assembly 200 from a lateral side. Such a wall may be formed by a lateral support portion 41.

The second discharge hole 214 may be disposed on a side portion of the corner fan assembly 200 toward the support member 40, more specifically, the lateral support portion 41. And a discharge hole 41*a* may be formed in the lateral support portion 41. The discharge hole 41*a* is provided to be able to expose the second discharge hole 214 laterally, and may be formed to pass through the lateral support portion 41 in a lateral direction.

The lateral support portion 41 may be coupled to the corner fan assembly 200. That is, the corner fan assembly 200 is laterally coupled with the lateral support portion 41, and may be supported by the support member 40.

The support member 40 may include a front support portion 42. The front support portion 42 forms a front surface of the support member 40, and may be disposed on a front side of the corner fan assembly 200.

The front support portion 42 may form a longitudinal wall covering the corner fan assembly 200 from a front. For example, the front support portion 42 may form a longitudinal plane orthogonal to a front-rear axis. Such a front support portion 42 may be disposed between a cooling fan 6 (refer to FIG. 21) to be described later and the corner fan assembly 200, and may form a wall blocking between the cooling fan 6 and the corner fan assembly 200 in an electronic/electrical component chamber 10*b*, 10*c*, 10*d*.

The front support portion 42 may be connected to the lateral support portion 41 at a lateral side of the lateral support portion 41. As an example, a right end of the front support portion 42 may be connected to a front end of the lateral support portion 41. For example, the front support portion 42 and the lateral support portion 41 may be connected in an "L" shape.

The front support portion 42 connected to the lateral support portion 41 in this way may support the lateral support portion 41 from a front side. Such a front support portion 42 may perform roles of a screening wall blocking between the cooling fan 6 and the corner fan assembly 200, and a supporting wall supporting the lateral support portion 41 supporting the corner fan assembly 200 together.

Also, the front support portion 42 may include a support surface forming a longitudinal plane for coupling with an electronic/electrical component. For example, an electronic/electrical component such as a magnetron, a high-voltage transformer, a high-voltage condenser, a noise filter, etc. may be disposed in the electronic/electrical component chamber 10*b*, 10*c*, 10*d*, and at least any one of the electronic/electrical components may be installed on a support surface of the front support portion 42. In the present embodiment, it is exemplified that a high-voltage condenser is installed on a support surface of the front support portion 42.

In addition, the support member 40 may further include an upward support portion 43. The upward support portion 43 forms an upper surface of the support member 40, and may be disposed above the corner fan assembly 200. As an example, the upward support portion 43 may be disposed in the corner space 10*g*, 10*h*.

The upward support portion 43 is disposed above the lateral support portion 41 and the front support portion 42, and may be connected vertically to at least one of the lateral support portion 41 and the front support portion 42. In the present embodiment, it is exemplified that the upward support portion 43 is connected to both the lateral support portion 41 and the front support portion 42.

As an example, a front end of the upward support portion 43 may be connected to an upper end of the front support portion 42, and a right end of the upward support portion 43 may be connected to an upper end of the lateral support portion 41. By the upward support portion 43, three directional surfaces of the support member 40 are connected as one, and accordingly, structural stability of the support member 40 can be improved.

Also, the upward support portion 43 may include a support surface forming a horizontal plane for coupling with an electronic/electrical component. In the present embodiment, it is exemplified that a noise filter connected to a corner fan assembly is installed on a support surface of the upward support portion 43.

The support member 40 including the lateral support portion 41, the front support portion 42, and the upward support portion 43 as described above not only provides a screening wall blocking between the cooling fan 6 and the corner fan assembly 200, but can also provide a support wall for a stable installation of an electronic/electrical component and the corner fan assembly 200 together.

As an example, the support member 40 may be provided in a shape in which the lateral support portion 41, the front support portion 42, and the upward support portion 43 are integrally formed. Such a support member 40 can facilitate assembly and installation of the support member 40, and part management, and can have excellent structural stability.

[Structure of Electronic/Electrical Component Chamber]

Figure 20:
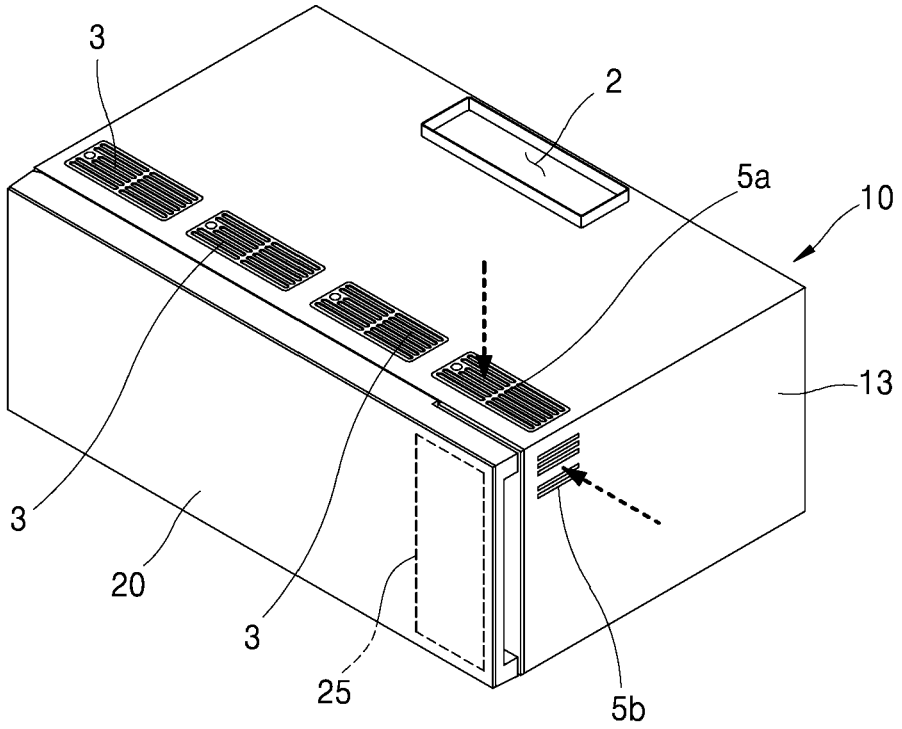
FIG. 20 is a view illustrating a state in which an external air flows into an electronic/electrical component chamber through a cold air inlet.
Figure 21:
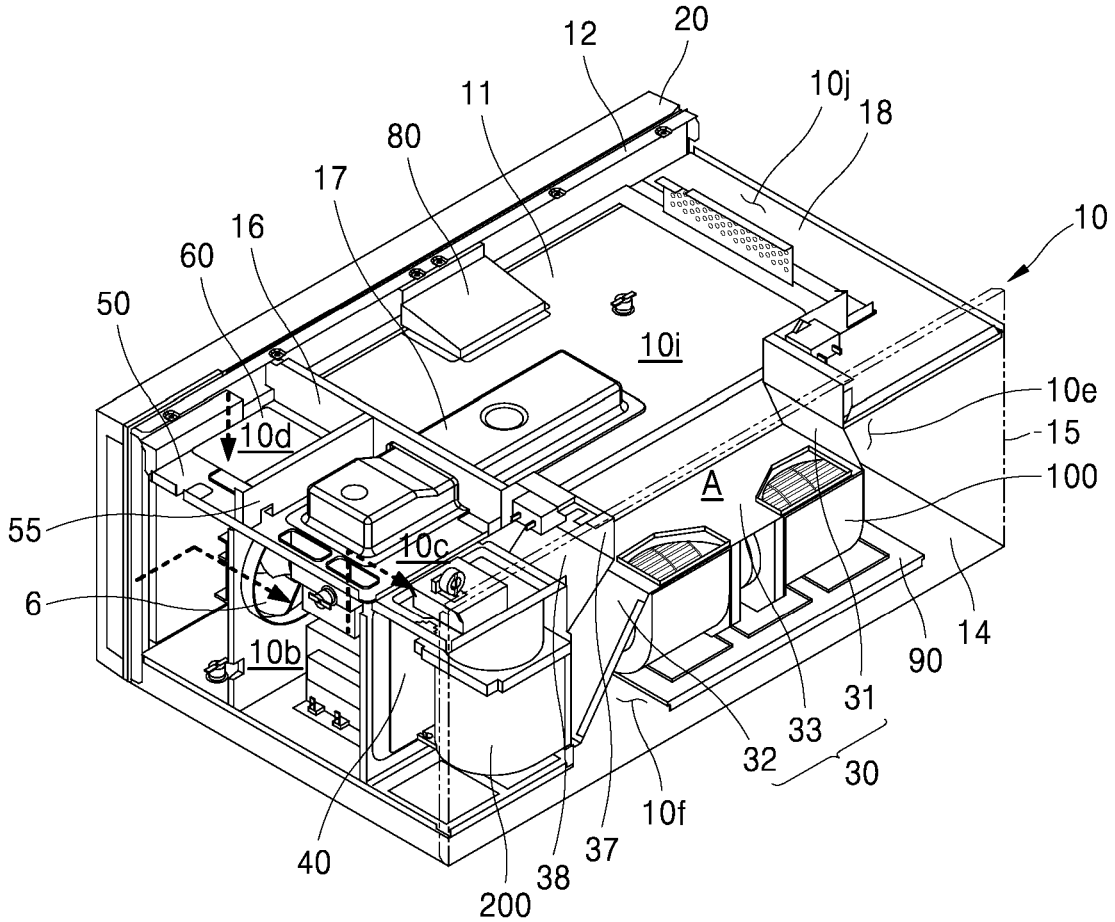
FIGS. 21 to 23 are views illustrating a flow state of air flowing into the electronic/electrical component chamber.
Figure 22:
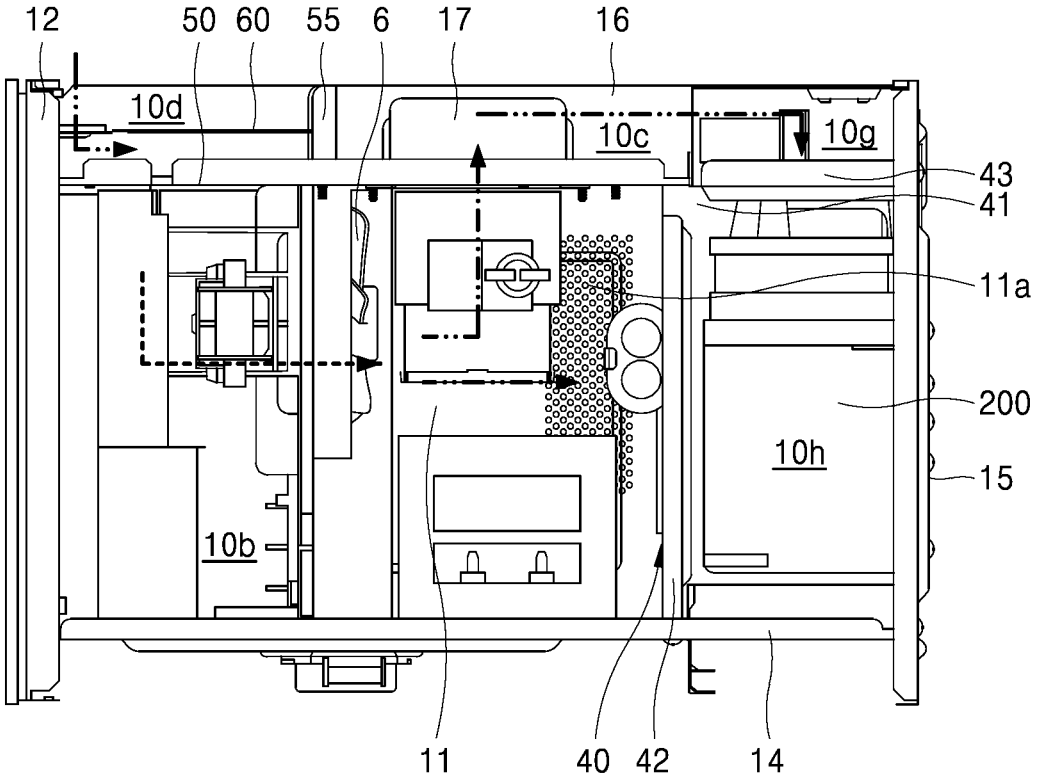
Figure 23:
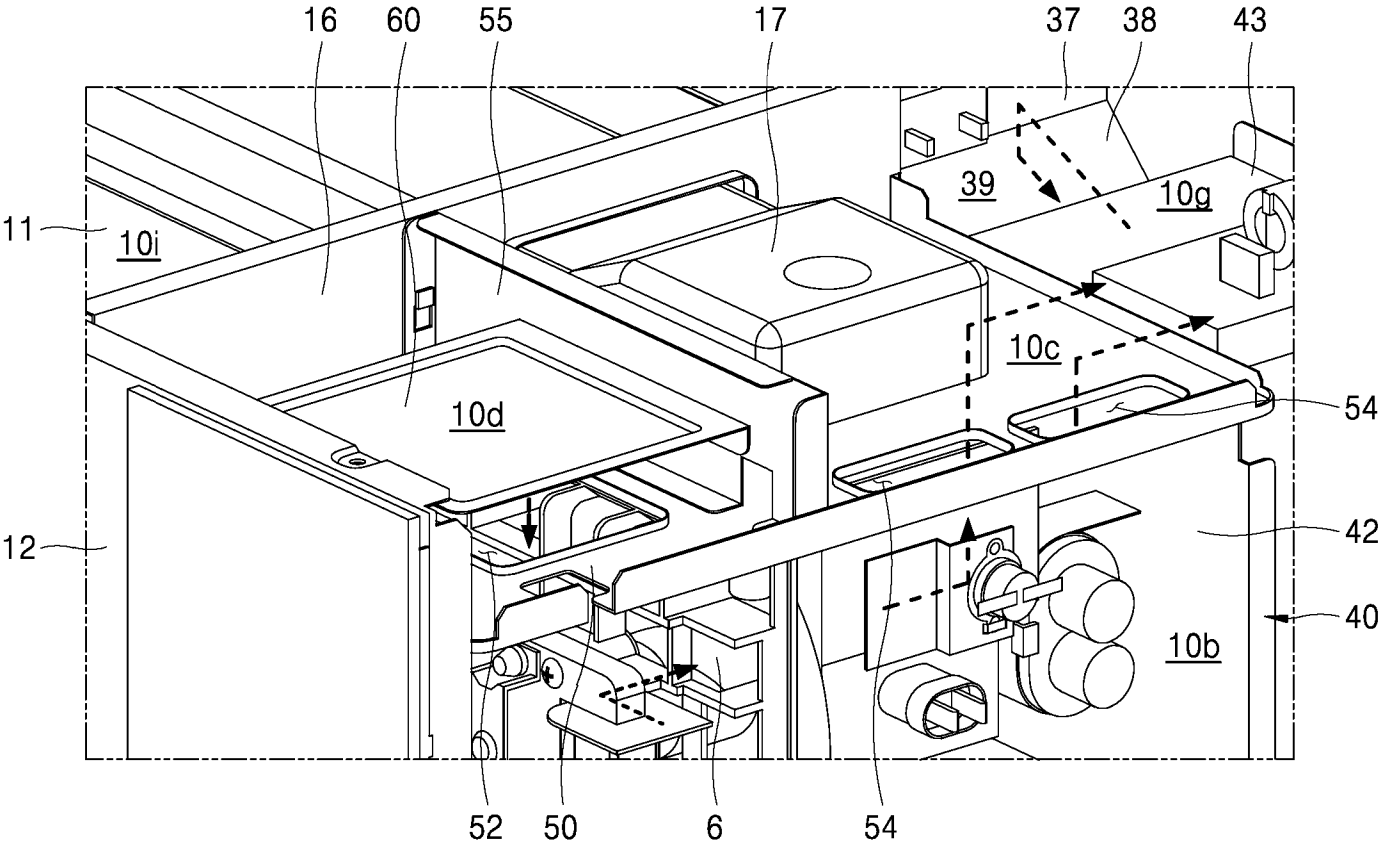
Figure 24:
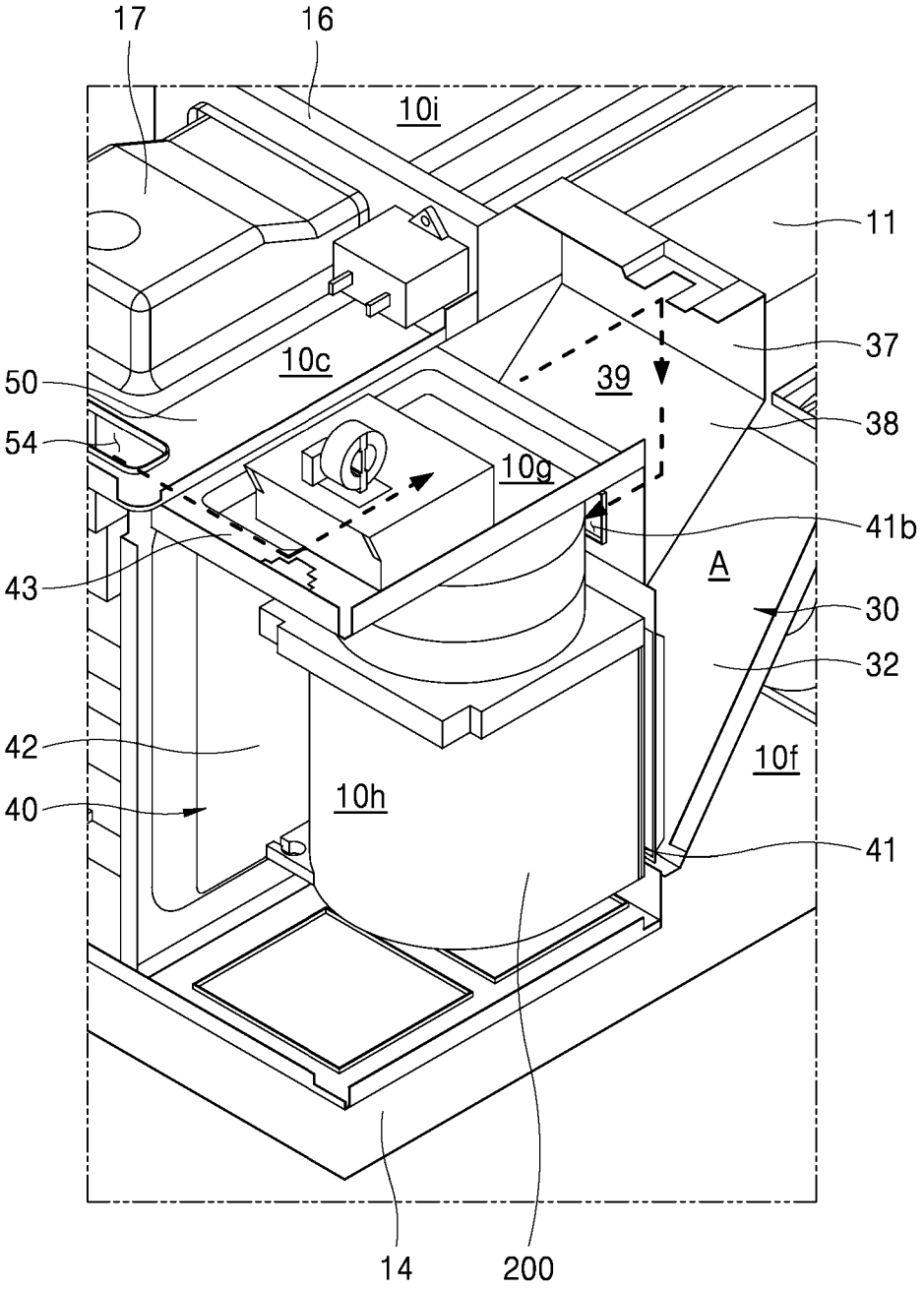
FIG. 24 is a view illustrating a flow state of air flowing into a lower corner space from an upper corner space through a connection flow path.

FIG. 20 is a view illustrating a state in which an external air flows into an electronic/electrical component chamber through a cold air inlet, FIGS. 21 to 23 are views illustrating a flow state of air flowing into the electronic/electrical component chamber, and FIG. 24 is a view illustrating a flow state of air flowing into a lower corner space from an upper corner space through a connection flow path portion.

Referring to FIGS. 20 and 21, a cold air inlet may be provided in the main body 10. The cold air inlet may be provided in a shape including at least one of an upper inlet 5*a* provided on an upper surface of the main body 10 and a side inlet 5*b* provided on a side surface of the main body 10.

The upper inlet 5*a* is formed to pass through an upper surface of the cabinet 13 in a vertical direction. Such an upper inlet 5*a* may form a lateral passage opening the electronic/electrical component chamber 10*b*, 10*c*, 10*d* to an exterior of the main body 10 on an upper surface of the cabinet 13.

The side inlet 5*b* is formed to pass through a side surface of the cabinet 13 in a lateral direction. Such a side inlet 5*b* may form a lateral passage opening the electronic/electrical component chamber 10*b*, 10*c*, 10*d* to an exterior of the main body 10 on an upper surface of the cabinet 13.

As an example, a cold air inlet may be provided in a shape including the upper inlet 5*a*. As another example, a cold air inlet may be provided in a shape including only the side inlet 5*b*. As yet another example, a cold air inlet may be provided in a shape including the upper inlet 5*a* and the side inlet 5*b* together.

In the present embodiment, a shape in which an upper inlet 5*a* and a side inlet 5*b* are provided together in a cooking appliance is exemplified. According to this, only any one of the upper inlet 5*a* and the side inlet 5*b* may be provided in an opened state, and the other may be provided in a closed state.

For example, an upper inlet 5*a* may be provided in an opened state and a side inlet 5*b* in a closed state, and in this case, external air may flow into an electronic/electrical component chamber 10*b*, 10*c*, 10*d* through the upper inlet 5*a*. In an opposite case, external air may flow into an electronic/electrical component chamber 10*b*, 10*c*, 10*d* through the side inlet 5*b*.

Referring to FIGS. 21 to 23, the cooking appliance of the present embodiment may include a partition plate 50. The partition plate 50 may be disposed in the side space 10*e*, more specifically, the electronic/electrical component chamber 10*b*, 10*c*, 10*d*.

As an example, the partition plate 50 may form a horizontal plane orthogonal to a vertical axis. Such a partition plate 50 partitions the side space 10*e* vertically, and may partition into a lower electronic/electrical component chamber 10*b* and an upper electronic/electrical component chamber 10*c*. For example, an electronic/electrical component chamber 10*b*, 10*c*, 10*d* may be partitioned into a lower electronic/electrical component chamber 10*b* below the partition plate 50 and an upper electronic/electrical component chamber 10*c* above the partition plate 50.

As an example, within an electronic/electrical component chamber 10*b*, 10*c*, 10*d*, a lower electronic/electrical component chamber 10*b* may occupy a much larger space compared to an upper electronic/electrical component chamber 10*c*. For example, a vertical length of a lower electronic/electrical component chamber 10*b* may be set to be much longer than a vertical length of an upper electronic/electrical component chamber 10*c*. Most electronic/electrical components including a magnetron, a high-voltage transformer, a high-voltage condenser, etc. may be mainly disposed in a lower electronic/electrical component chamber 10*b*.

The cooking appliance of the present embodiment may further include a cooling fan 6. The cooling fan 6 is provided so as to be able to introduce external air into an electronic/electrical component chamber 10*b*, 10*c*, 10*d* through a cold air inlet. As an example, the cooling fan 6 may be disposed in a lower electronic/electrical component chamber 10*b* together with most electronic/electrical components.

The blower 100, 200 is disposed on a rear side of the cooling fan 6, and a support member 40, more specifically, a front support portion 42 may be disposed between the cooling fan 6 and the corner fan assembly 200.

The cooling fan 6 may generate an airflow for introducing external air into an inside of the main body 10 through a cold air inlet.

During an operation of the cooling fan 6, external air may flow into an upper electronic/electrical component chamber 10*c* through a cold air inlet. Air having flowed into an upper electronic/electrical component chamber 10*c* may pass through the partition plate 50 and flow into a lower electronic/electrical component chamber 10*b*.

To this end, a passage hole 52, 54 may be provided in the partition plate 50. The passage hole 52, 54 may form a passage connecting between an upper electronic/electrical component chamber 10*c* and a lower electronic/electrical component chamber 10*b* in the partition plate 50. As an example, a passage hole 52, 54 may be formed to pass through the partition plate 50 in a vertical direction.

Air having flowed into an upper electronic/electrical component chamber 10*c* through a cold air inlet may flow into a lower electronic/electrical component chamber 10*b* through a passage hole 52, 54. Air introduced into an electronic/electrical component chamber 10*b*, 10*c*, 10*d* like this can cool electronic/electrical components disposed in a lower electronic/electrical component chamber 10*b*.

Also, some of air introduced into a lower electronic/electrical component chamber 10*b* may flow into the cooking chamber 10*a* (refer to FIG. 2). To this end, an internal inlet hole 11*a* may be provided in the cavity 11. An internal inlet hole 11*a* may form a passage connecting between at least any one of a lower electronic/electrical component chamber 10*b* and an upper electronic/electrical component chamber 10*c*, and the cooking chamber 10*a*.

In the present embodiment, an internal inlet hole 11*a* is exemplified as being disposed in a lower electronic/electrical component chamber 10*b*. As an example, an internal inlet hole 11*a* is formed to pass through the cavity 11 laterally, and may form a passage connecting between a lower electronic/electrical component chamber 10*b* and the cooking chamber 10*a* in the cavity 11. Such an internal inlet hole 11*a* may be disposed on a front side of the support member 40.

The cooking appliance of the present embodiment may further include a blocking plate 55. The blocking plate 55 may partition an upper electronic/electrical component chamber 10*c* front and rear such that a front region of an upper electronic/electrical component chamber 10*c* is separated into an intake chamber 10*d*.

As an example, the blocking plate 55 may form a longitudinal wall surface orthogonal to a front-rear axis. Such a blocking plate 55 is disposed above the partition plate 50, and may be coupled to an upper surface of the partition plate 50.

By the blocking plate 55 provided in this way, a region between the front plate 12 and the blocking plate 55 among an upper electronic/electrical component chamber 10*c* may be partitioned as an intake chamber 10*d*.

A plurality of passage holes 52, 54 may be provided in the partition plate 50. As an example, a first passage hole 52 and a second passage hole 54 may be provided in the partition plate 50. A first passage hole 52 and a second passage hole 54 may be disposed to be spaced apart in a front-rear direction with the blocking plate 55 interposed therebetween.

A first passage hole 52 may form a passage connecting between an intake chamber 10*d* and a lower electronic/electrical component chamber 10*b*. Such a first passage hole 52 may be disposed on a front side of the blocking plate 55 and the cooling fan 6, and may be formed to pass through the partition plate 50 in a vertical direction.

A second passage hole 54 may form a passage connecting between an upper electronic/electrical component chamber 10*c* and a lower electronic/electrical component chamber 10*b* at a rear side of an intake chamber 10*d*. Such a second passage hole 54 may be disposed on a rear side of the blocking plate 55 and the cooling fan 6, and may be formed to pass through the partition plate 50 in a vertical direction.

According to the present embodiment, an upward support portion 43 may be disposed on a rear side of the partition plate 50. The upward support portion 43 may be disposed in a corner space 10*g*, 10*h*, and may partition a corner space 10*g*, 10*h* vertically. By the upward support portion 43, a corner space 10*g*, 10*h* may be partitioned into an upper corner space 10*g* and a lower corner space 10*h*.

A lower corner space 10*h* may be disposed below the upward support portion 43. An upper boundary surface of the lower corner space 10*h* may be defined by the upward support portion 43, a front boundary surface of the lower corner space 10*h* may be defined by the front support portion 42, and a right boundary surface of the lower corner space 10*h* may be defined by the lateral support portion 41. The corner fan assembly 200 may be disposed in the lower corner space 10*h*.

An upper corner space 10*g* may be disposed above the upward support portion 43. The upper corner space 10*g* is disposed on a rear side of a rear side of an upper electronic/electrical component chamber 10*c*, and may communicate with the upper electronic/electrical component chamber 10*c* at a rear side of the upper electronic/electrical component chamber 10*c*.

At least any one of electronic/electrical components disposed in the upper electronic/electrical component chamber 10*c* may be disposed on the upward support portion 43. As an example, a noise filter connected to the corner fan assembly 200 may be disposed in the upper corner space 10*g*, and this noise filter may be installed on an upper surface of the upward support portion 43.

Air introduced into a lower electronic/electrical component chamber 10*b* by the cooling fan 6 may flow to the upper electronic/electrical component chamber 10*c* through a second passage hole 54. Air introduced into the upper electronic/electrical component chamber 10*c* like this can pass through the upper corner space 10*g* and cool an electronic/electrical component installed on the upward support portion 43.

Meanwhile, the upper electronic/electrical component chamber 10*c* and the lower electronic/electrical component chamber 10*b* may be connected by a connection flow path portion 39. The connection flow path portion 39 may form a passage for air introduced into the lower electronic/electrical component chamber 10*b* by the cooling fan 6 to flow toward the blower 100, 200 through the upper electronic/electrical component chamber 10*c*. For example, the connection flow path portion 39 may form a passage through which air introduced into the electronic/electrical component chamber 10*b*, 10*c*, 10*d* flows into the corner fan assembly 200 through the upper corner space 10*g*.

Also, a through hole 41*b* may be provided in the lateral support portion 41. The through hole 41*b* is provided to be capable of laterally opening a space surrounded by the lateral support portion 41 and the front support portion 42, that is, the lower corner space 10*h*.

The connection flow path portion 39 may form a passage connecting between this through hole 41*b* and the upper electronic/electrical component chamber 10*c*, more specifically between the through hole 41*b* and the upper corner space 10*g*. Such a connection flow path portion 39 may respectively communicate with the upper corner space 10*g* and the lower corner space 10*h* at a lateral side of the corner space 10*g*, 10*h*. The connection flow path portion 39 and the lower corner space 10*h* may communicate through the through hole 41*b*.

As described above, the connection flow path portion 39 may be formed by a connection flow path defining member 37, 38. In the connection flow path defining member 37, 38, a first partition portion 37 may form a longitudinal wall disposed to be spaced apart by a predetermined interval laterally of the lateral support portion 41. And a second partition portion 38 is connected to the lateral support portion 41 below the through hole 41*b*, and may form a wall connecting the lateral support portion 41 and the first partition portion 37.

Both side surfaces of the connection flow path portion 39 may be defined by the lateral support portion 41 and the first partition portion 37. For example, a left side surface of the connection flow path portion 39 may be defined by the lateral support portion 41, and a right side surface of the connection flow path portion 39 may be defined by the first partition portion 37. A bottom surface of the connection flow path portion 39 may be defined by the second partition portion 38.

Air introduced into the upper electronic/electrical component chamber 10*c* may pass through the upper corner space 10*g* and flow into the connection flow path portion 39. Air introduced into the connection flow path portion 39 may flow into the lower corner space 10*h* through the through hole 41*b*, and then be suctioned into the corner fan assembly 200.

A suction force of the corner fan assembly 200 may act on the lower corner space 10*h*. A suction force acting in the lower corner space 10*h* in this way may also affect the connection flow path portion 39 and the upper corner space 10*g* connected to the lower corner space 10*h*. That is, the suction force of the corner fan assembly 200 may affect the upper corner space 10*g*, and this can act as a force that makes air introduced into the upper corner space 10*g* flow toward the lower corner space 10*h*.

Ultimately, the suction force of the corner fan assembly 200 can act as a force guiding a flow of air introduced into the upper electronic/electrical component chamber 10*c* from the lower electronic/electrical component chamber 10*b* to the lower corner space 10*h* through the connection flow path portion 39.

Hereinafter, an air flow in the electronic/electrical component chamber 10*b*, 10*c*, 10*d* will be examined.

External air may flow into an inside of the main body 10 through a cold air inlet as illustrated in FIG. 20. Air passing through the cold air inlet in this way may flow into an intake chamber 10*d* as illustrated in FIGS. 21 to 23.

Air introduced into the intake chamber 10*d* may flow to the lower electronic/electrical component chamber 10*b* by passing through the partition plate 50 through a first passage hole 52. In the lower electronic/electrical component chamber 10*b*, air may flow rearward by the cooling fan 6. Air flowing rearward in the lower electronic/electrical component chamber 10*b* in this way can cool electronic/electrical components disposed in the lower electronic/electrical component chamber 10*b*.

Some of air flowing in the lower electronic/electrical component chamber 10*b* may pass through the cavity 11 through an internal inlet hole 11*a* and flow into the cooking chamber 10*a*. Another part of air flowing in the lower electronic/electrical component chamber 10*b* may pass through the partition plate 50 through a second passage hole 54 and flow to the upper electronic/electrical component chamber 10*c*.

In the upper electronic/electrical component chamber 10*c*, air may flow toward the connection flow path portion 39 under an influence of the suction force of the corner fan assembly 200. For example, air introduced into the upper electronic/electrical component chamber 10*c* passes through the upper corner space 10*g* and cools an electronic/electrical component, and then may flow into the connection flow path portion 39 as illustrated in FIGS. 23 and 24.

Air having flowed to the connection flow path portion 39 passes through the lateral support portion 41 through the through hole 41*b*, flows into the lower corner space 10*h*, and then may be suctioned into the corner fan assembly 200. That is, air introduced into the lower corner space 10*h* from the connection flow path portion 39 may join with air introduced into an inside of the main body 10 through the air intake hole 1 as illustrated in FIG. 11, be suctioned into the corner fan assembly 200, and then be discharged to the exhaust flow path A.

As illustrated in FIGS. 21 to 23, a flow path formed in the electronic/electrical component chamber 10*b*, 10*c*, 10*d*, the corner space 10*g*, 10*h*, and the connection flow path portion 39 can allow a force provided by a suction force of the corner fan assembly 200 to be added in the electronic/electrical component chamber 10*b*, 10*c*, 10*d* to a force provided by the cooling fan 6, thereby making an air flow inside the electronic/electrical component chamber 10*b*, 10*c*, 10*d* be made more smoothly, and can contribute to making cooling of electronic/electrical components disposed in the electronic/electrical component chamber 10*b*, 10*c*, 10*d* be made more effectively.

Also, a flow path formed in the electronic/electrical component chamber 10*b*, 10*c*, 10*d*, the corner space 10*g*, 10*h*, and the connection flow path portion 39 as described above allows air introduced into the electronic/electrical component chamber 10*b*, 10*c*, 10*d* to be able to flow toward the corner fan assembly 200, thereby allowing an air suction amount of the corner fan assembly 200 to be increased, and ultimately can contribute to allowing a discharge air volume of the corner fan assembly 200 to be effectively increased.

Meanwhile, referring to FIGS. 21 to 24, the cooking appliance of the present embodiment may further include a flow path partition plate 16. The flow path partition plate 16 is provided to be able to partition a space above the cavity 11 and the partition plate 50. Such a flow path partition plate 16 may partition a space above the cavity 11 and the partition plate 50 into the upper electronic/electrical component chamber 10*c* and the upper space 10*i*.

As an example, the flow path partition plate 16 may form a longitudinal wall orthogonal to a lateral axis. Such a flow path partition plate 16 blocks between the upper electronic/electrical component chamber 10*c* and the upper space 10*i*, and may separate these two spaces. For example, the flow path partition plate 16 may define a right boundary surface of the upper electronic/electrical component chamber 10*c*, and may define a left boundary surface of the upper space 10*i*.

In addition, the cooking appliance of the present embodiment may include a waveguide 17. The waveguide 17 is provided to be able to transfer a microwave generated in a magnetron installed in the electronic/electrical component chamber 10*b*, 10*c*, 10*d* to the cooking chamber 10*a*.

The waveguide 17 is disposed in the upper electronic/electrical component chamber 10*c* and the upper space 10*i*, and may be installed on upper surfaces of the partition plate 50 and the cavity 11. That is, a portion of the waveguide 17 is installed on an upper surface of the partition plate 50, and a remaining portion of the waveguide 17 may be installed on an upper surface of the cavity 11 by penetrating the flow path partition plate 16 in a lateral direction.

A space is formed in an inside of the waveguide 17, an inlet of the waveguide 17 connected to this space may be connected to a magnetron, and an outlet of the waveguide 17 connected to this space may be connected to the cooking chamber 10*a*. A microwave introduced into an inside of the waveguide 17 through an inlet of the waveguide 17 may flow into the cooking chamber 10*a* through an outlet of the waveguide 17.

An outlet of the waveguide 17 may be connected to the cooking chamber 10*a* on an upper surface of the cavity 11. Accordingly, a microwave transferred from a magnetron through the waveguide 17 may flow into the cooking chamber 10*a* from above the cooking chamber 10*a* through an upper surface of the cavity 11. As an example, an outlet of the waveguide 17 is disposed above the cavity 11, and may be disposed approximately at a lateral center of the cavity 11.

When a vertical length of a cooking appliance is shortened, there is a high possibility that a vertical length of the cooking chamber 10*a* is also shortened. Even if the blower 100, 200 is disposed in the rear space 10*f* instead of the upper space 10*i*, and accordingly a vertical length of the upper space 10*i* can be reduced, a length reduction amount of the upper space 10*i* is inevitably smaller than a length reduction amount of an entire cooking appliance, so it is difficult to avoid a length reduction of the cooking chamber 10*a* according to a length reduction of a cooking appliance.

In this case, a shape of the cooking chamber 10*a* comes to have a flatter shape in a horizontal direction compared to a cooking chamber of a typical cooking appliance. In a cooking appliance having the cooking chamber 10*a* of such a shape, when a microwave flows into the cooking chamber 10*a* through a side surface of the cavity 11, it is difficult for a microwave to be evenly supplied to an entire cooking chamber 10*a*.

In this case, in the present embodiment, the waveguide 17 is installed on an upper surface of the cavity 11, and a microwave may flow into the cooking chamber 10*a* through an upper surface of the cavity 11. That is, in the cooking appliance of the present embodiment, microwave supply can be made through above the cooking chamber 10*a*, and accordingly a microwave can be evenly supplied to an entire cooking chamber 10*a*.

In addition, the cooking appliance of the present embodiment may include a screening member 60 disposed in the intake chamber 10*d*. The screening member 60 is provided to be able to screen passage holes 52, 54 formed in the partition plate 50, more specifically a first passage hole 52, from above or below, and is provided to be able to block between the first passage hole 52 and a cold air inlet.

Such a screening member 60 blocks a flame generated in the lower electronic/electrical component chamber 10*b* in the intake chamber 10*d*, so that it can prevent a flame generated in the lower electronic/electrical component chamber 10*b* from being exposed to an exterior of the cooking appliance.

The cooking appliance of the present embodiment equipped with such a screening member 60 can provide an effect of remarkably lowering a risk of a fire spreading due to a flame generated inside the cooking appliance while allowing air inflow into the lower electronic/electrical component chamber 10*b* to be smoothly made.

[Structure of Upper Space]

Figure 25:
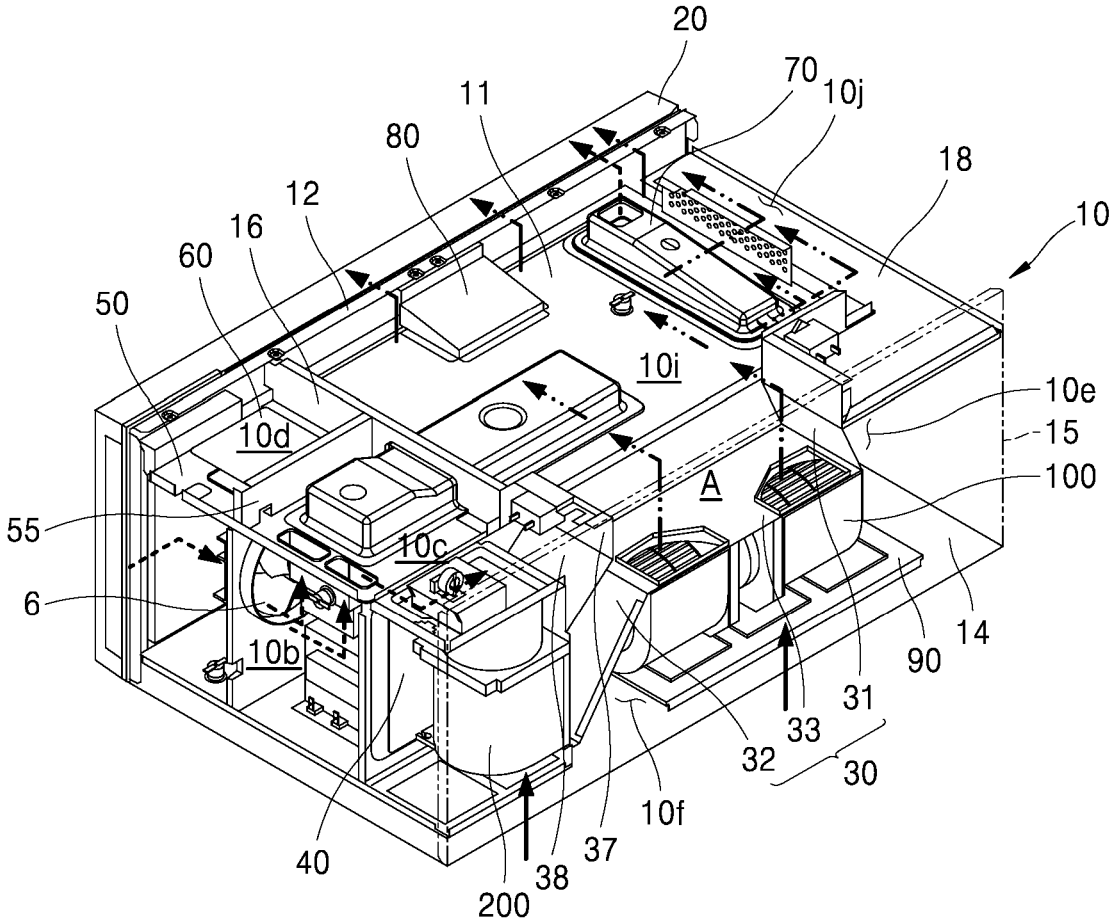
FIG. 25 is a rear perspective view illustrating an air flow state inside the cooking appliance according to the first embodiment of the present disclosure.

FIG. 25 is a rear perspective view illustrating an air flow state inside a cooking appliance according to a first embodiment of the present disclosure.

Referring to FIGS. 14 and 25, a lamp may be provided in an inside of the main body 10. A lamp is provided to be able to shine light into the cooking chamber 10*a*. As an example, a lamp may be installed on an upper surface of the cavity 11. At least a portion of such a lamp may be exposed above the cavity 11. For example, a portion of a lamp installed on an upper surface of the cavity 11 may be exposed to the upper space 10*i*.

A lamp cover 80 may be disposed in the upper space 10*i*, and this lamp cover 80 is provided to be able to cover a lamp. The lamp cover 80 may cover a lamp from above the cavity 11 so that a space surrounding a lamp is separated from the upper space 10*i*.

Such a lamp cover 80 covers a lamp from above the cavity 11 so that a space surrounding a lamp is separated from the upper space 10*i*, thereby protecting a lamp from oil vapor and heat.

Also, the cooking appliance of the present embodiment may include an extension plate 18. The extension plate 18 may be configured to partition the side space 10*e* such that a partial region of the side space 10*e* is separated into an extended upper space 10*j*. By the extension plate 18, a region above the extension plate 18 of the side space 10*e* may be partitioned into an extended upper space 10*j*.

At least a portion of the extension plate 18 may be disposed in the side space 10*e*. In the present embodiment, it is exemplified that an extension plate 18 is disposed in a side space 10*e*, not an electronic/electrical component chamber 10*b*, 10*c*, 10*d*, among a pair of side spaces 10*e* disposed inside a cooking appliance.

As an example, the extension plate 18 may form a horizontal plane orthogonal to a vertical axis. For example, the extension plate 18 may form a plane parallel to an upper surface of the cavity 11.

Preferably, an upper surface of the extension plate 18 and an upper surface of the cavity 11 may form a same plane. An upper surface of the cavity 11 may define a bottom surface of the upper space 10*i*, and an upper surface of the extension plate 18 may define a bottom surface of an extended upper space 10*j*. Accordingly, a bottom surface of the upper space 10*i* and a bottom surface of an extended upper space 10*j* may be disposed on a same plane.

An extended upper space 10*j* provided as described above may communicate with the upper space 10*i* from above the side space 10*e*. That is, an extended upper space 10*j* is disposed above the side space 10*e* and on a lateral side of the upper space 10*i*, and may be laterally connected to the upper space 10*i*.

According to the present embodiment, the upper space 10*i* and an extended upper space 10*j* are connected as one above the cavity 11, and accordingly, an exhaust space 10*i*, 10*j* may be formed above the cavity 11 and the side space 10*e*. In the present embodiment, an exhaust space 10*i*, 10*j* may be defined as a space where the upper space 10*i* and an extended upper space 10*j* are connected as one above the cavity 11 and the extension plate 18 connected as one.

In this way, an exhaust space 10*i*, 10*j* formed above the cavity 11 and the extension plate 18 may communicate with an exhaust hole 2, 3, 4 disposed on an upper surface of the main body 10. The exhaust hole 2, 3, 4 may be configured to open a space in which the upper space 10*i* and the extended upper space 10*j* are connected, that is, the exhaust space 10*i*, 10*j*, to an exterior of the main body 10.

The side space 10*e* and the rear space 10*f* may communicate with the lower space. The side space 10*e* and the rear space 10*f* may be connected to the lower space in a vertical direction, or may be connected in a lateral direction. The air intake hole 1 communicates with the lower space, and may communicate with the air intake hole 1 through a lower space of the side space 10*e* and the rear space 10*f*.

A portion of the extension plate 18 may be disposed in the rear space 10*f* According to this, a certain portion 18*a* (hereinafter, referred to as a "side partition portion of an extension plate") of the extension plate 18 is disposed in the side space 10*e*, and another portion 18*b* (hereinafter, referred to as a "rear partition portion of an extension plate") of the extension plate 18 may be disposed in the rear space 10*f*.

The side partition portion 18*a* of the extension plate 18 may partition the side space 10*e* such that a partial region of the side space 10*e* is separated into the extended upper space 10*j*, as described above. And the rear partition portion 18*b* of the extension plate 18 may partition a partial region of the rear space 10*f* such that a partial region of the rear space 10*f* is separated into the extended upper space 10*j*.

That is, the extension plate 18 may partition a partial region of the rear space 10*f* and the side space 10*e* such that a partial region of the side space 10*e* and the rear space 10*f* is separated into the extended upper space 10*j*.

A first coupling portion 18*c* may be provided in the extension plate 18. The first coupling portion 18*c* may be provided for coupling between the extension plate 18 and the cavity 11. As an example, the first coupling portion 18*c* may be formed to protrude in a lateral direction from at least any one of the side partition portion 18*a* and the rear partition portion 18*b*. Such a first coupling portion 18*c* is abutted against an upper surface of the cavity 11 in a vertical direction and may be coupled with the cavity 11.

The coupling between the first coupling portion 18*c* and the cavity 11 may be achieved by a joining method by welding, etc., or may be achieved by a fastening method by a screw, etc.

In the present embodiment, it is exemplified that the first coupling portion 18*c* is formed to protrude in a lateral direction from the side partition portion 18*a*. As another example, the first coupling portion 18*c* may be formed to protrude in a frontward direction from the rear partition portion 18*b*. As yet another example, the first coupling portion 18*c* may protrude in a longitudinal direction from at least any one of the side partition portion 18*a* and the rear partition portion 18*b* and be coupled with a side surface of the cavity 11.

Also, the extension plate 18 may include at least any one of a second coupling portion 18*d* and a third coupling portion 18*e*. The second coupling portion 18*d* and the third coupling portion 18*e* may be provided for coupling between the extension plate 18 and the cabinet 13.

The second coupling portion 18*d* may be provided in a shape protruding from the side partition portion 18*a* or the first coupling portion 18*c*. In the present embodiment, it is exemplified that the first coupling portion 18*c* protrudes in a lateral direction from the side partition portion 18*a*, and the second coupling portion 18*d* protrudes in a longitudinal direction from the first coupling portion 18*c*.

As an example, the second coupling portion 18*d* may form a longitudinal wall orthogonal to a lateral axis. A plane parallel to an upper surface of the cabinet 13 may be formed at an upper end of such a second coupling portion 18*d*.

The third coupling portion 18*e* may be provided in a shape protruding from the rear partition portion 18*b*. As an example, the third coupling portion 18*e* may form a longitudinal wall orthogonal to a front-rear axis. A plane parallel to an upper surface of the cabinet 13 may be formed at an upper end of such a third coupling portion 18*e*.

A vertical length of the second coupling portion 18*d* and the third coupling portion may be set to a length corresponding to a distance between the extension plate 18 and the cabinet 13, respectively. The second coupling portion 18*d* and the third coupling portion 18*e* formed in this way may be coupled with the cabinet 13 below the cabinet 13.

By a coupling between the second coupling portion 18*d* and the cabinet 13, and a coupling between the third coupling portion 18*e* and the cabinet 13, the extension plate 18 can support the cabinet 13 so that an upper surface of the cabinet 13 does not sag downward. Also, the extension plate 18 may be stably fixed inside the cooking appliance by being coupled with various structures at various positions using the first coupling portion 18*c*, the second coupling portion 18*d*, and the third coupling portion 18*e*.

As an example, the second coupling portion 18*d* may be disposed between the upper space 10*i* and the extended upper space 10*j*. That is, the second coupling portion 18*d* may be disposed in the exhaust space 10*i*, 10*j* in a shape of a longitudinal wall laterally blocking a portion between the upper space 10*i* and the extended upper space 10*j*.

A plurality of ventilation holes may be provided in such a second coupling portion 18*d*. Each ventilation hole may be formed to pass through the second coupling portion 18*d* in a lateral direction, and a ventilation hole may be disposed in most regions of the second coupling portion 18*d*.

The second coupling portion 18*d* having a plurality of ventilation holes in this way can minimize a flow of air in the exhaust space 10*i*, 10*j* being obstructed by the second coupling portion 18*d*, while providing a structure for a coupling between the extension plate 18 and the cabinet 13.

In the present embodiment, it is exemplified that the third coupling portion 18*e* is disposed in a region where the rear space 10*f* and the upper space 10*i* overlap, or in a region very close thereto. Such a third coupling portion 18*e* may be disposed at a position adjacent to the rear fan assembly 100 disposed in the rear space 10*f*.

To the third coupling portion 18*e* disposed in this way, an electronic/electrical component related to the rear fan assembly 100, for example, an electronic/electrical component such as a capacitor connected to the rear fan assembly 100, may be coupled. That is, the third coupling portion 18*e* can simultaneously perform a role of providing a structure for coupling between the extension plate 18 and the cabinet 13, and a role of providing a structure for an installation of an electronic/electrical component related to the rear fan assembly 100.

[Form of Exhaust Through Exhaust Space]

Referring to FIGS. 14 and 25, the upper space 10*i* may be formed above the cavity 11. Also, the extended upper space 10*j* may be formed above the side space 10*e*, which is not the electronic/electrical component chamber 10*b*, 10*c*, 10*d*.

As described above, the upper space 10*i* and the extended upper space 10*j* are connected as one above the cavity 11, and accordingly, the exhaust space 10*i*, 10*j* may be formed above the cavity 11 and the side space 10*e*.

The extended upper space 10*j* may be formed by the extension plate 18 that vertically partitions the side space 10*e*. In the present embodiment, the extension plate 18 may perform a role of laterally expanding the exhaust space 10*i*, 10*j* by making the exhaust space 10*i*, 10*j* a space including not only the upper space 10*i* but also the extended upper space 10*j*. In addition to that, the extension plate 18 may perform a role of separating the side space 10*e* from the exhaust space 10*i*, 10*j*.

As the exhaust space 10*i*, 10*j* is expanded into a space including the upper space 10*i* and the extended upper space 10*j* together, a size of a flow path required for a flow of air discharged to the second exhaust hole 3 through the exhaust space 10*i*, 10*j*, that is, a hood discharge air, can be expanded. In particular, a size of the exhaust space 10*i*, 10*j* can be further expanded in a lateral direction by a size of the extended upper space 10*j*.

That is, the extension plate 18 of the present embodiment can provide an effect of allowing a size of the exhaust space 10*i*, 10*j* to be expanded by partitioning the side space 10*e* such that the extended upper space 10*j* capable of being connected to the upper space 10*i* can be formed.

As described above, in the cooking appliance of the present embodiment, the blower 100, 200 is disposed in the rear space 10*f*, not the upper space 10*i*. Accordingly, since a space necessary for an installation of the blower 100, 200 is not required to be secured in the upper space 10*i*, a height of the upper space 10*i* can be lowered compared to a case where a blower is installed in an upper space.

In the cooking appliance of the present embodiment, one of methods for reducing a size of an entire cooking appliance while minimizing a volume reduction of a cooking chamber, that is, a method for reducing a height of an entire cooking appliance while minimizing a height reduction of a cooking chamber, is to reduce a height of the upper space 10*i*.

Considering this point, in the cooking appliance of the present embodiment, a height of the upper space 10*i* is set lower compared to a height of an upper space of a conventional cooking appliance. That is, in the cooking appliance of the present embodiment, a height of the upper space 10*i* is set to a height significantly lower than a height at which an installation of the rear fan assembly 100 or the corner fan assembly 200 is possible.

When a height of the upper space 10*i* is lowered in this way, a volume of the upper space 10*i* inevitably decreases together. Since the upper space 10*i* is a space associated with exhaust, when a volume of the upper space 10*i* is decreased, a size of a flow path required for a flow of a hood discharge air is inevitably decreased accordingly.

When a size of a flow path required for a flow of a hood discharge air is decreased, an exhaust performance of a cooking appliance is inevitably degraded. Also, when an exhaust performance of a cooking appliance is degraded, an intake performance of a cooking appliance is also inevitably degraded together, and ultimately, a result of degrading a cooking gas removal performance of a cooking appliance occurs.

In this case, in the present embodiment, the extended upper space 10*j* is separated from the side space 10*e* by the extension plate 18 partitioning the side space 10*e* vertically, and by making this extended upper space 10*j* connected to the upper space 10*i*, a size of an entire exhaust space 10*i*, 10*j* including the upper space 10*i* is allowed to be expanded. Accordingly, a size of a flow path required for a flow of a hood discharge air through the exhaust space 10*i*, 10*j* can be effectively expanded.

When a size of a flow path required for a flow of air discharged to the second exhaust hole 3 through the exhaust space 10*i*, 10*j* is expanded in this way, an exhaust performance of a cooking appliance can be improved accordingly, and ultimately, a cooking gas removal performance of a cooking appliance can be improved.

That is, in the present embodiment, a size of the exhaust space 10*i*, 10*j* is expanded by the extended upper space 10*j*, and accordingly, a size of a flow path required for a flow of a hood discharge air is expanded, whereby a flow of a hood discharge air can be smoothly made.

Through this, the cooking appliance of the present embodiment can provide an equal or more excellent cooking gas removal performance while an overall size is small compared to a conventional cooking appliance having a similar cookable capacity.

In addition, the extension plate 18 may perform a role of a blocking wall blocking between the side space 10*e* and the exhaust space 10*i*, 10*j*. Accordingly, the side space 10*e* may be separated from the exhaust space 10*i*, 10*j* by the extension plate 18.

That is, a space in which the upper space 10*i* and the extended upper space 10*j* are connected is formed above the extension plate 18 by the extension plate 18, but a passage between the side space 10*e* and the exhaust space 10*i*, 10*j* is blocked due to the extension plate 18.

According to the present embodiment, the side space 10*e* is connected to a lower space formed between the air intake hole 1 and the cavity 11. Accordingly, the side space 10*e* may be said to be a space connected to the air intake hole 1. And the exhaust space 10*i*, 10*j* may be said to be a space connected to the second exhaust hole 3. That is, the side space 10*e* may be said to be a space associated with intake, and the exhaust space 10*i*, 10*j* may be said to be a space associated with exhaust.

By separating the exhaust space 10*i*, 10*j* from the side space 10*e*, the extension plate 18 can separate a space associated with exhaust from a space associated with intake. Accordingly, a space associated with exhaust is expanded by the extended upper space 10*j*, and additionally, a space associated with intake can be expanded by a space occupied by the side space 10*e*.

That is, as the exhaust space 10*i*, 10*j* and the side space 10*e* are separated by the extension plate 18, a space associated with exhaust and a space associated with intake can be respectively secured to a sufficient size necessary for intake or exhaust.

Also, as the exhaust space 10*i*, 10*j* and the side space 10*e* are separated by the extension plate 18, an occurrence of a phenomenon where air in the exhaust space 10*i*, 10*j* is re-suctioned to the blower 100, 200, that is, a backflow phenomenon, can be effectively suppressed, whereby an exhaust performance of a cooking appliance can be effectively improved.

[First Example of Exhaust Structure Through Side Space]

Figure 26:
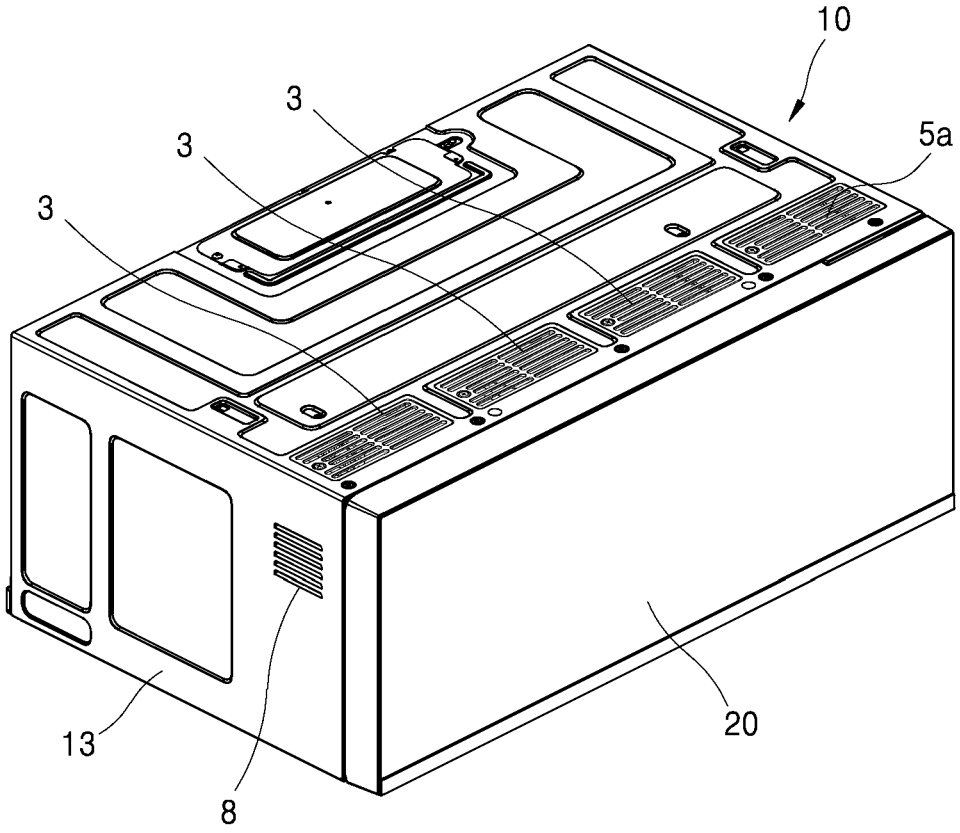
FIG. 26 is a perspective view illustrating an external exhaust hole side of the cooking appliance illustrated in FIG. 1.
Figure 27:
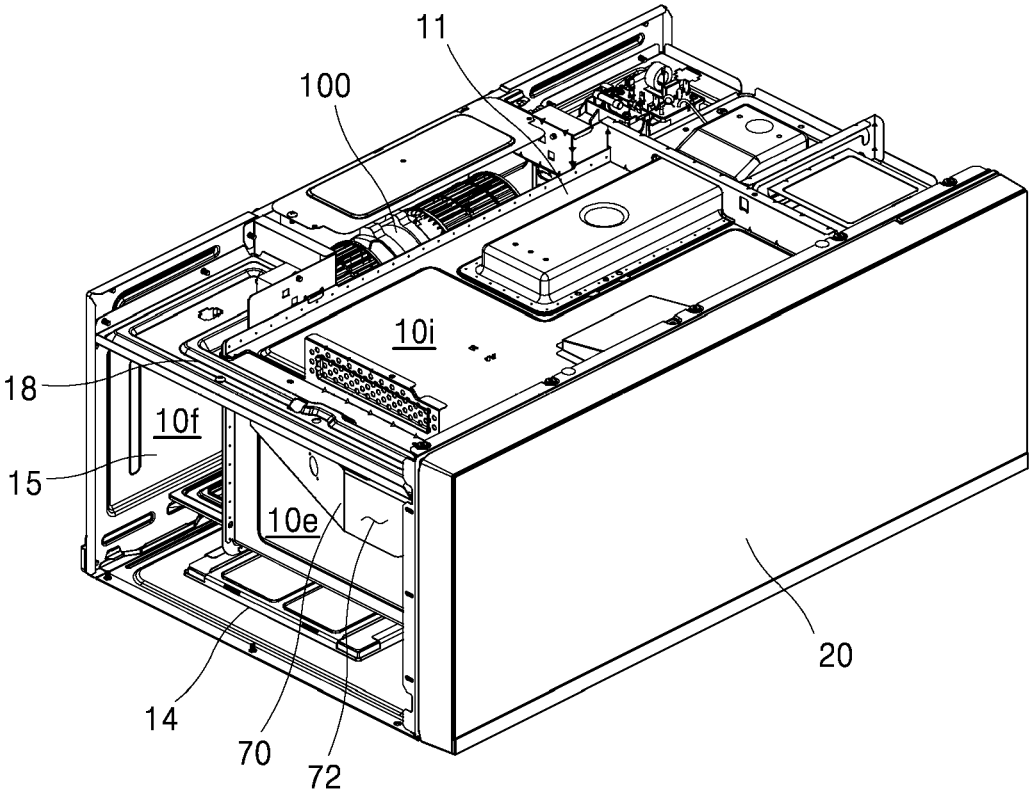
FIG. 27 is a view illustrating a state in which the cabinet is removed from the cooking appliance illustrated in FIG. 26.
Figure 28:
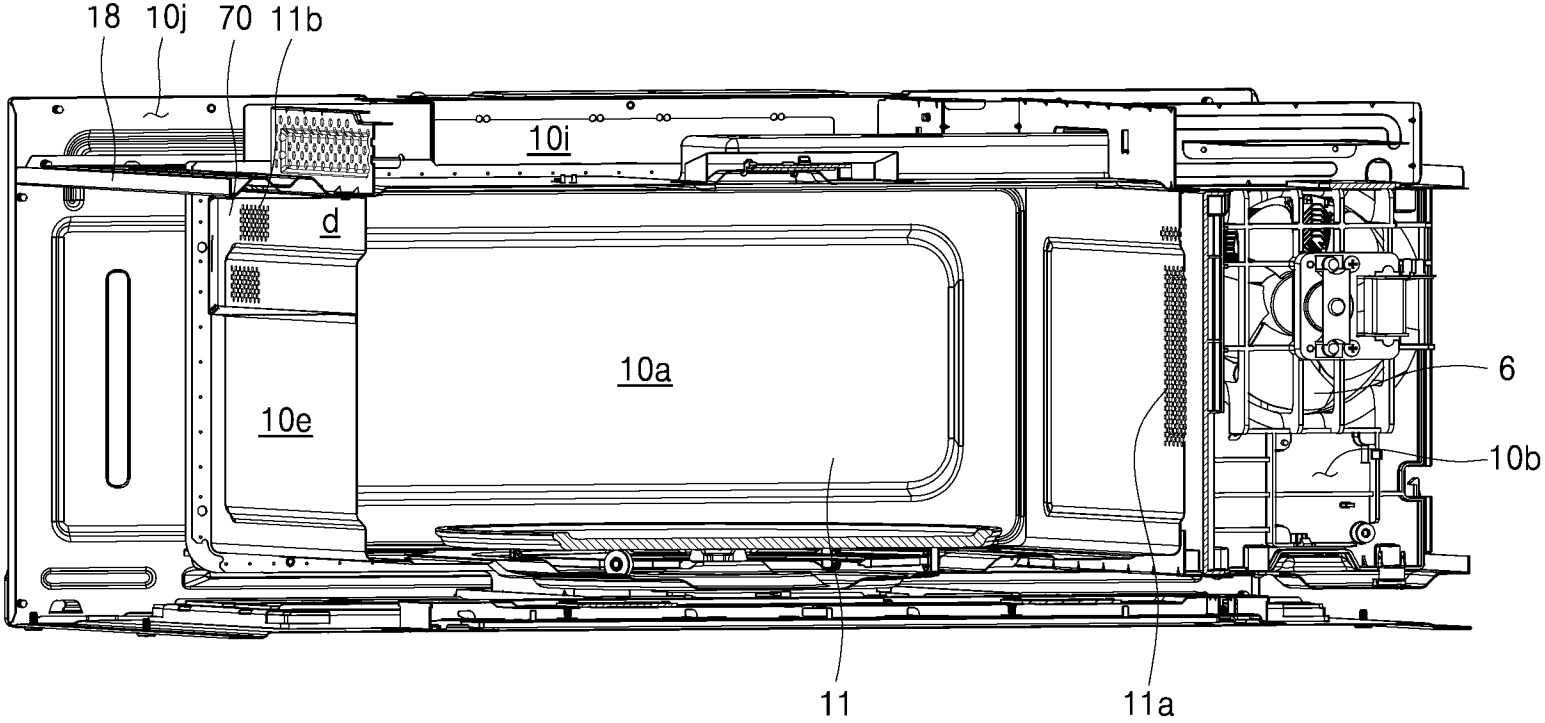
FIGS. 28 and 29 are front cross-sectional views illustrating an internal structure of the cooking appliance illustrated in FIG. 26.
Figure 29:
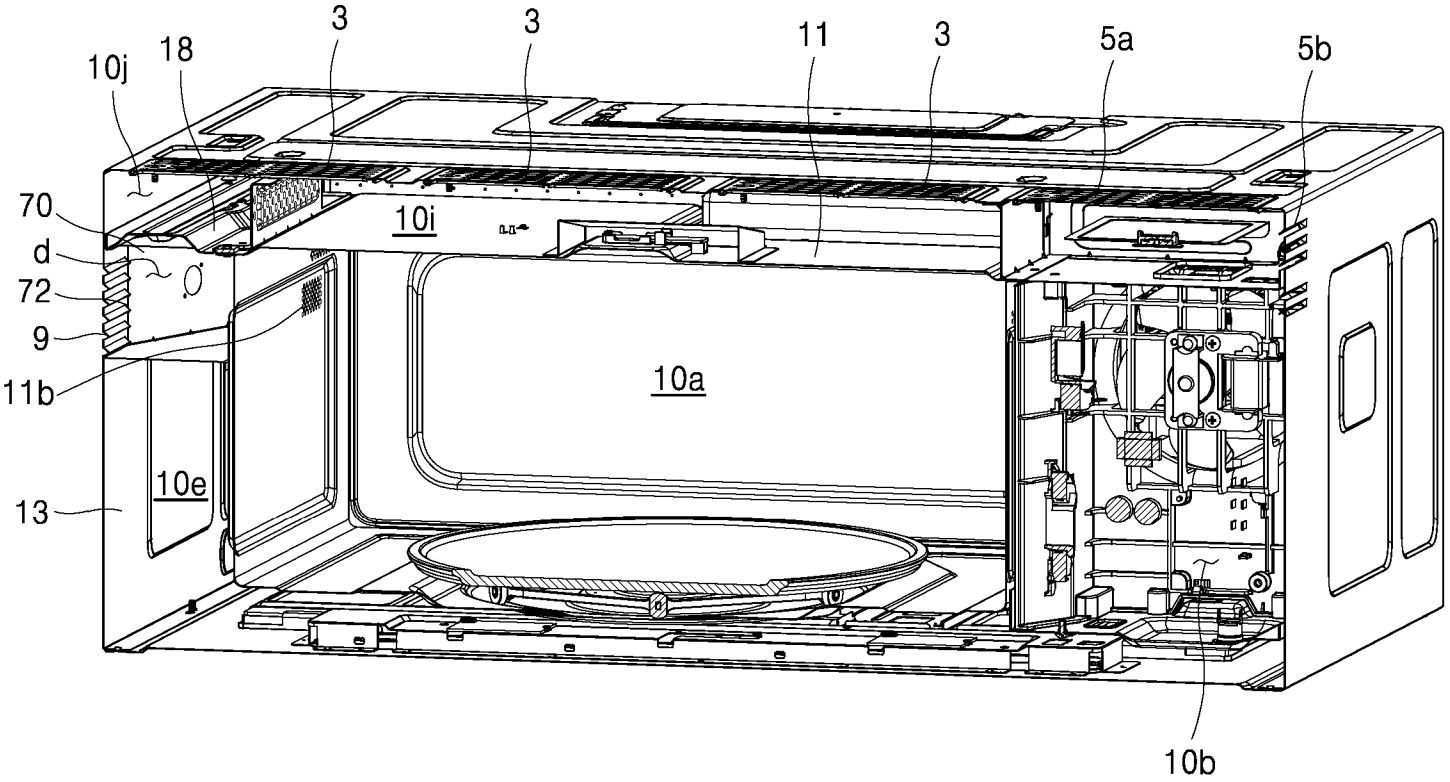
Figure 30:
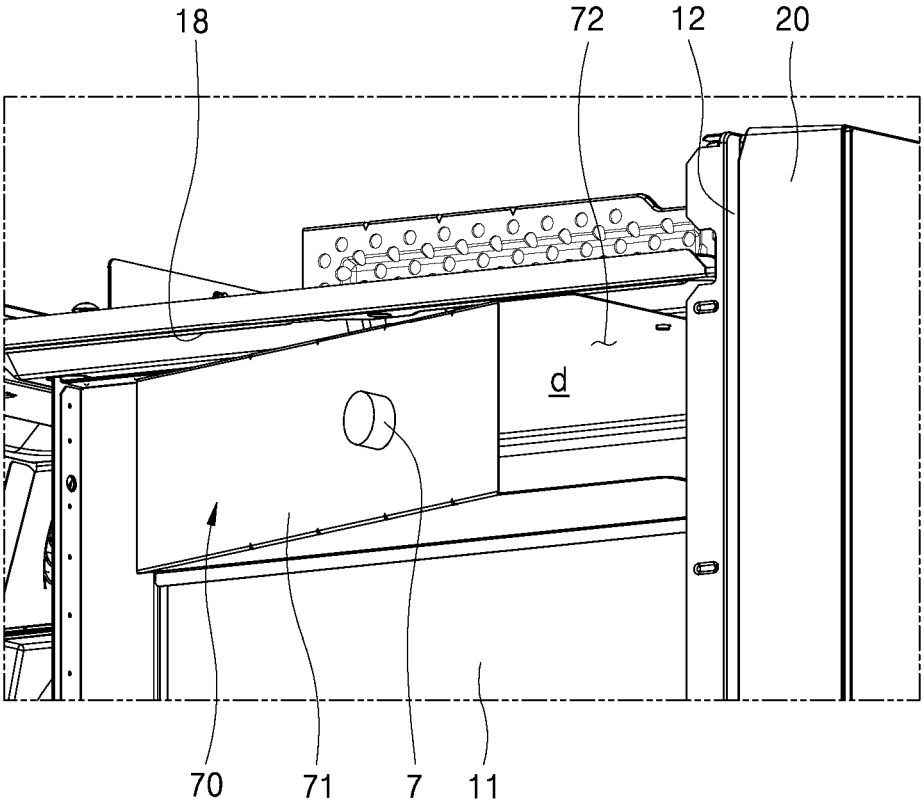
FIG. 30 is an enlarged view enlarging and illustrating a guide duct illustrated in FIG. 27 and a surrounding thereof.
Figure 31:
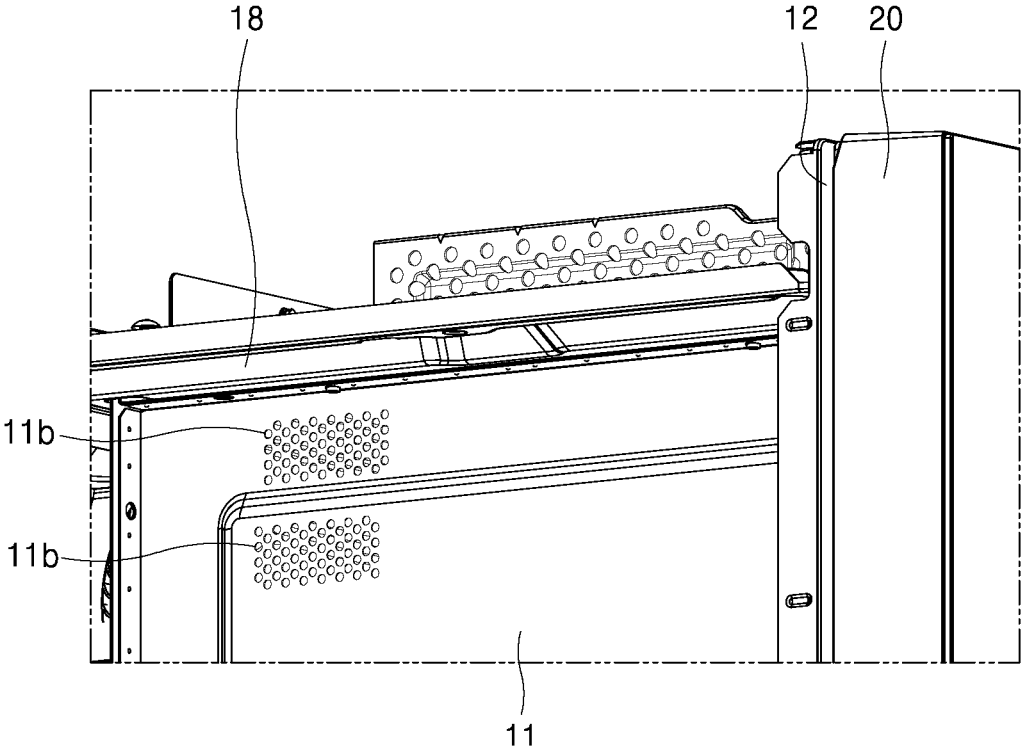
FIG. 31 is a view illustrating a state in which the guide duct is removed from the cooking appliance illustrated in FIG. 30.

FIG. 26 is a perspective view illustrating an external air exhaust hole side of the cooking appliance illustrated in FIG. 1, FIG. 27 is a view illustrating a state in which a cabinet is removed from the cooking appliance illustrated in FIG. 26, and FIGS. 28 and 29 are front cross-sectional views illustrating an internal structure of the cooking appliance illustrated in FIG. 26. Also, FIG. 30 is an enlarged view enlarging and illustrating a guide duct illustrated in FIG. 27 and a surrounding thereof, and FIG. 31 is a view illustrating a state in which a guide duct is removed from the cooking appliance illustrated in FIG. 30.

Referring to FIG. 26, the exhaust hole 2, 3, 4 is provided on an upper surface of the cabinet 13, and may be formed to pass through the upper surface of the cabinet 13 in a vertical direction. Such an exhaust hole 2, 3, 4 may be configured to open the upper space 10*i* to an exterior. A cooking gas suctioned to an inside of a cooking appliance and having flowed to the upper space 10*i* may be discharged to an exterior of a cooking appliance through the exhaust hole 2, 3, 4.

Hereinafter, an exhaust hole 3 provided on an upper surface of the cabinet 13 and opening the upper space 10*i* to an exterior will be distinguished from other exhaust holes to be described later and referred to as an exhaust hole 2, 3, 4.

As illustrated in FIGS. 26 to 29 and FIG. 31, an internal exhaust hole 11*b* and an external exhaust hole 8 may be further provided in the main body 10. The internal exhaust hole 11*b* may be configured to form a passage opening an inside of the cooking chamber 10*a* to an exterior of the cooking chamber 10*a*. And the external exhaust hole 8 may be configured to form a passage opening at least any one of the side space 10*e* and the upper space 10*i* to an exterior of the main body 10.

The side space 10*e* and the upper space 10*i* may be disposed between the cabinet 13 and the cavity 11. The upper space 10*i* may be defined as a space between an upper surface of the cavity 11 and an upper surface of the cabinet 13, and the side space 10*e* may be defined as a space between a side surface of the cavity 11 and a side surface of the cabinet 13. Also, the side space 10*e* may be defined as a space in which an extended upper space 10*j* is added to a space between a side surface of the cavity 11 and a side surface of the cabinet 13, or may be defined as a space not including an extended upper space 10*j*.

According to the present embodiment, the upper exhaust hole 2 faces the cavity 11 in a vertical direction, or is disposed on a surface defining an upper boundary of the upper space 10*i*. For example, the upper exhaust hole 3 may be disposed above the cavity 11, or may be disposed on an upper surface of the cabinet 13.

In the present embodiment, a shape in which the upper exhaust hole 3 is provided on an upper surface of the cabinet 13 and is disposed at a position spaced apart upwardly by a predetermined interval from the cavity 11 is exemplified.

As an example, the internal exhaust hole 11*b* may be disposed in the cavity 11, and the external exhaust hole 8 may be disposed in the cabinet 13.

At least any one of the internal exhaust hole 11*b* and the external exhaust hole 8 may face a direction different from a direction in which the upper exhaust hole 3 faces with respect to the cavity 11, or may be disposed on a surface other than a surface defining an upper boundary of the upper space 10*i*.

That is, at least any one of the internal exhaust hole 11*b* and the external exhaust hole 8 may be disposed at a position other than above the cavity 11, for example, on a lateral side or a rear side of the cavity 11, or may be disposed on a surface other than an upper surface of the main body 10, for example, on a side surface or a rear surface of the main body 10.

As an example, at least any one of the internal exhaust hole 11*b* and the external exhaust hole 8 may face the side space 10*e* in a lateral direction, or may be disposed on a surface defining the side space 10*e*. For example, at least any one of the internal exhaust hole 11*b* and the external exhaust hole 8 may be disposed on a side surface of the cavity 11 or a side surface of the cabinet 13.

The side space 10*e* is disposed between the internal exhaust hole 11*b* and the external exhaust hole 8. The internal exhaust hole 11*b* forms a passage opening an inside of the cooking chamber 10*a* to the side space 10*e* or the upper space 10*i*, and the external exhaust hole 8 may form a passage opening the side space 10*e* or the upper space 10*i* to an exterior of the main body 10.

In this case, at least any one of the internal exhaust hole 11*b* and the external exhaust hole 8 forms a passage connected to the side space 10*e*. For example, if the internal exhaust hole 11*b* forms a passage connected to the upper space 10*i*, the external exhaust hole 8 forms a passage connected to the side space 10*e*. If the internal exhaust hole 11*b* forms a passage connected to the side space 10*e*, the external exhaust hole 8 may form a passage connected to the side space 10*e*, or may form a passage connected to the upper space 10*i*.

In other words, when the internal exhaust hole 11*b* is disposed on an upper surface of the cavity 11, the external exhaust hole 8 is disposed on a side surface of the cabinet 13. If the internal exhaust hole 11*b* is disposed on a side surface of the cavity 11, the external exhaust hole 8 may be disposed on a side surface of the cabinet 13, or may be disposed on an upper surface of the cabinet 13.

In the present embodiment, a shape in which both the internal exhaust hole 11*b* and the external exhaust hole 8 face the side space 10*e* in a lateral direction is exemplified.

According to the present embodiment, a side surface of the cavity 11 and a side surface of the cabinet 13 respectively face the side space 10*e* laterally, and the side space 10*e* is disposed between a side surface of the cavity 11 and a side surface of the cabinet 13. And the external exhaust hole 8 is disposed on a side surface of the cabinet 13, and the internal exhaust hole 11*b* is disposed on a side surface of the cavity 11.

That is, the external exhaust hole 8 is disposed on a side surface of the cabinet 13, which is a surface where the upper exhaust hole 3 is not disposed, and the external exhaust hole 8 and the internal exhaust hole 11*b* face each other in a lateral direction with the side space 10*e* interposed therebetween.

According to the present embodiment, air flowing to an exterior of the cooking chamber 10*a* through the internal exhaust hole 11*b* after flowing into an inside of the cooking chamber 10*a* may be discharged to an exterior of the cooking appliance through the external exhaust hole 8.

Hereinafter, air discharged to an exterior of a cooking appliance through the external exhaust hole 8 of a cooking appliance will be distinguished from air discharged through other exhaust holes of a cooking appliance and referred to as an "in-chamber discharge air". Also, air discharged from the cooking chamber 10*a* through the internal exhaust hole 11*b* will also be together referred to as an "in-chamber discharge air".

Meanwhile, the cooking appliance of the present embodiment may further include a guide duct 70, as illustrated in FIGS. 27 to 30. The guide duct 70 may be configured to form a flow path d therein connected to the internal exhaust hole 11*b*. The flow path d may form a passage in an inside of the guide duct 70 guiding a flow of air having flowed to the side space 10*e* through the internal exhaust hole 11*b* from the cooking chamber 10*a* toward the external exhaust hole 8.

At least a portion of the guide duct 70 may be disposed in the side space 10*e*. As an example, most regions of the guide duct 70 may be disposed in the side space 10*e*, and the flow path d may form a passage connecting between the internal exhaust hole 11*b* and the external exhaust hole 8 in the side space 10*e*.

According to the present embodiment, the internal exhaust hole 11*b* and the external exhaust hole 8 may be disposed to be spaced apart in a front-rear direction. For example, the internal exhaust hole 11*b* is disposed on a side surface of the cavity 11, and is disposed at a position further biased rearward from a front-rear directional center of the cavity 11. And the external exhaust hole 8 is disposed on a side surface of the cabinet 13, and is disposed at a position further biased rearward from a front-rear directional center of the cabinet 13.

As an example, the guide duct 70 may be formed in a polyhedral shape in which a front-rear directional length is longer compared to a lateral length and a vertical length. A rear end of such a guide duct 70 may be disposed between a rear surface of the cavity 11 and the internal exhaust hole 11*b*. And a front end of the guide duct 70 may be disposed between a front-rear directional center of the cavity 11 and a front surface of the cavity 11.

For example, a rear end of the guide duct 70 is disposed at a position very adjacent to a rear surface of the cavity 11, and a front end of the guide duct 70 may be disposed at a position very adjacent to a front surface of the cavity 11.

A space is formed in an inside of the guide duct 70, and this space may form a flow path d connected to the internal exhaust hole 11*b* in an inside of the guide duct 70. In such a guide duct 70, a duct inlet and a duct discharge hole 72 may be provided.

A duct inlet is provided to be able to open the flow path d toward the internal exhaust hole 11*b* at one side in a longitudinal direction of the flow path d. And the duct discharge hole 72 is provided to be able to open the flow path d toward the external exhaust hole 8.

As an example, a duct inlet may be formed in a shape in which one side surface of the guide duct 70 facing a side surface of the cavity 11 is opened. At least a portion of a duct inlet may overlap the internal exhaust hole 11*b* laterally.

And the duct discharge hole 72 may be formed in a shape in which a portion of the other side surface of the guide duct 70 facing a side surface of the cabinet 13 is opened. The duct discharge hole 72 may be disposed at a position biased frontward from a front-rear directional center of the guide duct 70. At least a portion of such a duct discharge hole 72 may overlap the external exhaust hole 8 laterally.

The cooking appliance of the present embodiment may further include a humidity sensor 7. The humidity sensor 7 is installed on the guide duct 70, and is provided to be able to measure humidity in the flow path d.

The humidity sensor 7 is provided to be able to measure humidity of air introduced to the flow path d through the internal exhaust hole 11*b* from the cooking chamber 10*a*. In order for humidity of air introduced to the flow path d to be effectively measured by the humidity sensor 7, a flow path d of sufficient length is necessary.

To this end, the internal exhaust hole 11*b* is disposed at a position biased rearward among the side space 10*e*, and the duct discharge hole 72 is disposed at a position biased frontward among the side space 10*e*, and the guide duct 70 may be formed with a sufficient length to include them.

The guide duct 70 of the present embodiment may be disposed between a side surface of the cavity 11 and a side surface of the cabinet 13 with respect to a lateral direction. Such a guide duct 70 may include a width change section 71.

The width change section 71 is a section in which a width of the guide duct 70 is changed along a longitudinal direction of the flow path d. For example, the width change section 71 may be a section in which a width of the guide duct 70 is changed along a front-rear direction.

In the width change section 71, a width of the guide duct 70 is expanded toward a direction facing one side in a longitudinal direction of the flow path d, for example, toward a frontward direction, and accordingly, the other side surface of the guide duct 70 where the duct discharge hole 72 is disposed gradually gets closer to the cabinet 13 toward a frontward direction.

As a result, the duct discharge hole 72 disposed at a position biased frontward from a front-rear directional center of the guide duct 70 is disposed at a position closer to the cabinet 13 than the cavity 11, and can be disposed at a position very adjacent to the external exhaust hole 8.

Accordingly, a connection between the flow path d and the external exhaust hole 8 is made very closely, and an air discharge guidance from the flow path d through the duct discharge hole 72 to the external exhaust hole 8 can be made very effectively.

Figure 32:
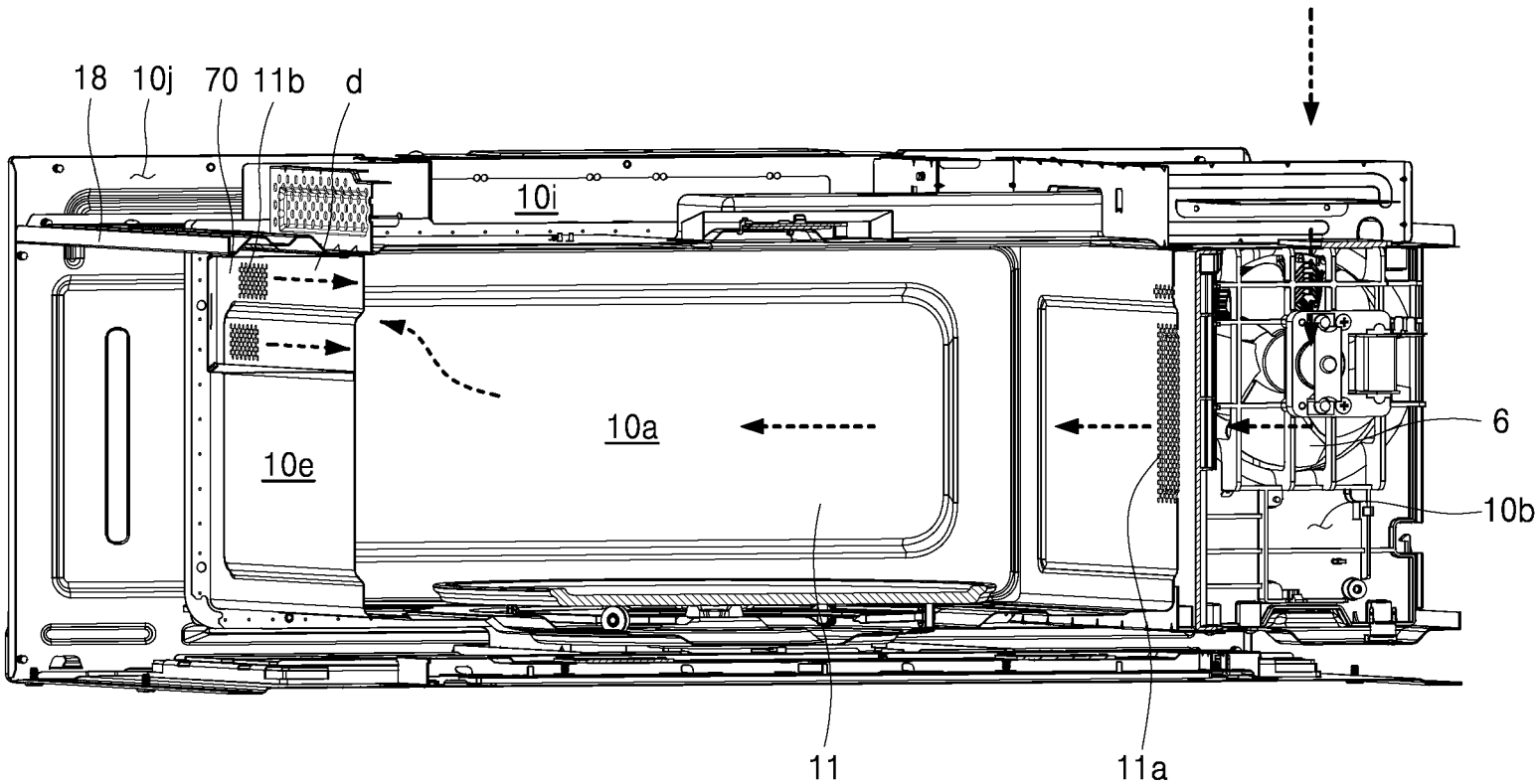
FIGS. 32 and 33 are views illustrating an air flow state through a side space.
Figure 33:
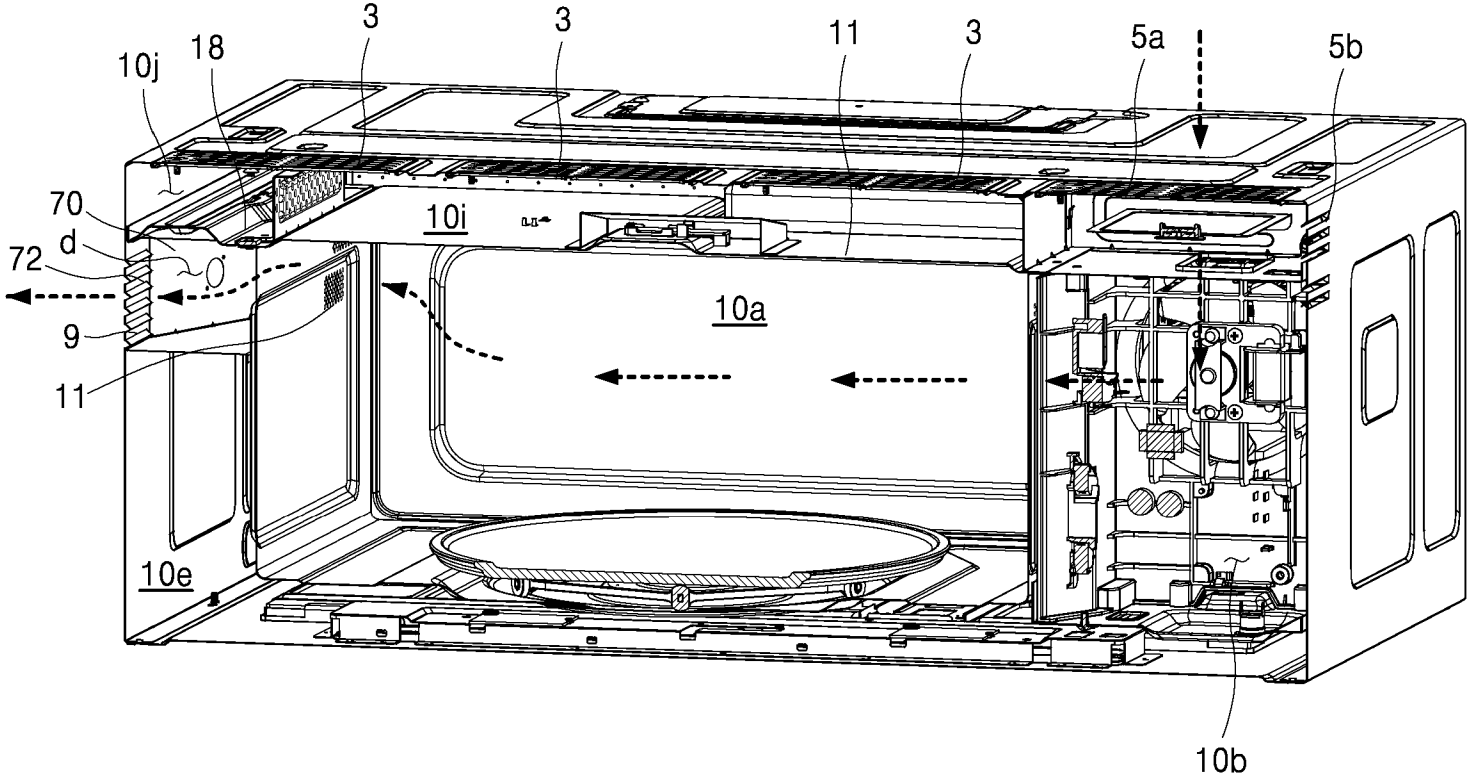
Figure 34:
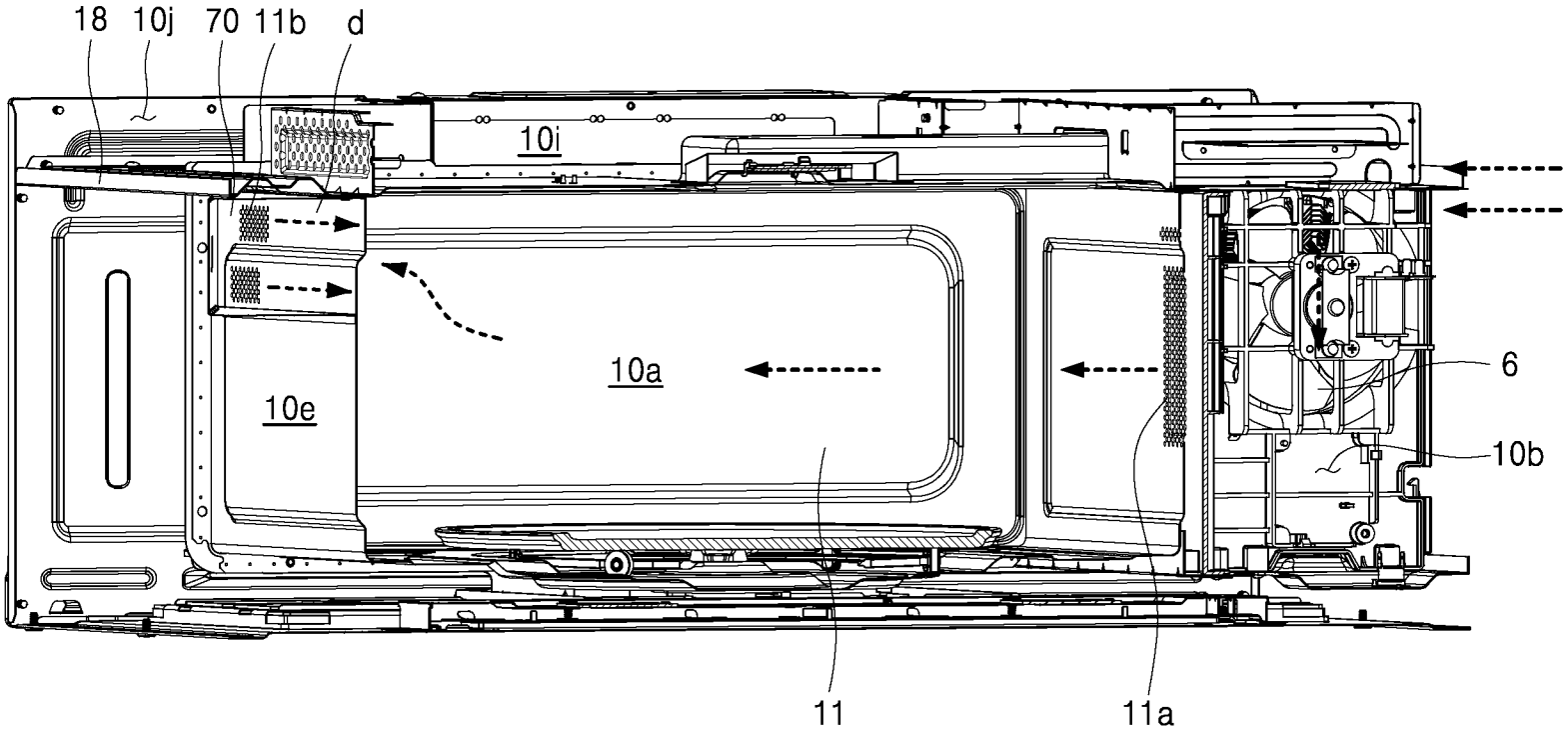
FIGS. 34 and 35 are views illustrating another example of an air flow state through the side space.
Figure 35:
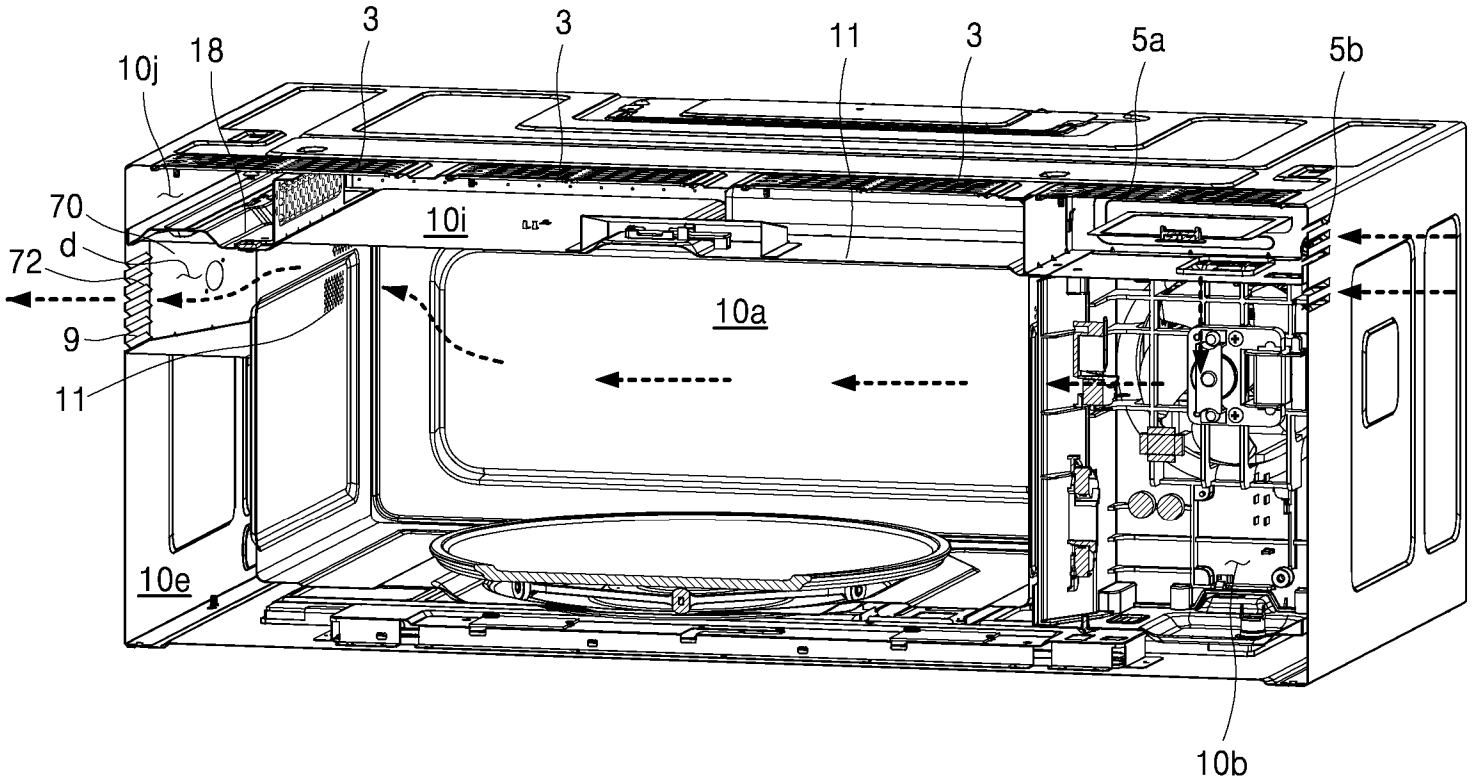

Also, FIGS. 32 and 33 are views illustrating an air flow state through the side space, and FIGS. 34 and 35 are views illustrating another example of an air flow state through the side space.

Hereinafter, an exhaust flow of an in-chamber discharge air in a cooking appliance according to the present embodiment will be described with reference to FIGS. 32 to 35.

As illustrated in FIGS. 32 and 33, when a cold air inlet is provided in a shape including only the upper inlet 5*a*, or when the side inlet 5*b* is closed and only the upper inlet 5*a* is opened, external air may flow into an inside of a cooking appliance through the upper inlet 5*a*. Air having passed through a cold air inlet in this way may flow into the lower electronic/electrical component chamber 10*b*.

In the lower electronic/electrical component chamber 10*b*, air may flow rearward by the cooling fan 6. Air flowing rearward in the lower electronic/electrical component chamber 10*b* in this way can cool electronic/electrical components disposed in the lower electronic/electrical component chamber 10*b*.

Some of air flowing in the lower electronic/electrical component chamber 10*b* may pass through the cavity 11 through the internal inlet hole 11*a* and flow into the cooking chamber 10*a*. Air flowing into the cooking chamber 10*a* may be discharged to an exterior of the cooking chamber 10*a*, that is, to the side space 10*e* through the internal exhaust hole 11*b* together with steam, gas, etc. generated in the cooking chamber 10*a* in a cooking process of a cooking appliance.

Air discharged to an exterior of the cooking chamber 10*a* in this way, that is, an "in-chamber discharge air", flows into an inside of the guide duct 70, and may flow toward the external exhaust hole 8 along a flow path d formed in an inside of the guide duct 70. For example, an in-chamber discharge air introduced to an inside of the guide duct 70 may flow frontward along a flow path d extending in a front-rear direction.

An in-chamber discharge air flowing along a flow path d in this way may be discharged to an exterior of a cooking appliance through the external exhaust hole 8. That is, the external exhaust hole 8 can be an outlet used for air discharged from the cooking chamber 10*a* to be discharged to an exterior of a cooking appliance, and air having passed through the external exhaust hole 8 may be discharged to an exterior of a cooking appliance through a side surface of a cooking appliance.

When the upper inlet 5*a* functions as a cold air inlet as described above, an air flow of a shape in which external air introduced through an upper portion of a cooking appliance passes through an electronic/electrical component chamber and the cooking chamber 10*a* and is then discharged through a side portion of a cooking appliance is made in a cooking appliance.

According to the present embodiment, a hood discharge air is discharged through an upper portion of a cooking appliance, whereas an in-chamber discharge air is discharged through a side portion of a cooking appliance. That is, a flow path of a hood discharge air and a flow path of an in-chamber discharge air formed in an inside of a cooking appliance are physically isolated from each other, and accordingly, each discharge air is independently discharged at a different point.

By separately discharging a hood discharge air and an in-chamber discharge air through independent flow paths in this way, a back pressure at a confluence point and an airflow bottleneck phenomenon, which inevitably occurred in a conventional single exhaust structure, can be effectively prevented. As a result, the cooking appliance of the present embodiment can make suction performance of a hood system and ventilation efficiency of a cooking chamber exhibit their respective design maximums without interference.

Also, by dualizing a discharge point of a discharge air into a top end and a side surface of a product, a phenomenon in which a high-temperature and high-humidity airflow intensively stagnates in a cabinet or a kitchen ceiling in an upper portion of a product can be prevented. Such an exhaust distribution structure provides an effect of preventing damage due to discoloration of furniture, deformation by heat, and moisture penetration, which are concerned upon long-term use.

Meanwhile, as illustrated in FIGS. 34 and 35, when a cold air inlet is provided in a shape including only the side inlet 5*b*, or when the upper inlet 5*a* is closed and only the side inlet 5*b* is opened, external air may flow into an inside of a cooking appliance through the side inlet 5*b*.

According to this, an air flow path of a shape continuing from the side inlet 5*b* through an electronic/electrical component chamber, the cooking chamber 10*a*, and the side space 10*e* to the external exhaust hole 8 is formed. In particular, such an air flow path has a substantially straight flow path structure continuing in a lateral direction, thereby being capable of lowering a flow path resistance caused by bending of an air flow.

A lateral straight flow structure formed in a shape like this rapidly discharges internal heat without stagnation, thereby maximizing cooling efficiency of an electronic/electrical component and being capable of contributing to securing thermal stability of an inside of an appliance.

[Second Example of Exhaust Structure Through Side Space]

Figure 36:
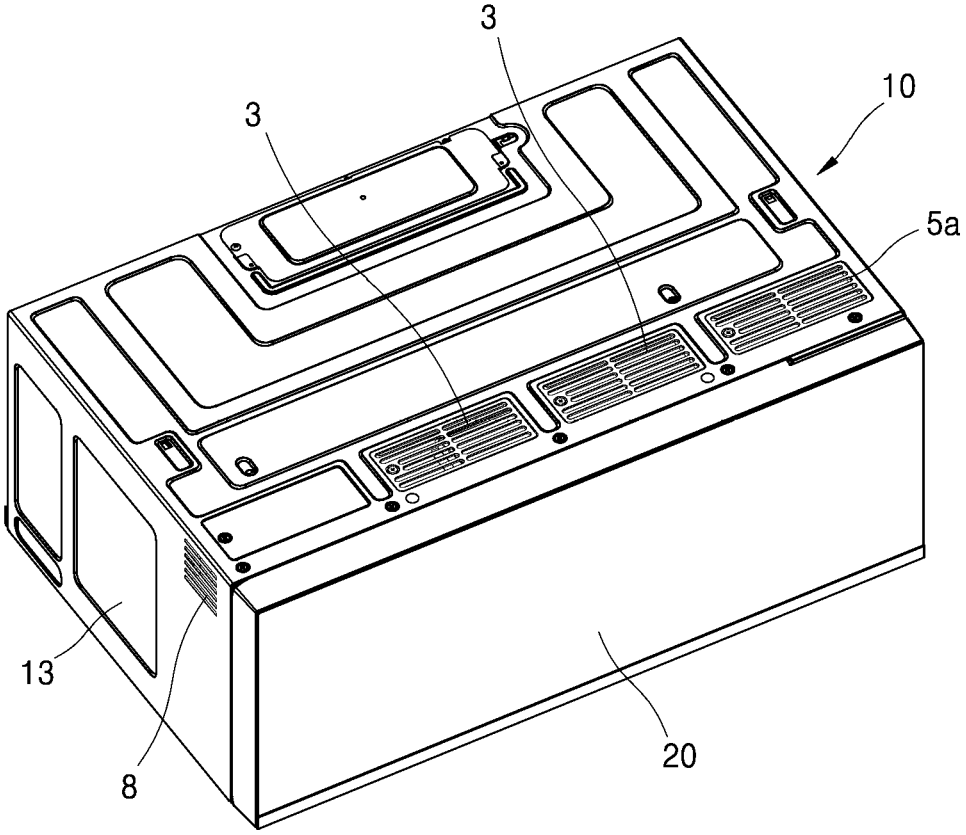
FIG. 36 is a perspective view illustrating a cooking appliance according to a second embodiment of the present disclosure.
Figure 37:
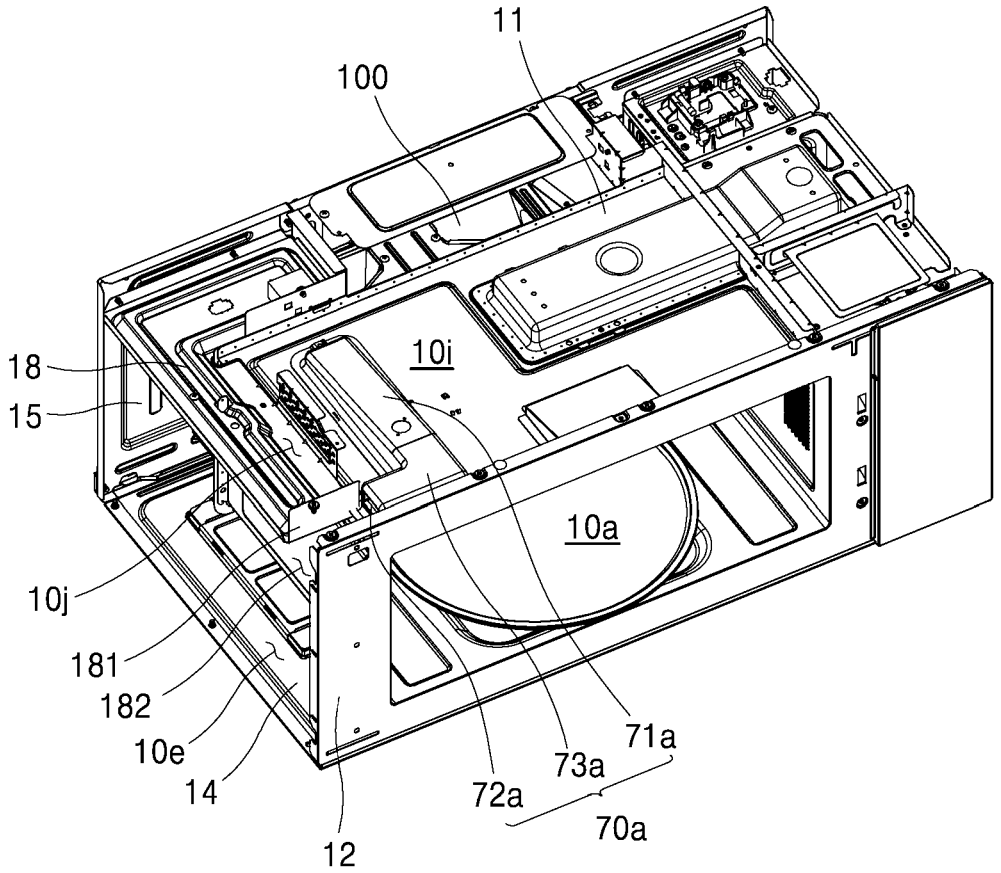
FIG. 37 is a view illustrating a state in which a cabinet is removed from the cooking appliance illustrated in FIG. 36.
Figure 38:
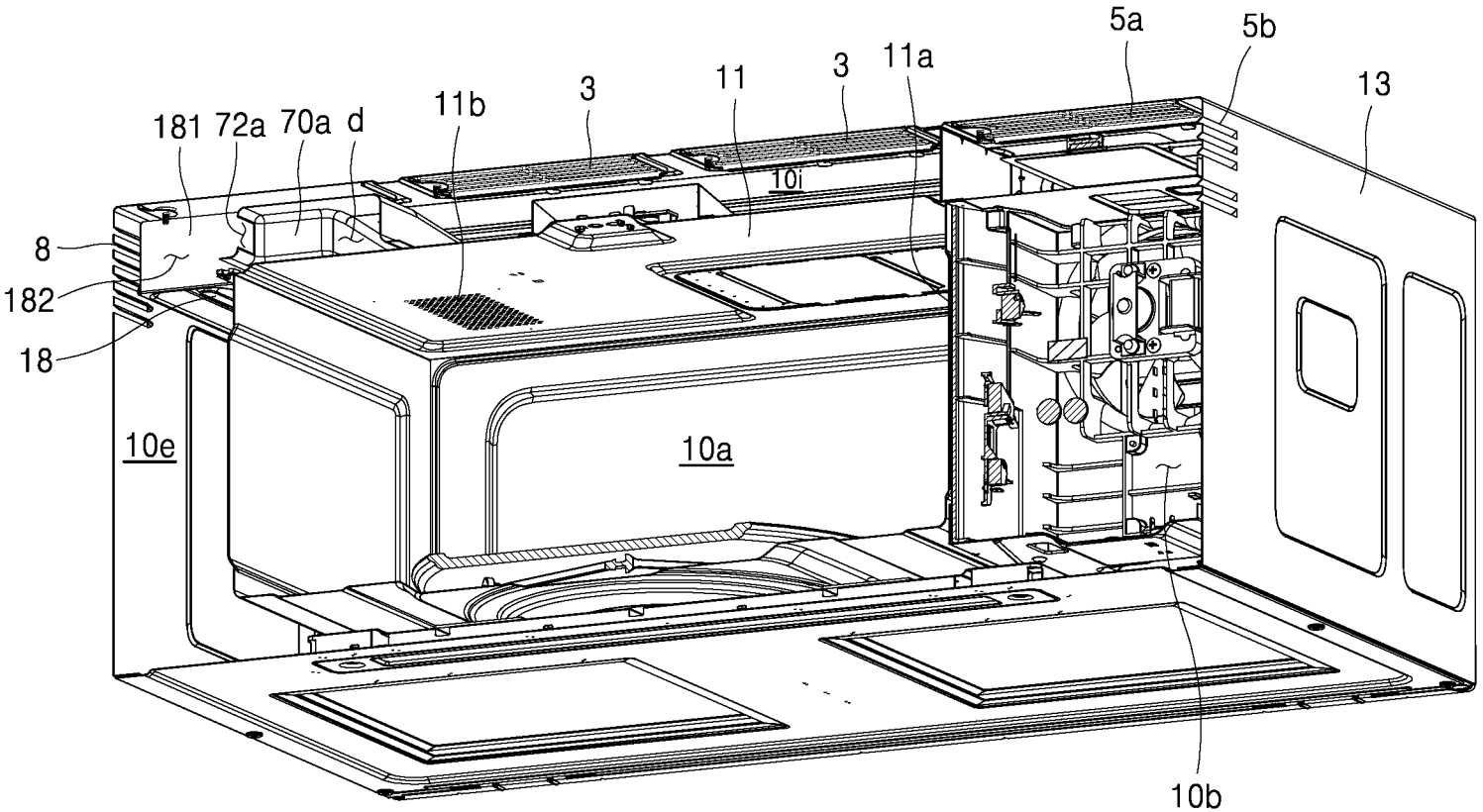
FIGS. 38 and 39 are front cross-sectional views illustrating an internal structure of the cooking appliance illustrated in FIG. 36.
Figure 39:
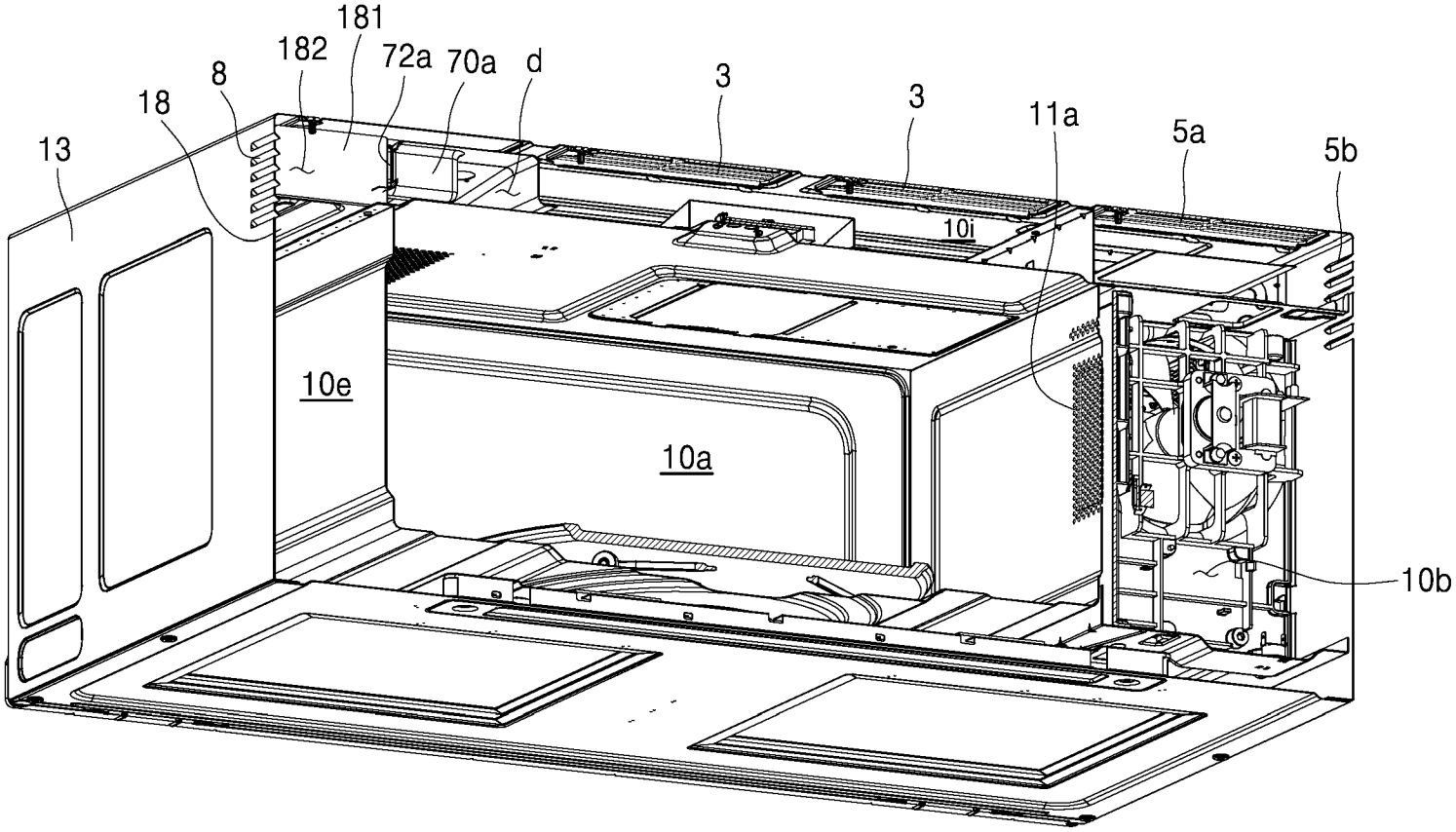
Figure 40:
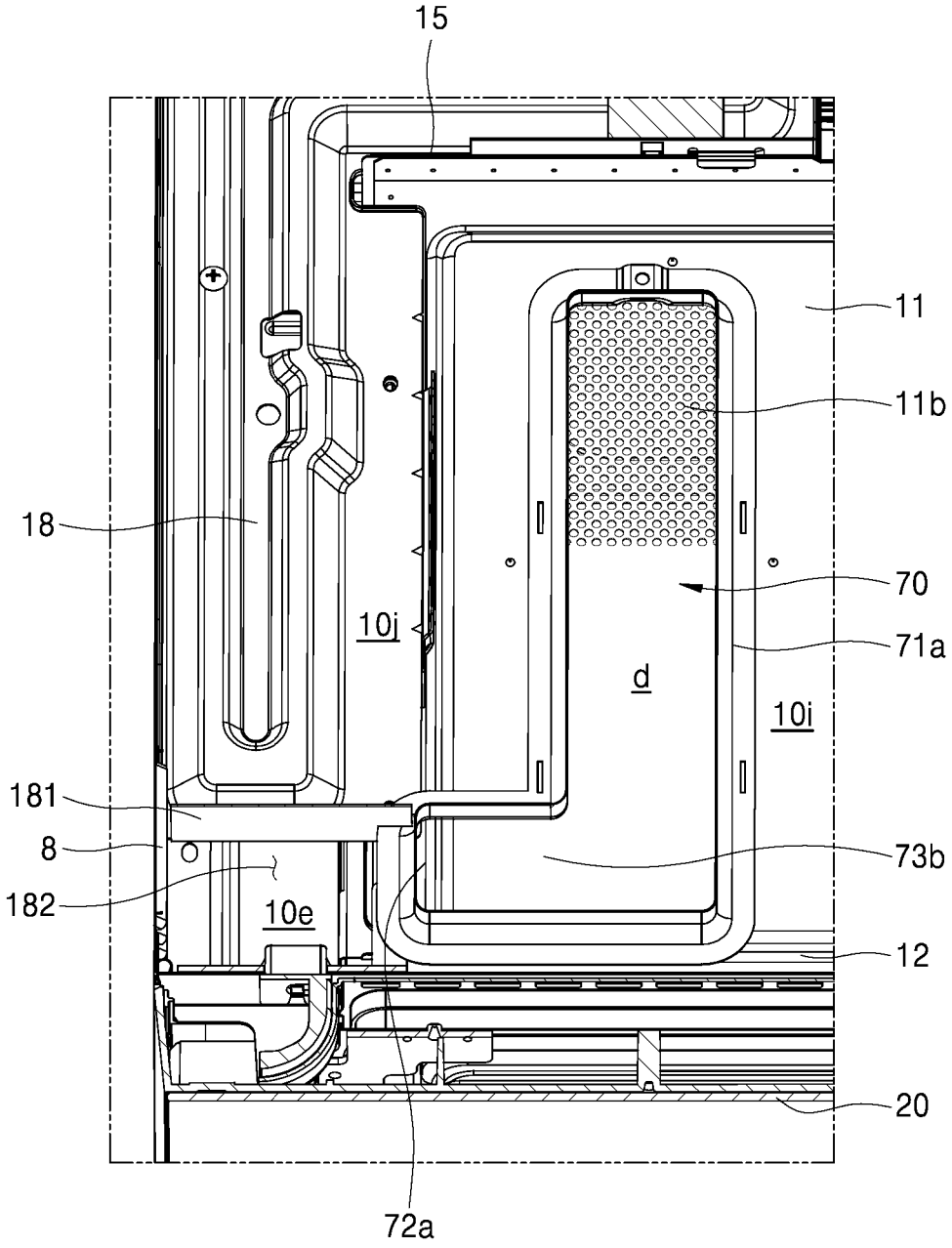
FIG. 40 is a plane cross-sectional view illustrating an internal structure of a guide duct.

FIG. 36 is a perspective view illustrating a cooking appliance according to a second embodiment of the present disclosure, and FIG. 37 is a view illustrating a state in which a cabinet is removed from the cooking appliance illustrated in FIG. 36. Also, FIGS. 38 and 39 are front cross-sectional views illustrating an internal structure of the cooking appliance illustrated in FIG. 36, and FIG. 40 is a plane cross-sectional view illustrating an internal structure of a guide duct.

Referring to FIGS. 36 to 40, in a cooking appliance according to a second embodiment of the present disclosure, an internal exhaust hole 11*b* may be disposed on an upper surface of the cavity 11. According to this, the internal exhaust hole 11*b* is disposed above the cooking chamber 10*a*, and may be formed to pass through an upper surface of the cavity 11 in a vertical direction. Such an internal exhaust hole 11*b* may be configured to form a passage opening the cooking chamber 10*a* to the upper space 10*i* on an upper surface of the cavity 11.

Also, the cooking appliance of the present embodiment includes an extension plate 18, and the extension plate 18 is configured to partition the side space 10*e* such that a partial region of the side space 10*e* is separated into an extended upper space 10*i*. Such an extension plate 18 may form a horizontal wall blocking between the extended upper space 10*i* and the side space 10*e*.

Also, the cooking appliance of the present embodiment may further include a passage portion 182. The passage portion 182 is formed in the extension plate 18 to connect the internal exhaust hole 11*b* and the external exhaust hole 8.

As an example, the passage portion 182 may be formed in a shape in which a portion of the extension plate 18 is penetrated in a vertical direction. Such a passage portion 182 may form a passage connecting the extended upper space 10*i* and the side space 10*e* on the extension plate 18.

The passage portion 182 may be formed at a position adjacent to the external exhaust hole 8. For example, the external exhaust hole 8 and the passage portion 182 are disposed at a position adjacent to an upper surface and a front surface of a cooking appliance, and may be disposed to be connected to each other laterally.

Also, the cooking appliance of the present embodiment may include a guide duct 70*a* provided in the upper space 10*i*. A space is formed in an inside of the guide duct 70*a*, and this space may be configured to form a flow path d therein connected to the internal exhaust hole 11*b*.

According to the present embodiment, the guide duct 70*a* may be configured to form a flow path d in an inside of the main body 10 for guiding a flow of air having flowed to the upper space 10*i* through the internal exhaust hole 11*b* toward the side space 10*e*. In such a guide duct 70*a*, a duct inlet and a duct discharge hole 72*a* may be provided.

A duct inlet is provided to be able to open a flow path toward the internal exhaust hole 11*b* at one side in a longitudinal direction of a flow path. And the duct discharge hole 72*a* is provided to be able to open a flow path d toward at least any one of the passage portion 182 and the external exhaust hole 8.

In the present embodiment, a shape in which the flow path d is opened laterally toward the passage portion 182 by the duct discharge hole 72*a*, and the duct discharge hole 72*a*, the passage portion 182, and the external exhaust hole 8 are connected laterally is exemplified.

The guide duct 70*a* may be formed in a polyhedral shape surrounding the internal exhaust hole 11*b* from an outside. A rear end of such a guide duct 70*a* may be disposed between a rear surface of the cavity 11 and the internal exhaust hole 11*b*. And a front end of the guide duct 70*a* may be disposed between a front-rear directional center of the cavity 11 and a front surface of the cavity 11.

For example, a rear end of the guide duct 70*a* is disposed at a position very adjacent to a rear surface of the cavity 11, and a front end of the guide duct 70*a* may be disposed at a position very adjacent to a front surface of the cavity 11.

As an example, the guide duct 70*a* and the flow path d formed in an inside thereof may be formed in a shape including a first section 71*a* extending in a front-rear direction, and a second section 73*a* extending laterally from a front end of the first section 71*a*. The first section 71*a* is connected to the internal exhaust hole 11*b*, and the second section 73*a* may be disposed between the first section 71*a* and the passage portion 182.

In the first section 71*a*, the internal exhaust hole 11*b* and the flow path d may be connected by a duct inlet. The second section 73*a* is connected to the first section 71*a* at a front side of the first section 71*a*, and may be opened toward the passage portion 182. That is, the duct discharge hole 72*a* is disposed in the second section 73*a*, and may form a passage connecting the flow path d and the passage portion 182.

Meanwhile, the cooking appliance of the present embodiment may further include a guide wall 181. The guide wall 181 protrudes upwardly from the extension plate 18, and may be configured to block between the extended upper space 10*i* and the passage portion 182.

As an example, the guide wall 181 may form a wall surface protruding upwardly from the extension plate 18. The passage portion 182 is disposed on a front side of the extension plate 18, and the guide wall 181 may form a longitudinal wall blocking between the extension plate 18 and the passage portion 182.

With respect to a front-rear direction, the passage portion 182 is disposed between the guide wall 181 and the front plate 12, the guide wall 181 is disposed between the extension plate 18 and the passage portion 182, and the duct discharge hole 72*a* may be disposed between the guide wall 181 and the front plate 12.

That is, the duct discharge hole 72*a* is laterally connected to the passage portion 182, and the guide wall 181 may be disposed at a rear side of the duct discharge hole 72*a* and the passage portion 182. Such a guide wall 181 performs a role of guiding a flow of air discharged from the guide duct 70*a* toward the passage portion 182 and the external exhaust hole 8 connected thereto.

Figure 41:
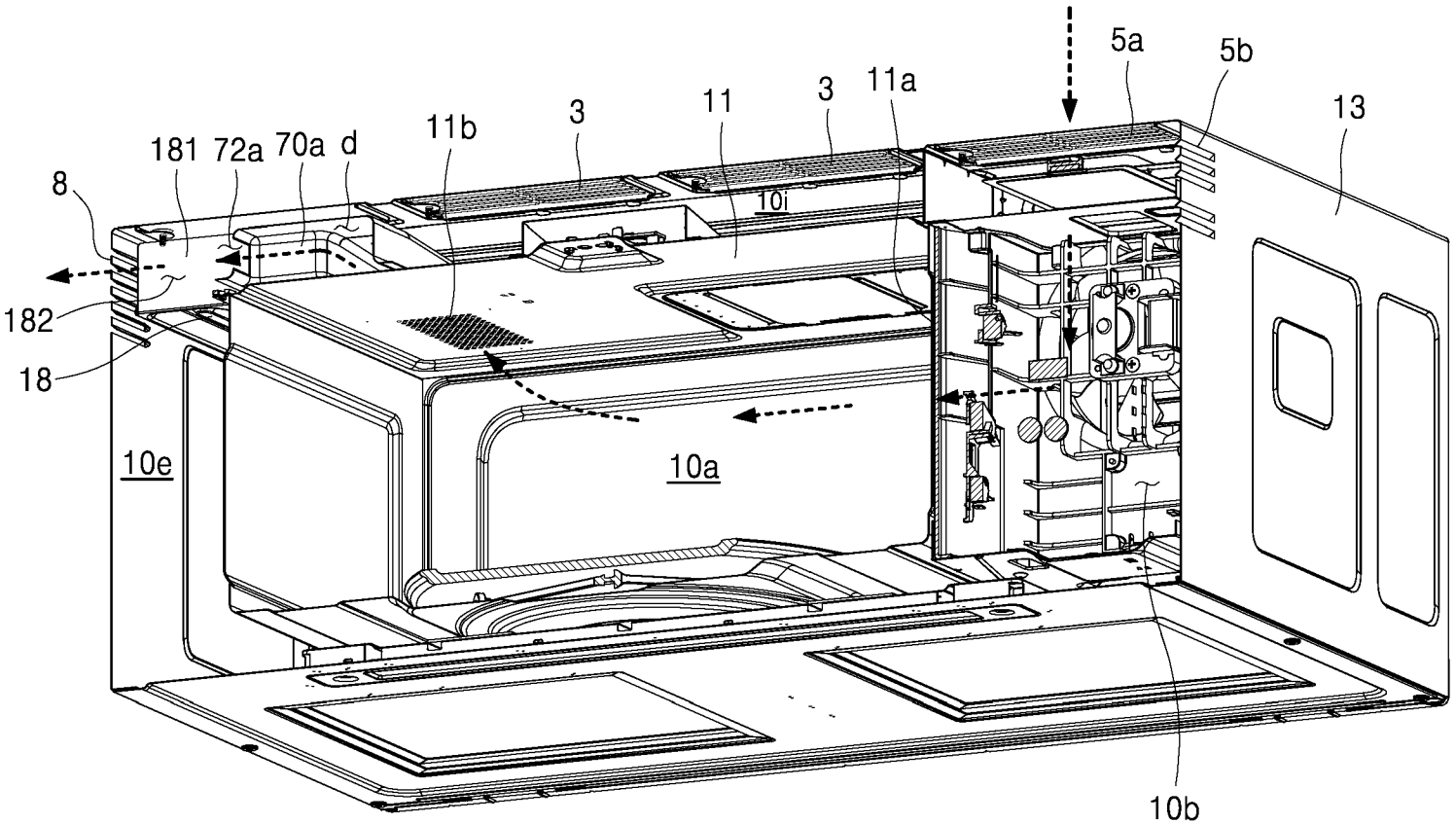
FIGS. 41 and 42 are views illustrating an air flow state through a side space.
Figure 42:
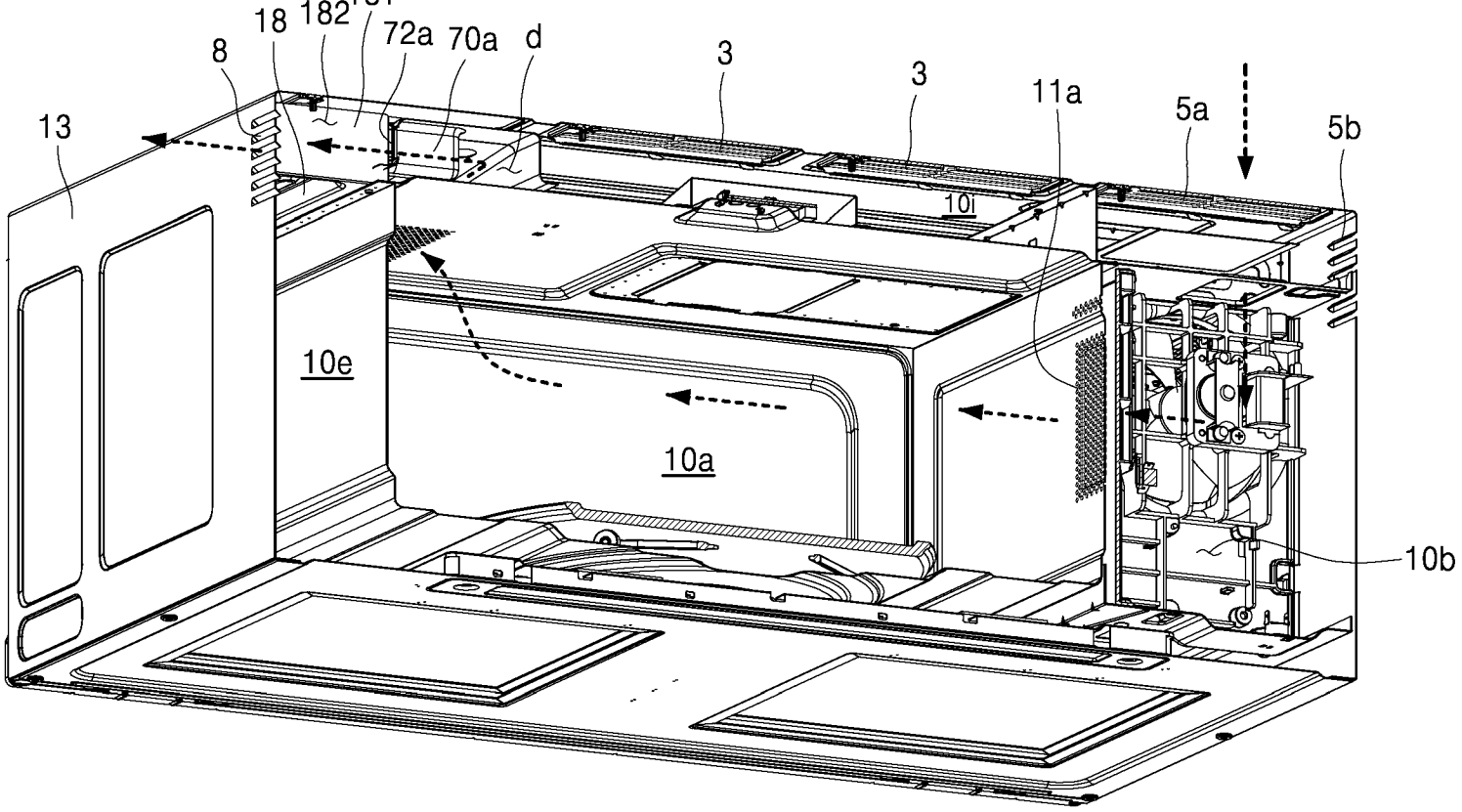
Figure 43:
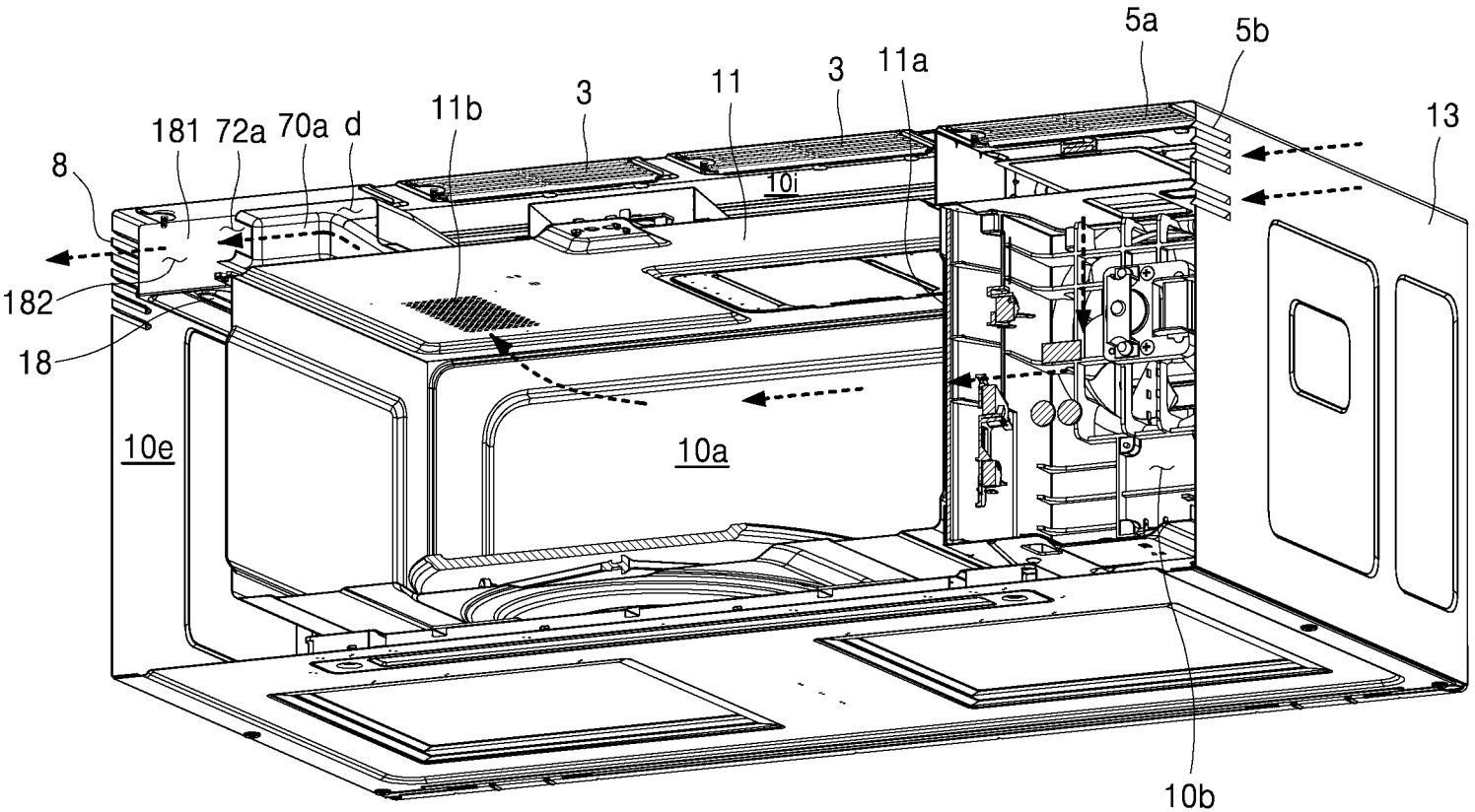
FIGS. 43 and 44 are views illustrating another example of an air flow state through the side space.
Figure 44:
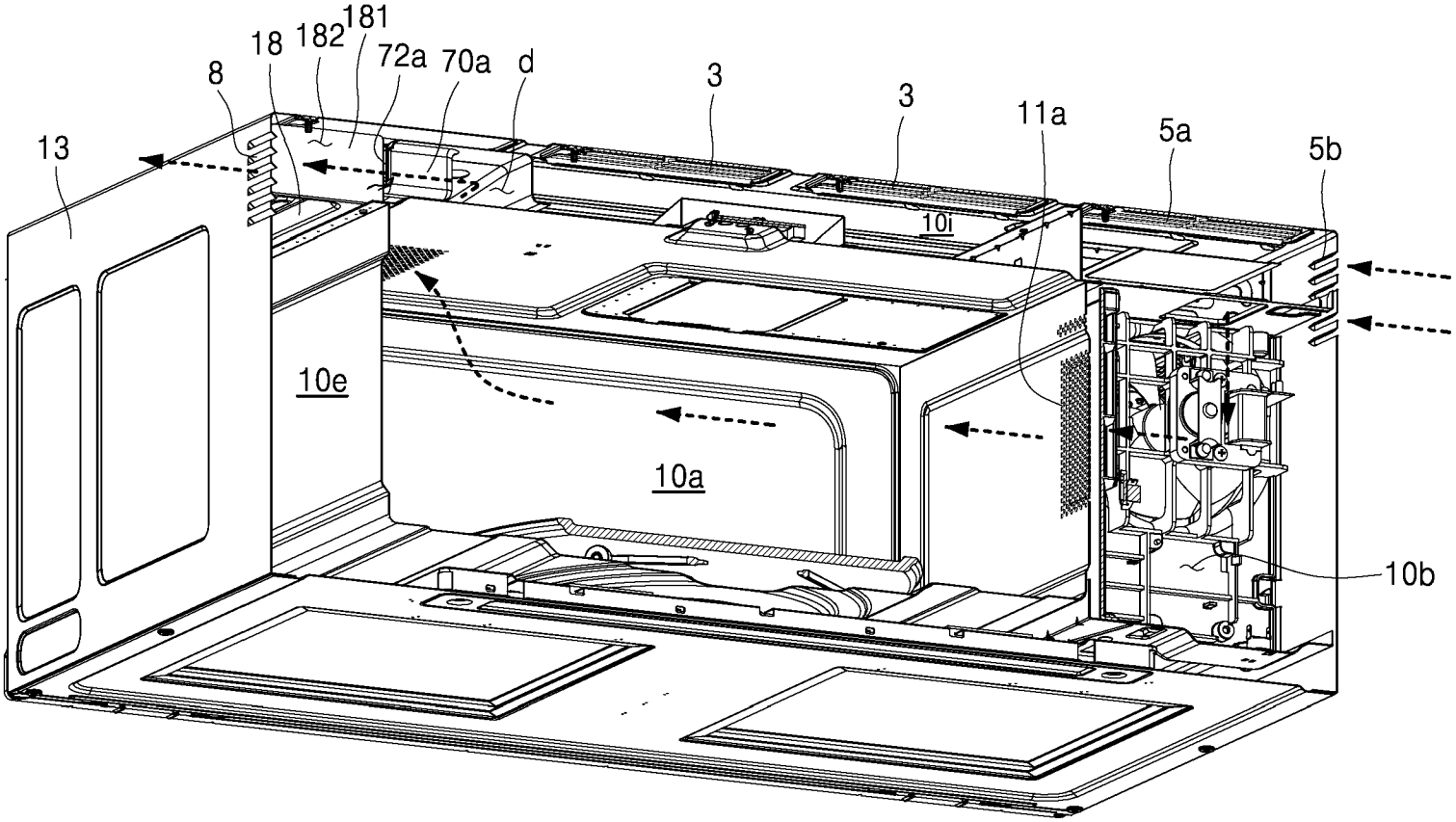

FIGS. 41 and 42 are views illustrating an air flow state through a side space, and FIGS. 43 and 44 are views illustrating another example of an air flow state through the side space.

Hereinafter, an exhaust flow of an in-chamber discharge air in a cooking appliance according to the present embodiment will be described with reference to FIGS. 41 to 44.

External air may flow into an inside of a cooking appliance through an upper inlet 5*a* as illustrated in FIGS. 41 and 42, or may flow into an inside of a cooking appliance through a side inlet 5*b* as illustrated in FIGS. 43 and 44.

Some of air flowing in a lower electronic/electrical component chamber 10*b* may flow into the cooking chamber 10*a* through an internal inlet hole 11*a*, and then be discharged to an exterior of the cooking chamber 10*a*, that is, to the upper space 10*i* through the internal exhaust hole 11*b*.

An in-chamber discharge air discharged to an exterior of the cooking chamber 10*a* in this way flows into an inside of the guide duct 70*a*, and may flow toward the external exhaust hole 8 along a flow path d formed in an inside of the guide duct 70*a*.

For example, an in-chamber discharge air having flowed into an inside of the guide duct 70*a* may flow frontward along a flow path d extending in a front-rear direction in the first section 71*a*, and then flow laterally along a flow path d extending laterally in the second section 73*a*.

An in-chamber discharge air having flowed along a flow path d in this way may be discharged to an exterior of the guide duct 70*a* through the duct discharge hole 72*a*, and then pass through the side space 10*e* through the passage portion 182, and be discharged to an exterior of a cooking appliance through the external exhaust hole 8.

According to an exhaust structure of a shape as described above, an in-chamber discharge air may be discharged upwardly from the cooking chamber 10*a* through an upper surface of the cavity 11, and then be discharged laterally of a cooking appliance through a side surface of the cabinet 13.

According to this, even when the internal exhaust hole 11*b* is disposed in an upper portion of the cooking chamber 10*a* or on an upper surface of the cavity 11 and a discharge of an in-chamber discharge air is made toward above the cooking chamber 10*a* due to structural characteristics of a cooking appliance, a discharge of an in-chamber discharge air to an exterior of a cooking appliance can be made through a side surface of a cooking appliance or can be made laterally of a cooking appliance.

That is, regardless of a position or an exhaust direction of the internal exhaust hole 11*b*, a hood discharge air and an in-chamber discharge air can be separately discharged through independent flow paths, respectively.

Such an upper-side switched exhaust structure can flexibly bypass an exhaust path while efficiently utilizing a limited space of an upper portion of a cooking chamber, thereby enabling maintaining a compact and slim exterior without increasing an overall height of a cooking appliance.

In addition, even if the internal exhaust hole 11*b* is positioned in an upper portion, a final discharge is made at a side surface of a cooking appliance, thereby mitigating a heat concentration phenomenon in which high-temperature exhaust is concentrated to an upper portion of an appliance, to provide an effect of maximizing thermal stability of a top plate of a product and an adjacent structure.

[Third Example of Exhaust Structure Through Side Space]

Figure 45:
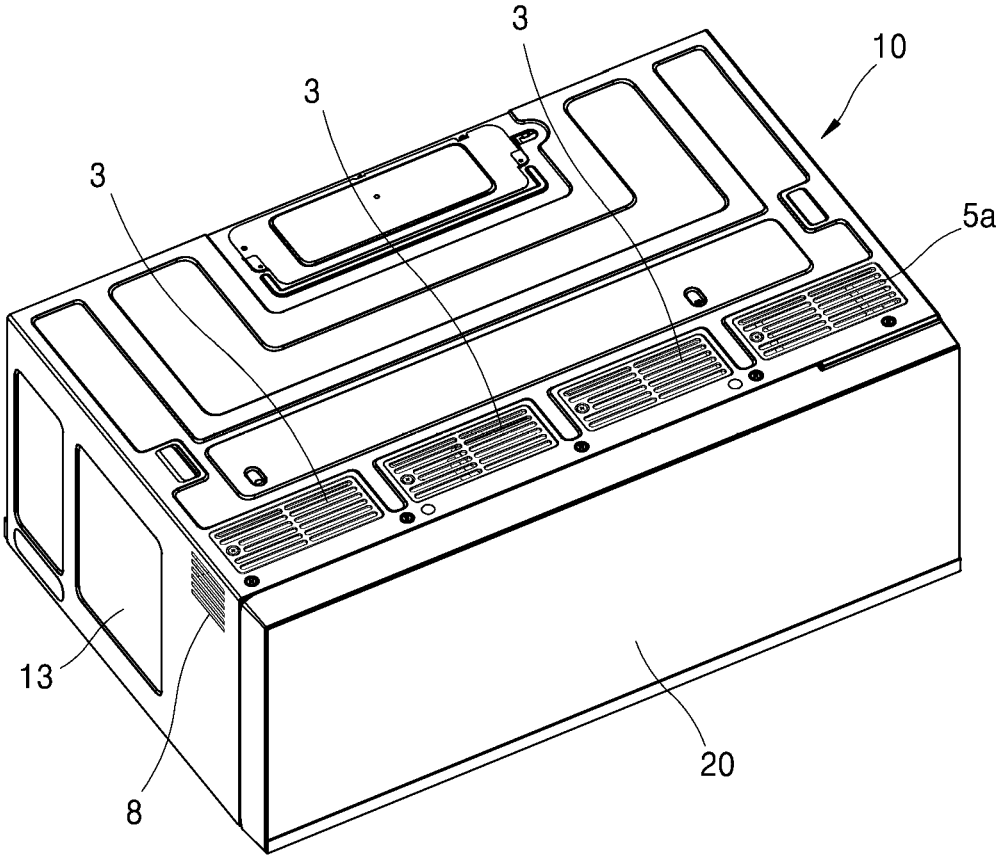
FIG. 45 is a perspective view illustrating a cooking appliance according to a third embodiment of the present disclosure.
Figure 46:
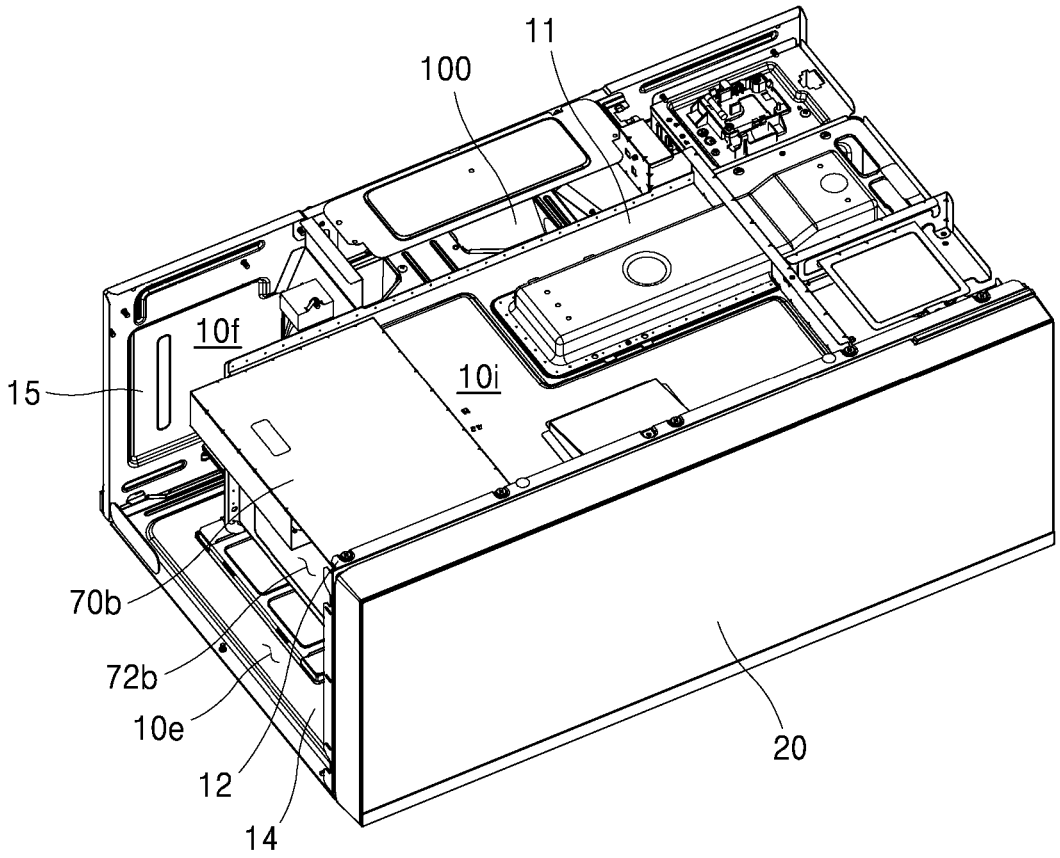
FIG. 46 is a view illustrating a state in which a cabinet is removed from the cooking appliance illustrated in FIG. 45.
Figure 47:
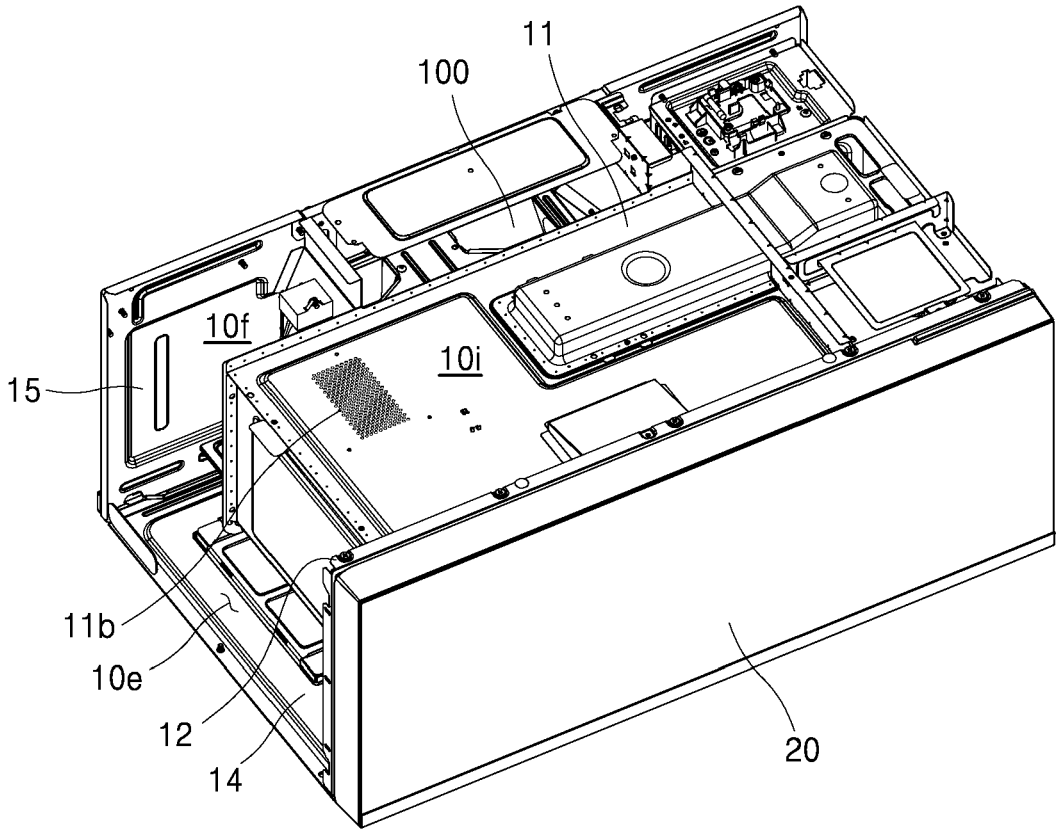
FIG. 47 is a view illustrating a state in which a guide duct is removed from the cooking appliance illustrated in FIG. 46.
Figure 48:
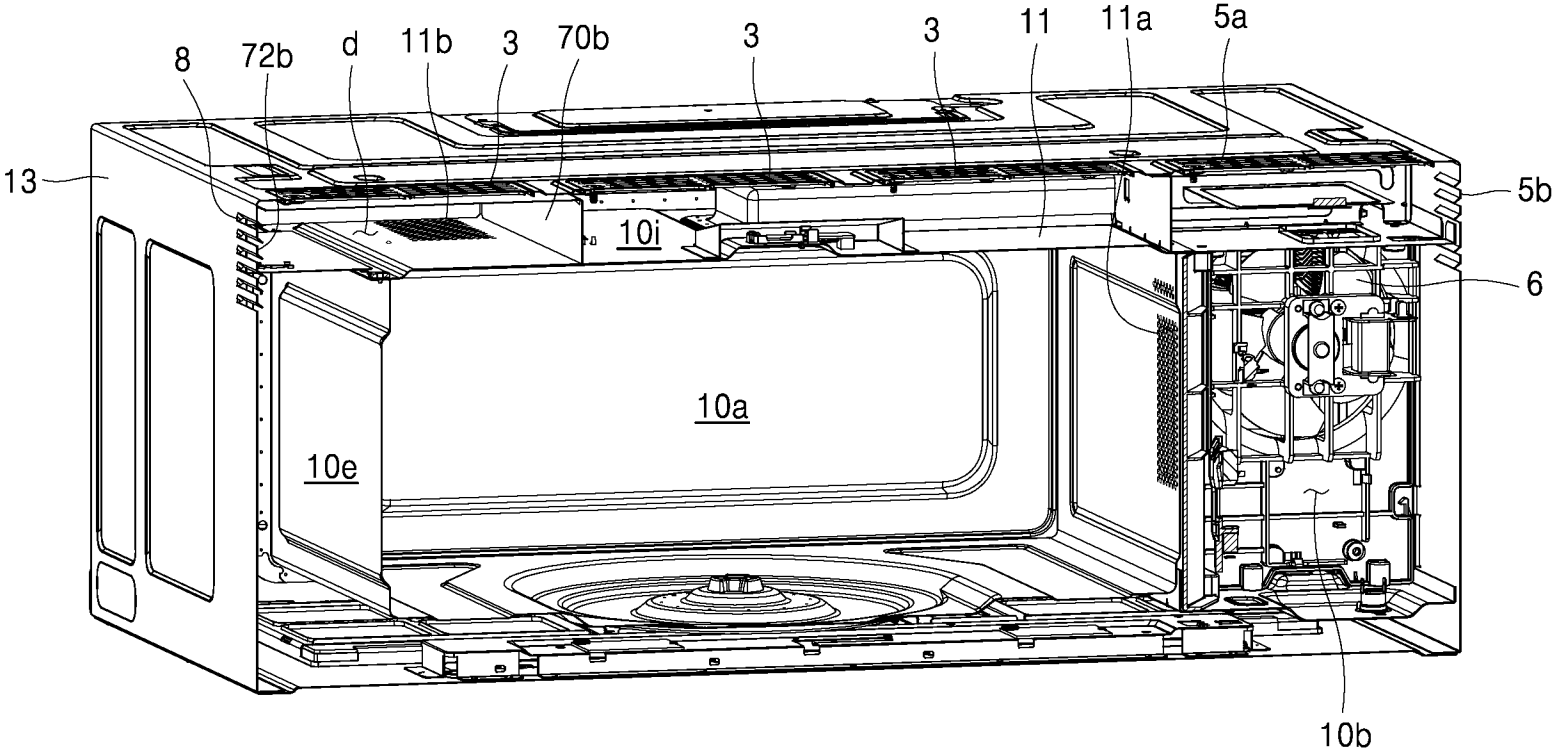
FIGS. 48 and 49 are front cross-sectional views illustrating an internal structure of the cooking appliance illustrated in FIG. 45.
Figure 49:
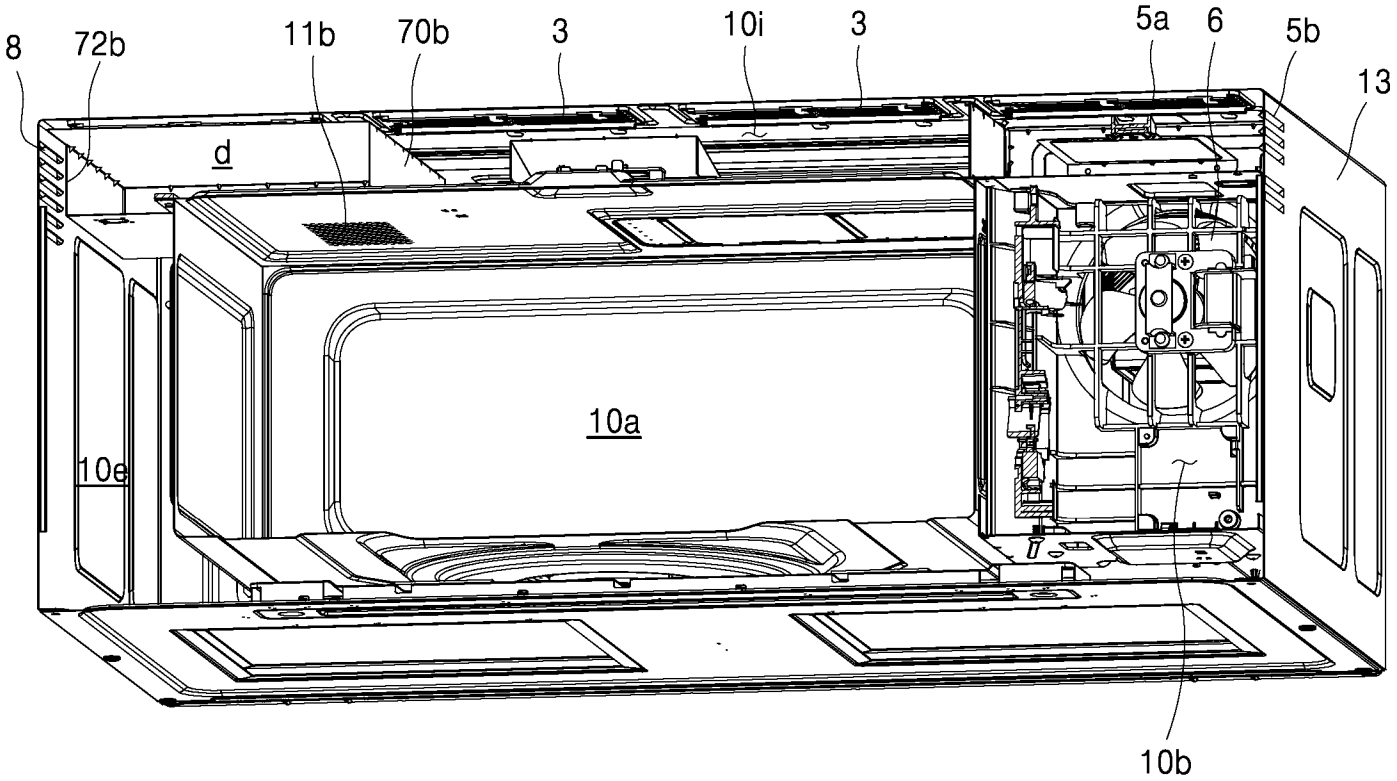

FIG. 45 is a perspective view illustrating a cooking appliance according to a third embodiment of the present disclosure, and FIG. 46 is a view illustrating a state in which a cabinet is removed from the cooking appliance illustrated in FIG. 45. Also, FIG. 47 is a view illustrating a state in which a guide duct is removed from the cooking appliance illustrated in FIG. 46, and FIGS. 48 and 49 are front cross-sectional views illustrating an internal structure of the cooking appliance illustrated in FIG. 45.

Referring to FIGS. 45 to 50, the internal exhaust hole 11*b* of the cooking appliance according to the third embodiment of the present disclosure may be disposed on an upper surface of the cavity 11 similarly as in the above-described embodiments.

Also, the cooking appliance of the present embodiment may further include a guide duct 70*b*. The guide duct 70*b* may be configured to form a flow path d therein connected to the internal exhaust hole 11*b*, and at least a portion of the guide duct 70*b* may be disposed in the upper space 10*i*.

As an example, most regions of the guide duct 70*b* may be disposed in the upper space 10*i*, and the flow path d may form a passage connecting between the internal exhaust hole 11*b* and the external exhaust hole 8 in the upper space 10*i*.

As an example, the guide duct 70*b* may be formed in a polyhedral shape including an upper surface, a front surface, a rear surface, and both side surfaces. The flow path d may be defined as a space surrounded by an upper surface, a rear surface, and both side surfaces of the guide duct 70*b*, and an upper surface of the cavity 11.

In such a guide duct 70*b*, a duct inlet and a duct discharge hole 72*b* may be provided.

A duct inlet is provided to be able to open the flow path d toward the internal exhaust hole 11*b* at one side in a longitudinal direction of the flow path d. And the duct discharge hole 72*b* is provided to be able to open the flow path d toward the external exhaust hole 8.

As an example, a duct inlet may be formed in a shape in which a bottom surface of the guide duct 70*b* facing an upper surface of the cavity 11 is opened. At least a portion of a duct inlet may overlap the internal exhaust hole 11*b* in a vertical direction.

And the duct discharge hole 72*b* may be formed in a shape in which a portion of the other side surface of the guide duct 70*b* facing a side surface of the cabinet 13 is opened. The duct discharge hole 72*e* may be disposed at a position biased frontward from a front-rear directional center of the guide duct 70*b*. At least a portion of such a duct discharge hole 72*e* may overlap the external exhaust hole 8 laterally.

According to the present embodiment, the guide duct 70*b* may be provided as a structure in which an upper surface, a front surface, a rear surface, and both side surfaces, etc. are integrally formed. That is, simply by installing the guide duct 70*b* provided as a single structure in the main body 10, an installation of a structure for guiding a discharge of an in-chamber discharge air can be completed.

Figure 50:
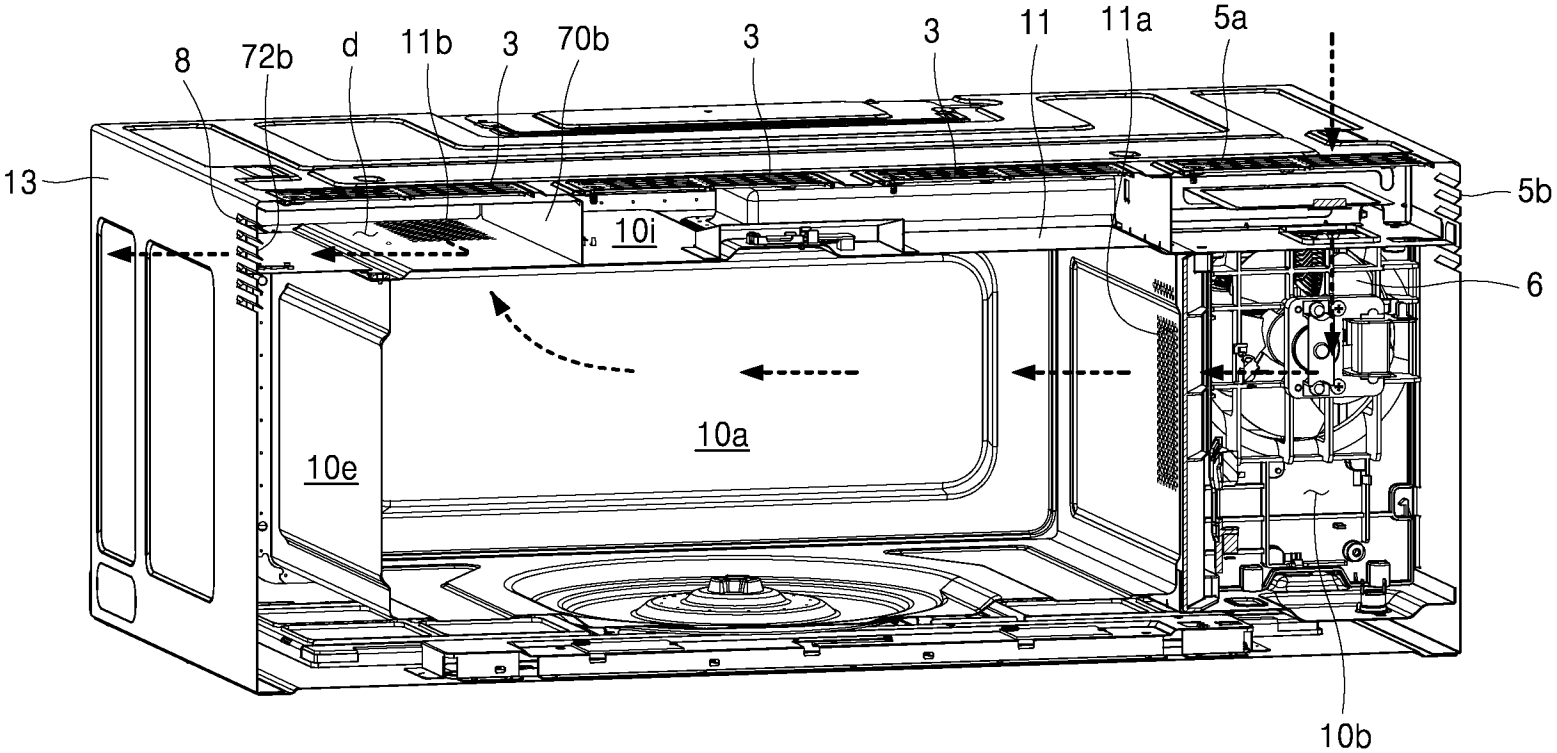
FIGS. 50 and 51 are views illustrating an air flow state through a side space.
Figure 51:
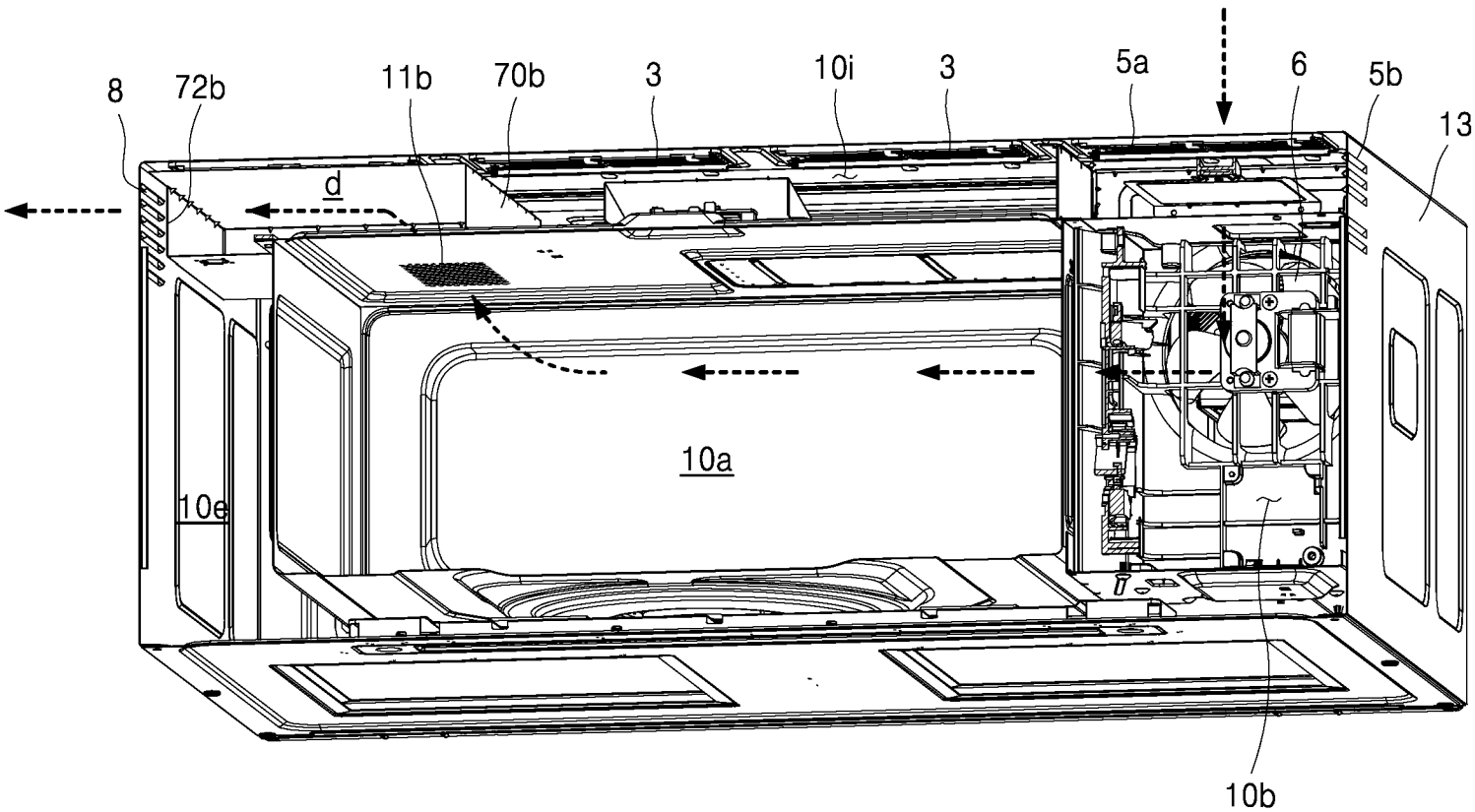
Figure 52:
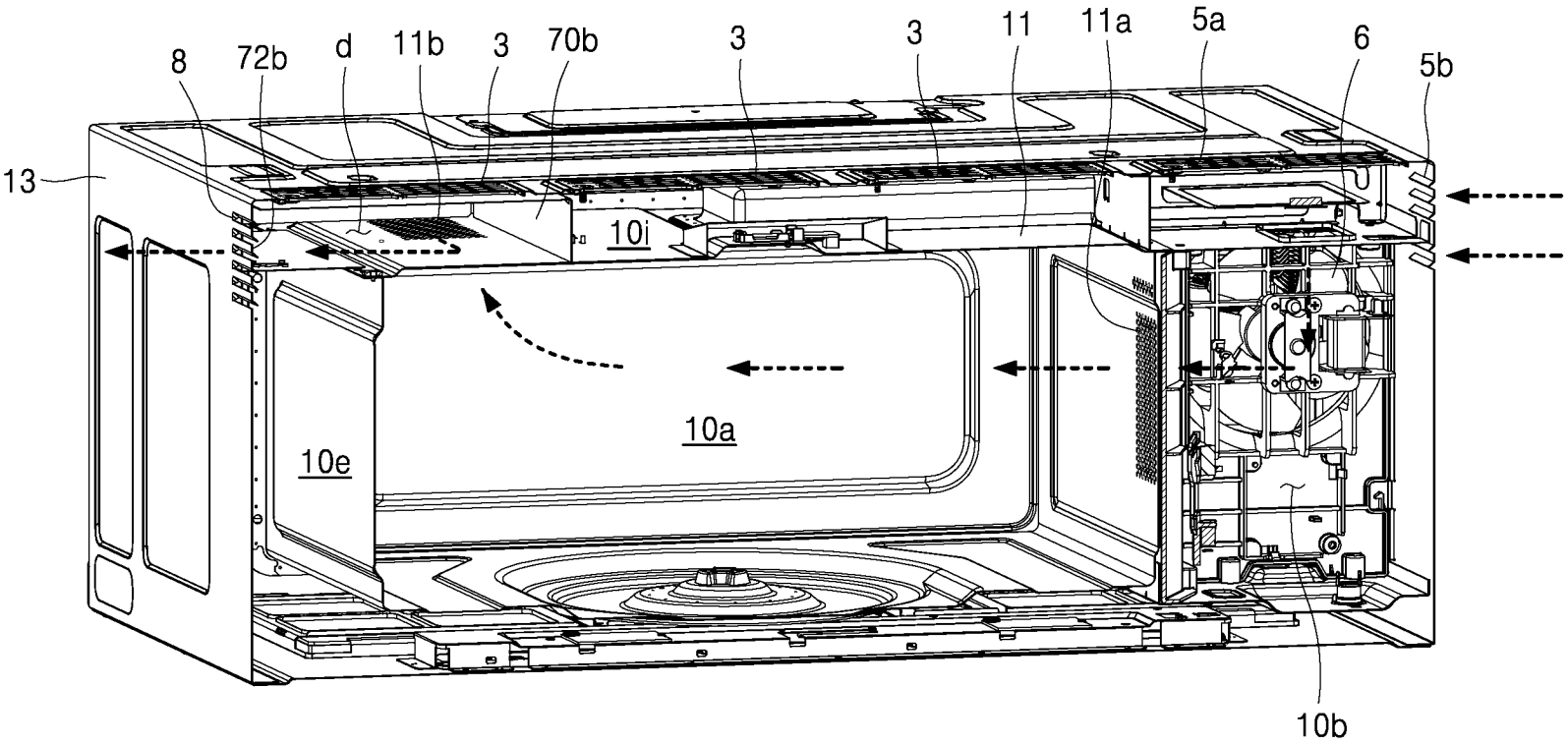
FIGS. 52 and 53 are views illustrating another example of an air flow state through the side space.
Figure 53:
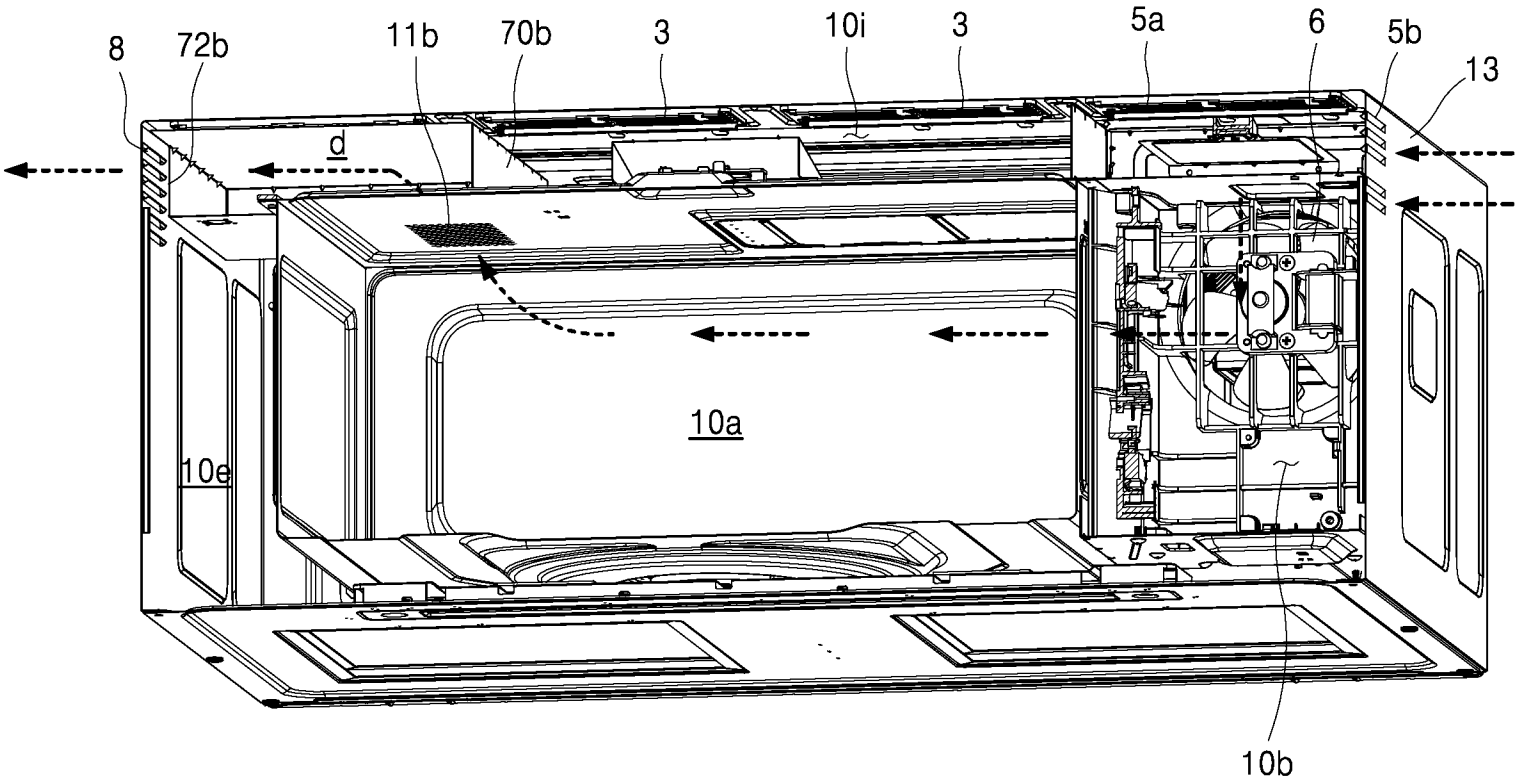

FIGS. 50 and 51 are views illustrating an air flow state through a side space, and FIGS. 52 and 53 are views illustrating another example of an air flow state through the side space.

Hereinafter, an exhaust flow of an in-chamber discharge air in a cooking appliance according to the present embodiment will be described with reference to FIGS. 50 to 53.

External air may flow into an inside of a cooking appliance through an upper inlet 5*a* as illustrated in FIGS. 50 and 51, or may flow into an inside of a cooking appliance through a side inlet 5*b* as illustrated in FIGS. 52 and 53.

Air flowing into the cooking chamber 10*a* through an internal inlet hole 11*a* in a lower electronic/electrical component chamber 10*b* may be discharged to an exterior of the cooking chamber 10*a*, that is, to the upper space 10*i* through the internal exhaust hole 11*b* together with steam, gas, etc. generated in the cooking chamber 10*a* in a cooking process of a cooking appliance.

An in-chamber discharge air discharged to the upper space 10*i* in this way flows into an inside of the guide duct 70*b*, and may flow toward the external exhaust hole 8 along a flow path d formed in an inside of the guide duct 70*b*. For example, an in-chamber discharge air having flowed into an inside of the guide duct 70*b* may flow frontward along a flow path d extending in a front-rear direction, and then be discharged laterally from the guide duct 70*b* through a duct discharge hole 72*b* disposed on a side surface of the guide duct 70*b*.

An in-chamber discharge air discharged laterally from the guide duct 70*b* in this way may be discharged to an exterior of a cooking appliance through the external exhaust hole 8 provided on a side surface of a cooking appliance.

According to this, even when the internal exhaust hole 11*b* is disposed in an upper portion of the cooking chamber 10*a* or on an upper surface of the cavity 11 and a discharge of an in-chamber discharge air is made toward above the cooking chamber 10*a* due to structural characteristics of a cooking appliance, a discharge of an in-chamber discharge air to an exterior of a cooking appliance can be made through a side surface of a cooking appliance or can be made laterally of a cooking appliance.

In particular, the guide duct 70*b* provided as a single structure by integrally forming an upper surface, front and rear, and both side surfaces, can effectively block a leakage of an in-chamber discharge air by fundamentally blocking an occurrence of fine gaps due to assembly tolerances or joints between components.

This provides an advantage of maximizing exhaust efficiency by preventing oil vapor or odors from re-entering into an inside of a cooking appliance to maintain cleanliness inside an appliance and prevent minor breakdowns, and improving straightness of an air flow by eliminating steps on a flow path.

Also, since simply installing the guide duct 70*b* provided as a single structure in the main body 10 completes an installation of a structure for guiding a discharge of an in-chamber discharge air, work man-hours and costs required for manufacturing a cooking appliance can be effectively reduced.

[Fourth Example of Exhaust Structure Through Side Space]

Figure 54:
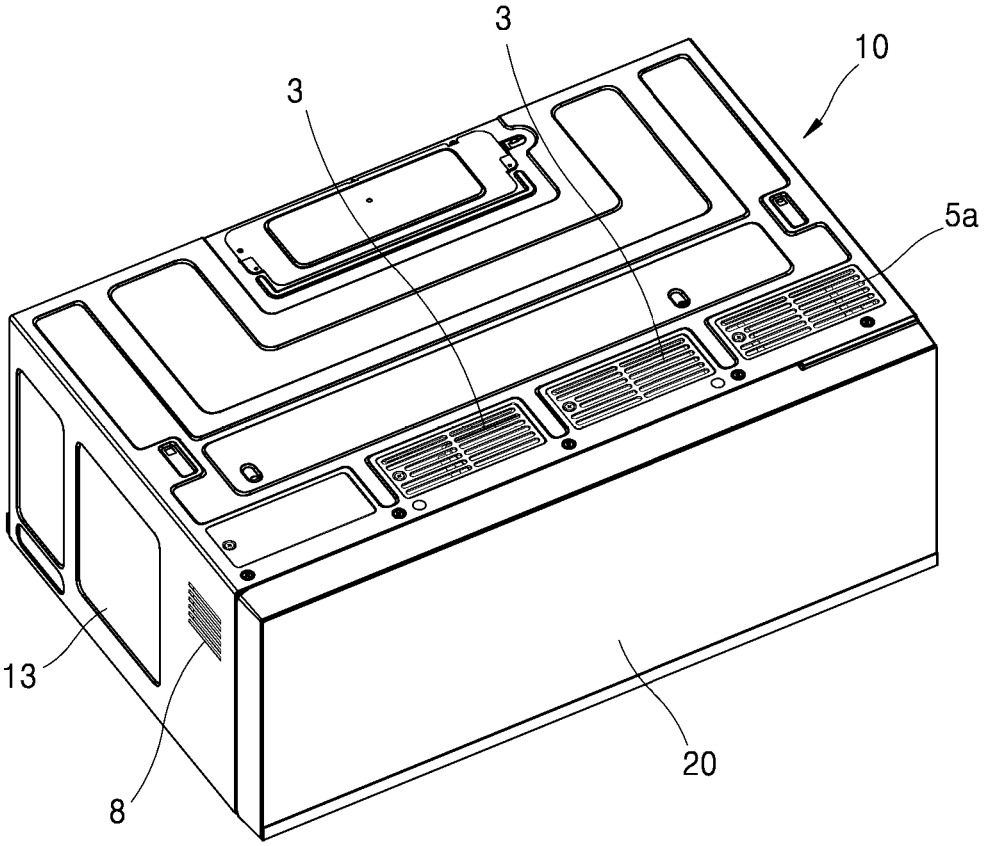
FIG. 54 is a perspective view illustrating a cooking appliance according to a fourth embodiment of the present disclosure.
Figure 55:
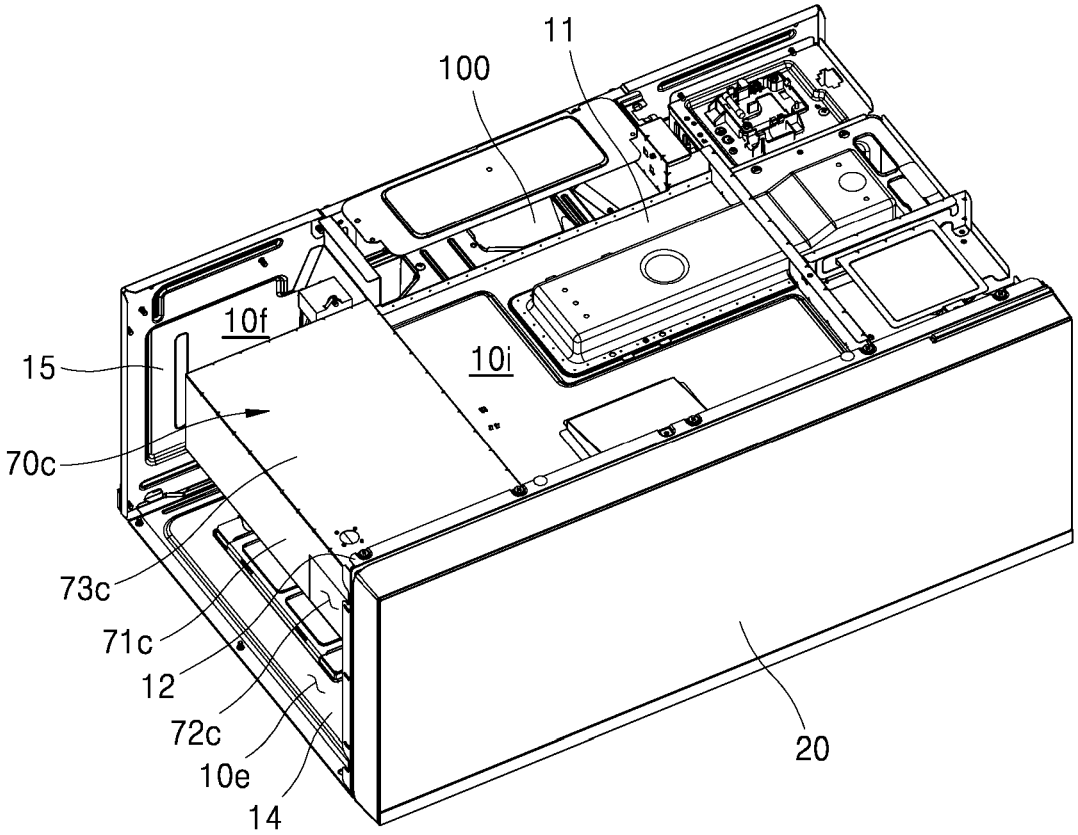
FIG. 55 is a view illustrating a state in which a cabinet is removed from the cooking appliance illustrated in FIG. 54.
Figure 57:
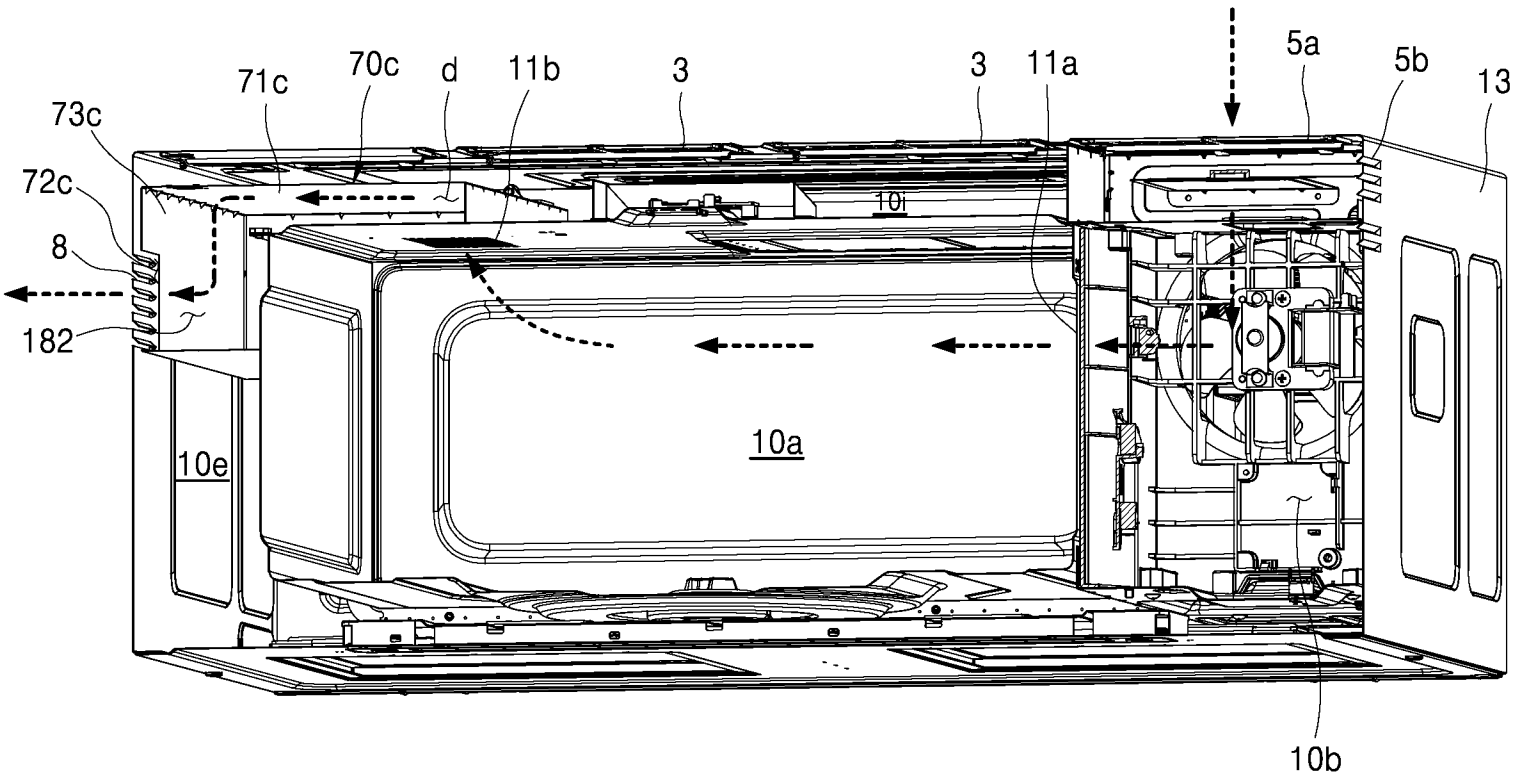
Figure 58:
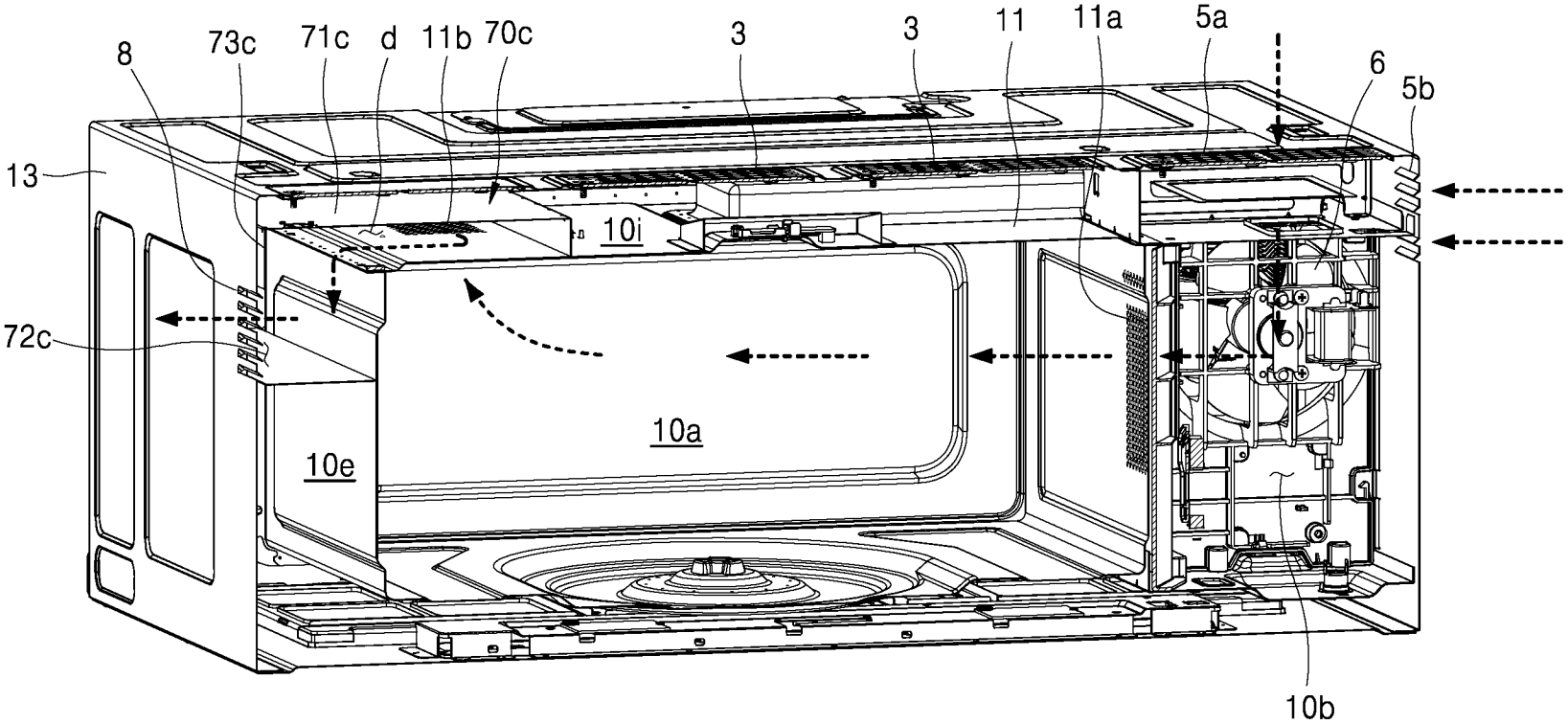
FIGS. 58 and 59 are front cross-sectional views illustrating another example of an air flow state through the side space.
Figure 59:
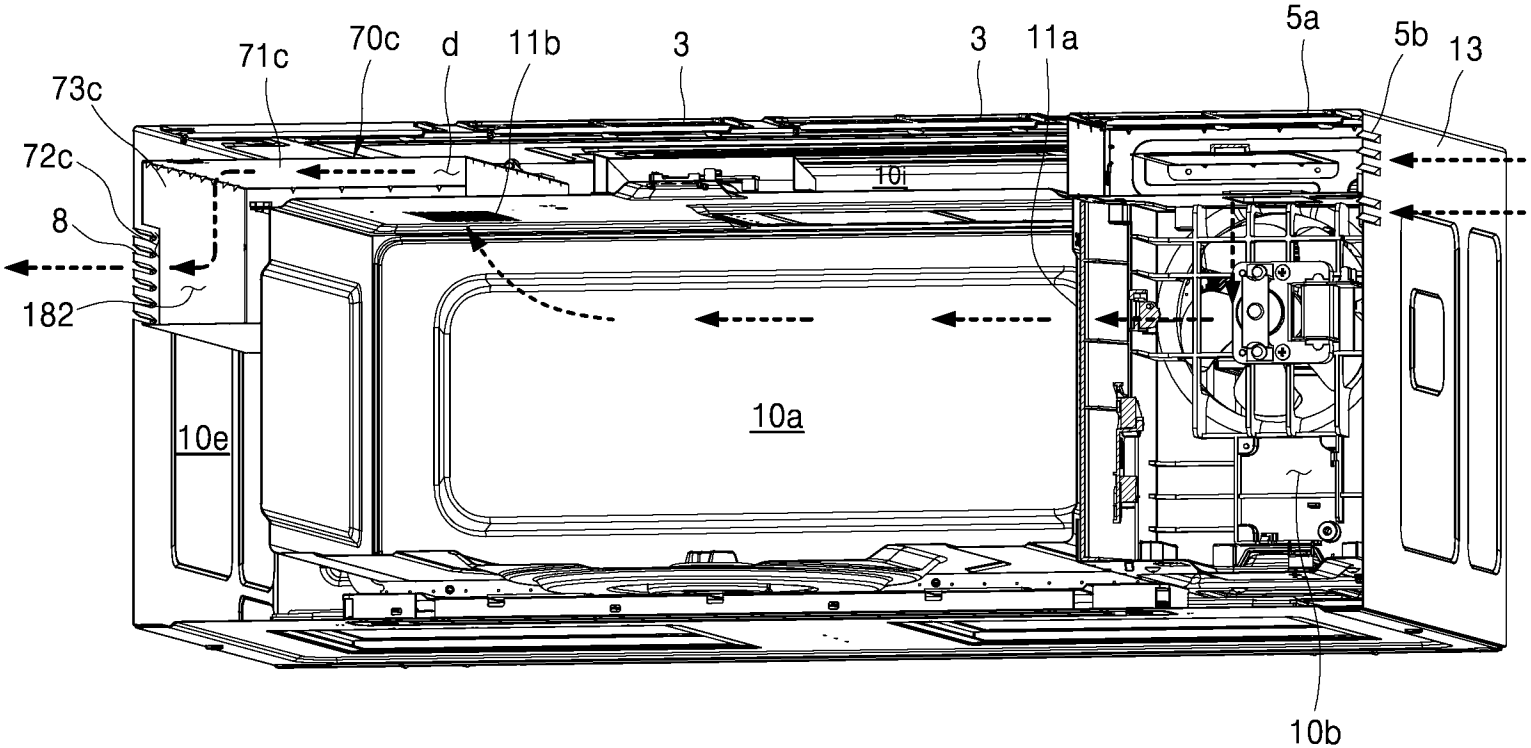

FIG. 54 is a perspective view illustrating a cooking appliance according to a fourth embodiment of the present disclosure, and FIG. 55 is a view illustrating a state in which a cabinet is removed from the cooking appliance illustrated in FIG. 54. Also, FIGS. 56 and 57 are front cross-sectional views illustrating an air flow state through a side space, and FIGS. 58 and 59 are front cross-sectional views illustrating another example of an air flow state through the side space.

Figure 56:
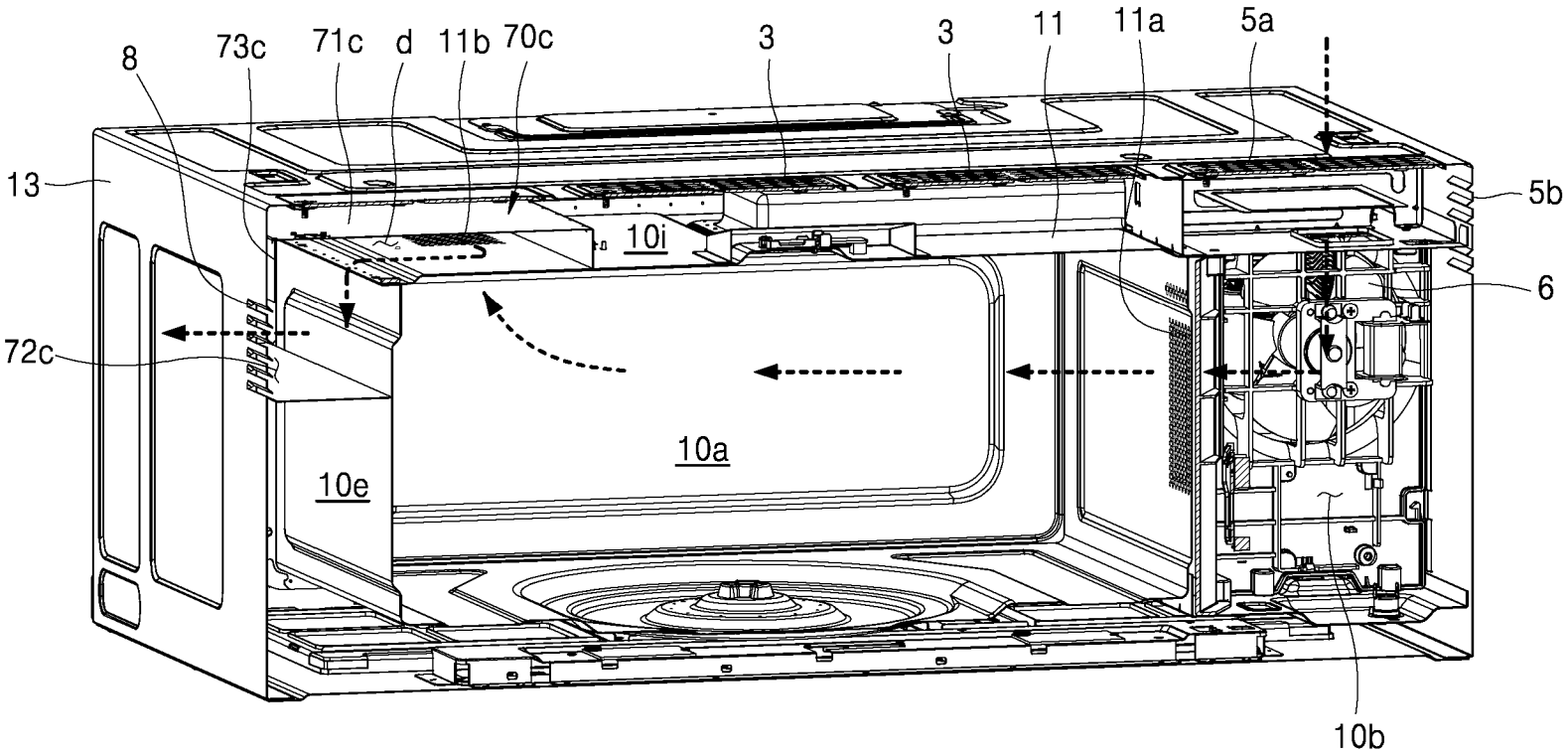
FIGS. 56 and 57 are front cross-sectional views illustrating an air flow state through a side space.

Referring to FIGS. 54 to 56, a main difference between a cooking appliance according to the present embodiment and a cooking appliance exemplified in previous embodiments is in a guide duct 70*c*. In the present embodiment, the guide duct 70*c* is exemplified in a shape including a first duct portion 71*c* and a second duct portion 73*c*.

The first duct portion 71*c* is provided in a shape similar to the guide duct 70*b* (refer to FIG. 46) exemplified in a previous embodiment. The first duct portion 71*c* is disposed in the upper space 10*i*, and may be configured to form a flow path d therein while surrounding the internal exhaust hole 11*b* from above thereof.

The second duct portion 73*c* is disposed below the first duct portion 71*c*, and is connected to the first duct portion 71*c* in a vertical direction. In an inside of the second duct portion 73*c*, a flow path d connected to an inside of the first duct portion 71*c* is formed. As an example, the second duct portion 73*c* may be disposed in the side space 10*e*.

In the guide duct 70*c* of the present embodiment, a duct discharge hole 72*c* may be disposed in the second duct portion 73*c*. Such a duct discharge hole 72*c* is provided to be able to open a flow path d inside the second duct portion 73*c* toward the external exhaust hole 8.

As an example, the duct discharge hole 72*c* may be formed to pass through laterally on a side surface of the second duct portion 73*c* facing laterally with respect to the external exhaust hole 8. At least a portion of such a duct discharge hole 72*c* may overlap the external exhaust hole 8 laterally.

Hereinafter, an exhaust flow of an in-chamber discharge air in a cooking appliance according to the present embodiment will be described with reference to FIGS. 56 to 59.

External air may flow into an inside of a cooking appliance through an upper inlet 5*a* as illustrated in FIGS. 56 and 57, or may flow into an inside of a cooking appliance through a side inlet 5*b* as illustrated in FIGS. 58 and 59.

Air having flowed into the cooking chamber 10*a* in an inside of a cooking appliance may be discharged to the upper space 10*i* through the internal exhaust hole 11*b* together with steam, gas, etc. generated in the cooking chamber 10*a* in a cooking process of a cooking appliance. An in-chamber discharge air discharged in this way flows into an inside of the first duct portion 71*c*.

Such an in-chamber discharge air spreads into an inside of the first duct portion 71*c* and an inside of the second duct portion 73*c* and flows frontward, and then may be discharged laterally from the guide duct 70*c* through a duct discharge hole 72*c* disposed on a side surface of the second duct portion 73*c*.

An in-chamber discharge air discharged laterally from the guide duct 70*c* in this way may be discharged to an exterior of a cooking appliance through the external exhaust hole 8 provided on a side surface of a cooking appliance.

According to the guide duct 70*c* as described above, a space inside the guide duct 70*c* can be expanded by a space formed in an inside of the second duct portion 73*c*. When a space inside the guide duct 70*c* is expanded in this way, a size of a flow path d required for a flow of an in-chamber discharge air can be effectively expanded.

When a size of a flow path d required for a flow of an in-chamber discharge air is expanded in this way, an exhaust of an in-chamber discharge air can be made more effectively accordingly.

In this case, the second duct portion 73*c* is disposed in the side space 10*e* having little relation with an exhaust of a hood discharge air. Therefore, even if a size of the guide duct 70*c* is increased to expand a flow path d, a size of a flow path required for a flow of air discharged to the second exhaust hole 3 is not reduced by this guide duct 70*c*.

That is, a structure in which the first duct portion 71*c* and the second duct portion 73*c* are combined as described above can improve space efficiency of a cooking appliance by utilizing a dead space inside an appliance as an exhaust flow path.

Also, since an in-chamber discharge air and a hood discharge air are discharged side by side toward an upper portion of an appliance through independent flow paths, an exhaust resistance due to interference or collision between mutual airflows is suppressed, and through this, stable exhaust performance without backflow can be provided.

Also, as a flow path volume is three-dimensionally expanded through the second duct portion 73*c*, a corresponding space performs a role of a chamber buffering a rapid pressure rise of an exhaust gas. A space expanded in this way can provide an effect of lowering dynamic pressure generated during exhaust flow and significantly reducing aerodynamic noise.

[Fifth Example of Exhaust Structure Through Side Space]

Figure 60:
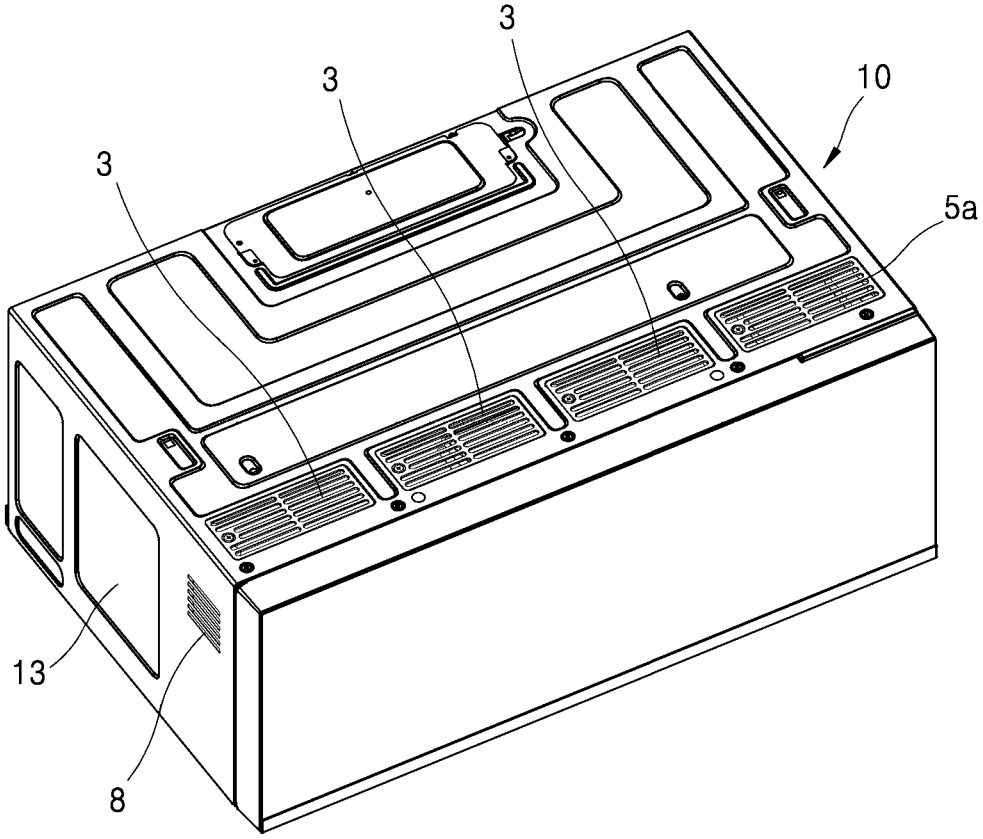
FIG. 60 is a perspective view illustrating a cooking appliance according to a fifth embodiment of the present disclosure.
Figure 61:
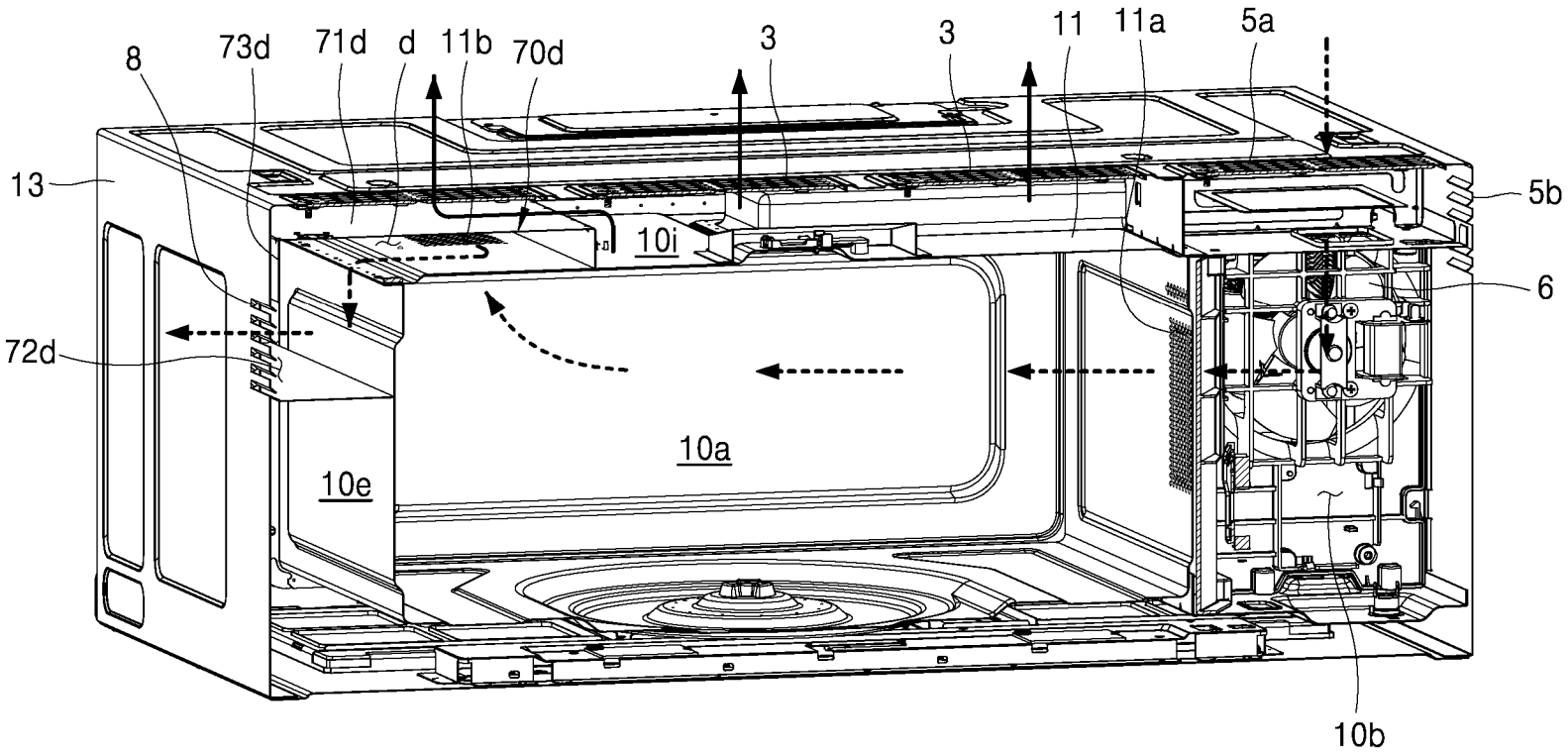
FIGS. 61 and 62 are front cross-sectional views illustrating an air flow state through a side space.
Figure 62:
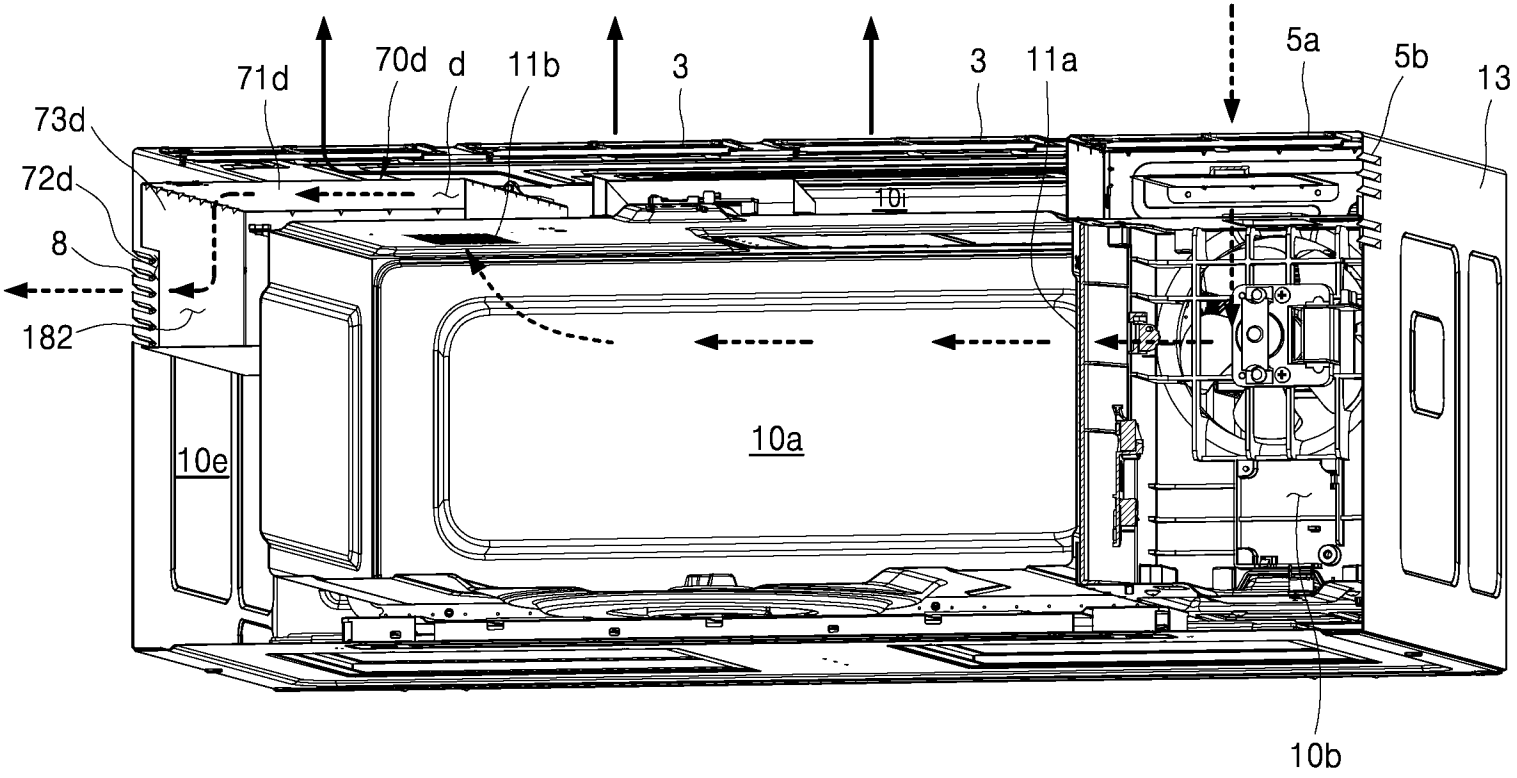
Figure 63:
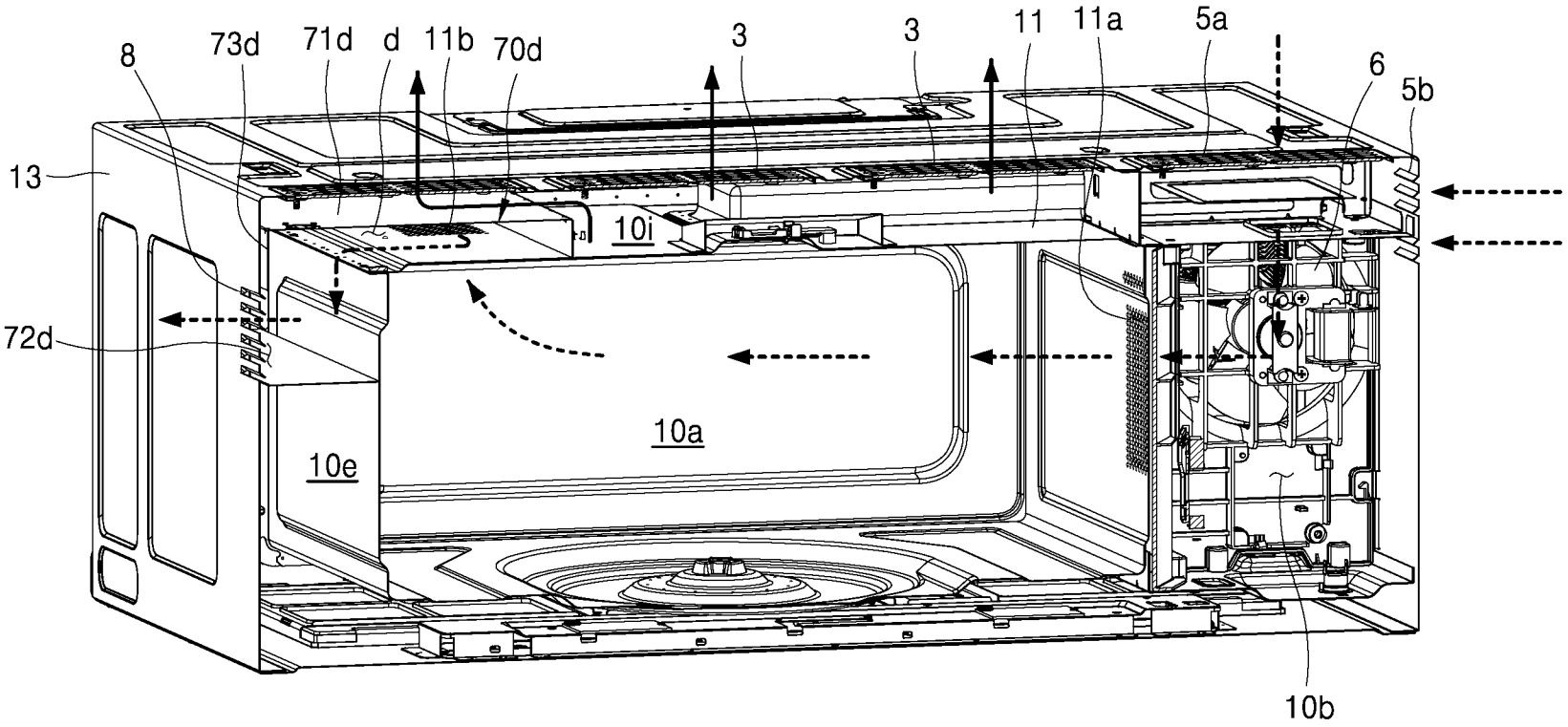
FIGS. 63 and 64 are front cross-sectional views illustrating another example of an air flow state through the side space.
Figure 64:
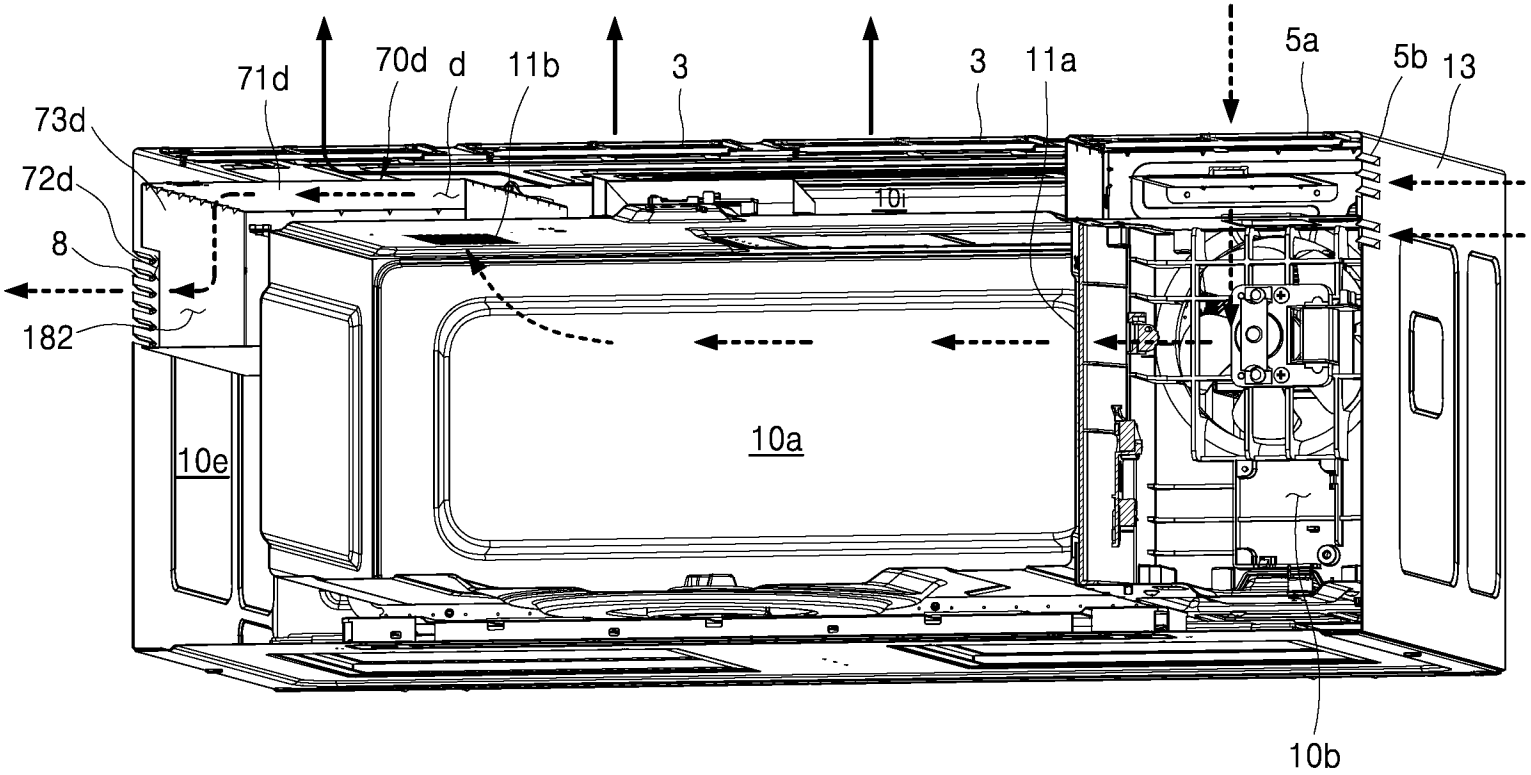

FIG. 60 is a perspective view illustrating a cooking appliance according to a fifth embodiment of the present disclosure, FIGS. 61 and 62 are front cross-sectional views illustrating an air flow state through a side space, and FIGS. 63 and 64 are front cross-sectional views illustrating another example of an air flow state through the side space.

Referring to FIGS. 60 to 61, a guide duct 70*d* according to the present embodiment is provided in a shape having a lower height compared to the guide duct 70*c* (refer to FIG. 55) exemplified in a previous embodiment. According to this, an upper surface of the guide duct 70*d* is disposed to be spaced apart by a predetermined interval below the upper exhaust hole 3.

That is, a space is formed between an upper surface of the guide duct 70*d* and the upper exhaust hole 3, and some of a flow of a hood discharge air flowing in the upper space 10*i* may flow into a space between an upper surface of the guide duct 70*d* and the upper exhaust hole 3.

As an example, a plurality of upper exhaust holes 3 are arranged along a lateral direction in an upper portion of a cooking appliance, and the guide duct 70*d* may be disposed in a region covered by an upper exhaust hole 3 disposed at a farthest position from an upper inlet 5*a* among them.

By a space being formed between an upper surface of such a guide duct 70*d* and the upper exhaust hole 3, a hood discharge air can be discharged through all upper exhaust holes 3 including an upper exhaust hole 3 disposed at a farthest position from an upper inlet 5*a*.

External air may flow into an inside of a cooking appliance through an upper inlet 5*a* as illustrated in FIGS. 61 and 62, or may flow into an inside of a cooking appliance through a side inlet 5*b* as illustrated in FIGS. 63 and 64.

Air having flowed into the cooking chamber 10*a* in an inside of a cooking appliance may be discharged to the upper space 10*i* through the internal exhaust hole 11*b* together with steam, gas, etc. generated in the cooking chamber 10*a* in a cooking process of a cooking appliance. An in-chamber discharge air discharged in this way flows into an inside of a first duct portion 71*d*.

Such an in-chamber discharge air spreads into an inside of the first duct portion 71*d* and an inside of a second duct portion 73*d* and flows frontward, and then may be discharged laterally from the guide duct 70*d* through a duct discharge hole 72*d* disposed on a side surface of the second duct portion 73*d*.

An in-chamber discharge air discharged laterally from the guide duct 70*d* in this way may be discharged to an exterior of a cooking appliance through the external exhaust hole 8 provided on a side surface of a cooking appliance.

According to the present embodiment, a space in which a flow of a hood discharge air is possible is formed between an upper surface of the guide duct 70*d* and the upper exhaust hole 3, and to secure this space, a height of the guide duct 70*d* is lowered. As a height of the guide duct 70*d* is lowered in this way, a size of a flow path d required for a flow of an in-chamber discharge air inside the first duct portion 71*d* inevitably decreases.

However, a reduction amount of a size of a flow path d as described above can be supplemented by a space formed in an inside of the second duct portion 73*d*, and consequently, a flow path d of a sufficient size required for effective exhaust of an in-chamber discharge air can be secured in an inside of the guide duct 70*d*.

A cooking appliance of the present embodiment having such a guide duct 70*d* secures a flow path d of a sufficient size required for effective exhaust of an in-chamber discharge air while allowing a passage required for discharging a hood discharge air to be expanded, thereby being capable of improving both exhaust performance for an in-chamber discharge air and exhaust performance for a hood discharge air together.

[Sixth Example of Exhaust Structure Through Side Space]

Figure 65:
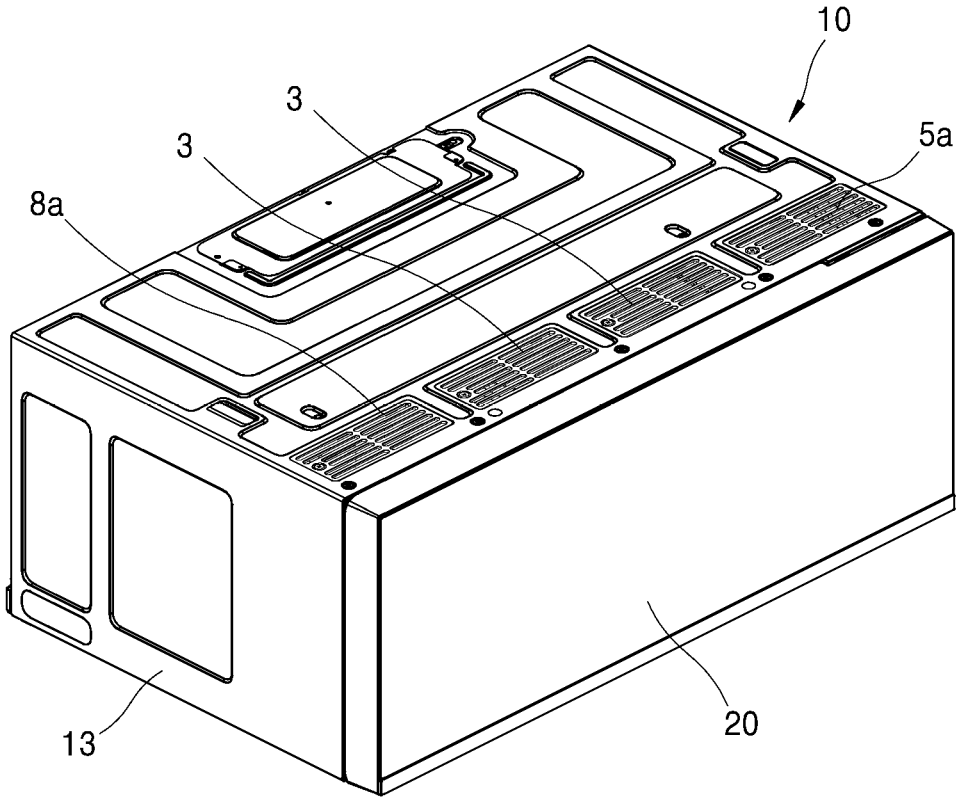
FIG. 65 is a perspective view illustrating a cooking appliance according to a sixth embodiment of the present disclosure.
Figure 66:
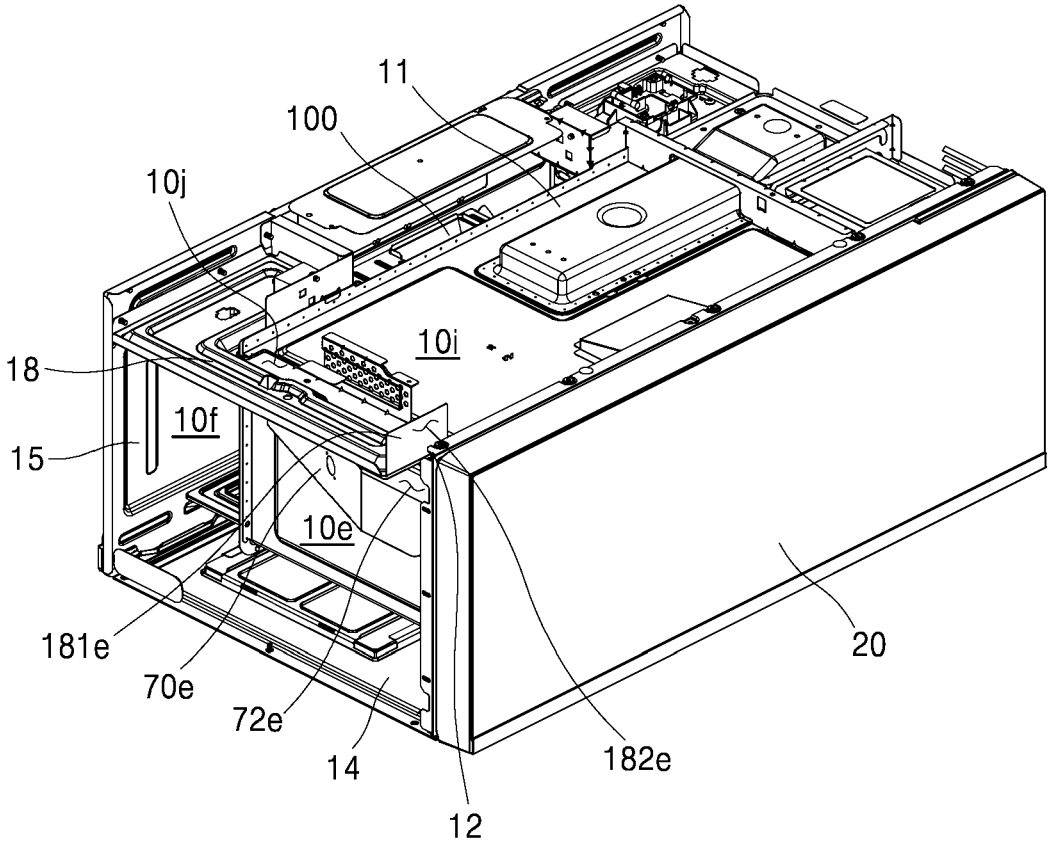
FIG. 66 is a view illustrating a state in which a cabinet is removed from the cooking appliance illustrated in FIG. 65.
Figure 67:
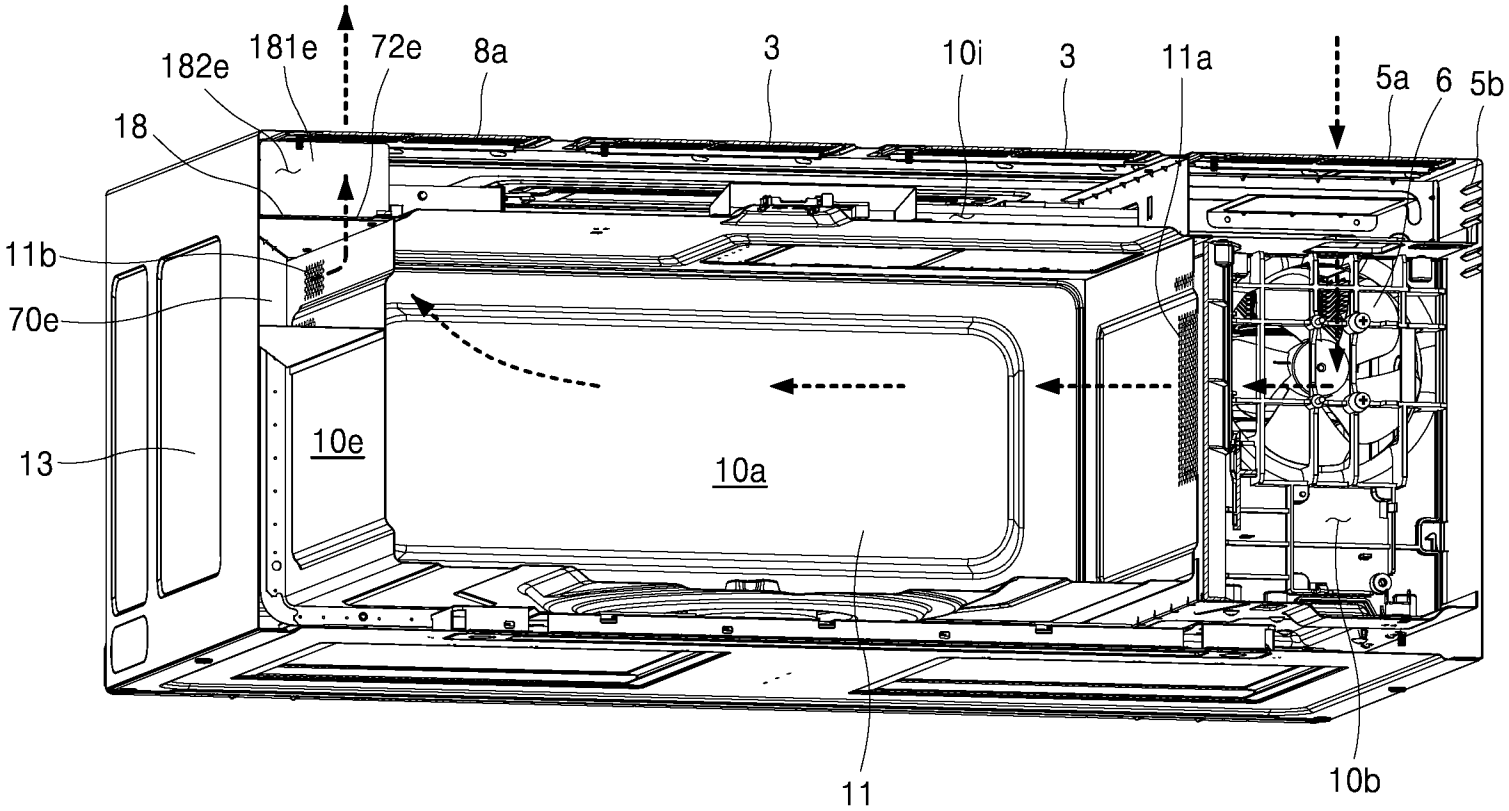
FIGS. 67 and 68 are front cross-sectional views illustrating an air flow state through a side space.
Figure 68:
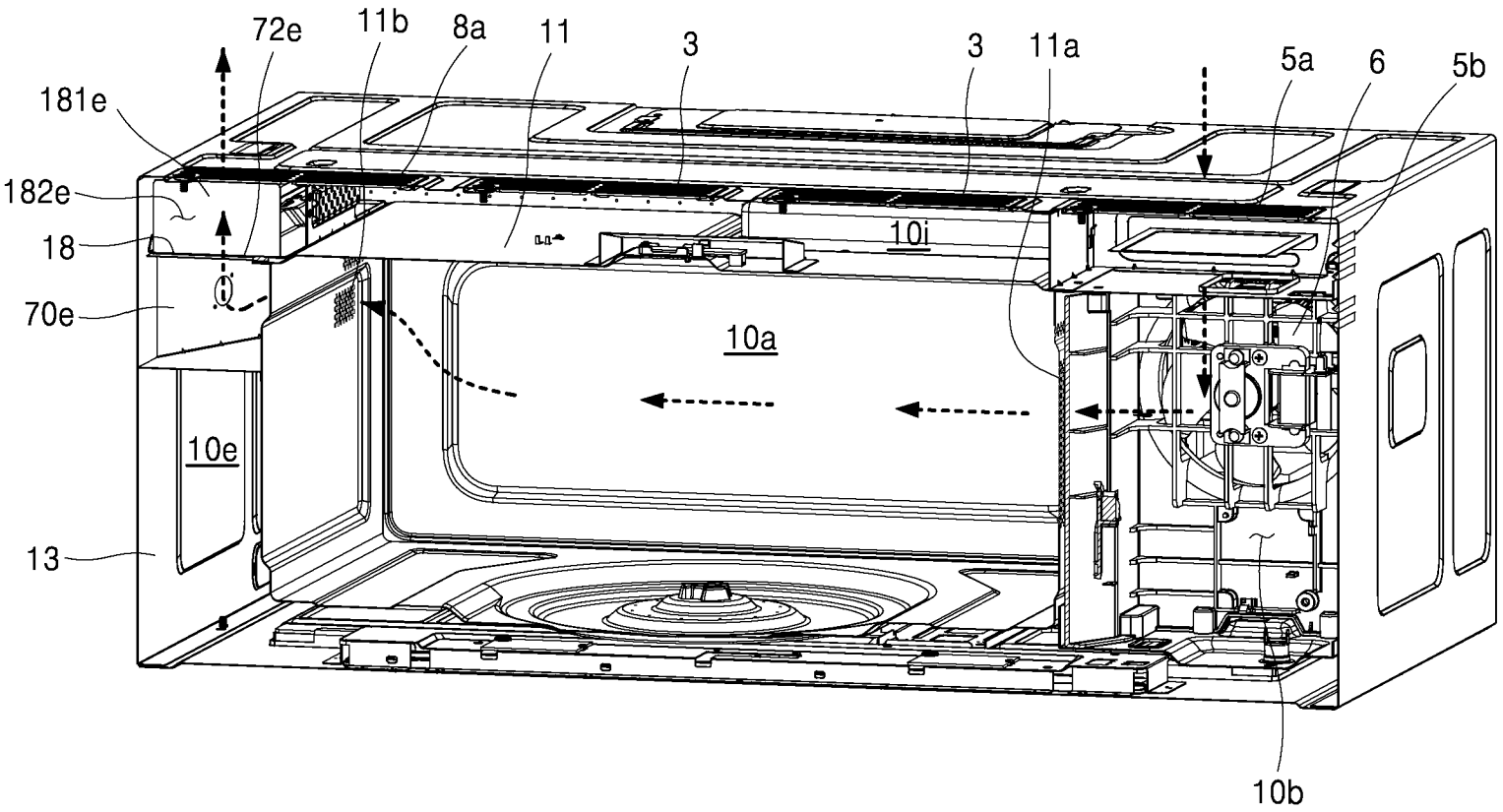
Figure 69:
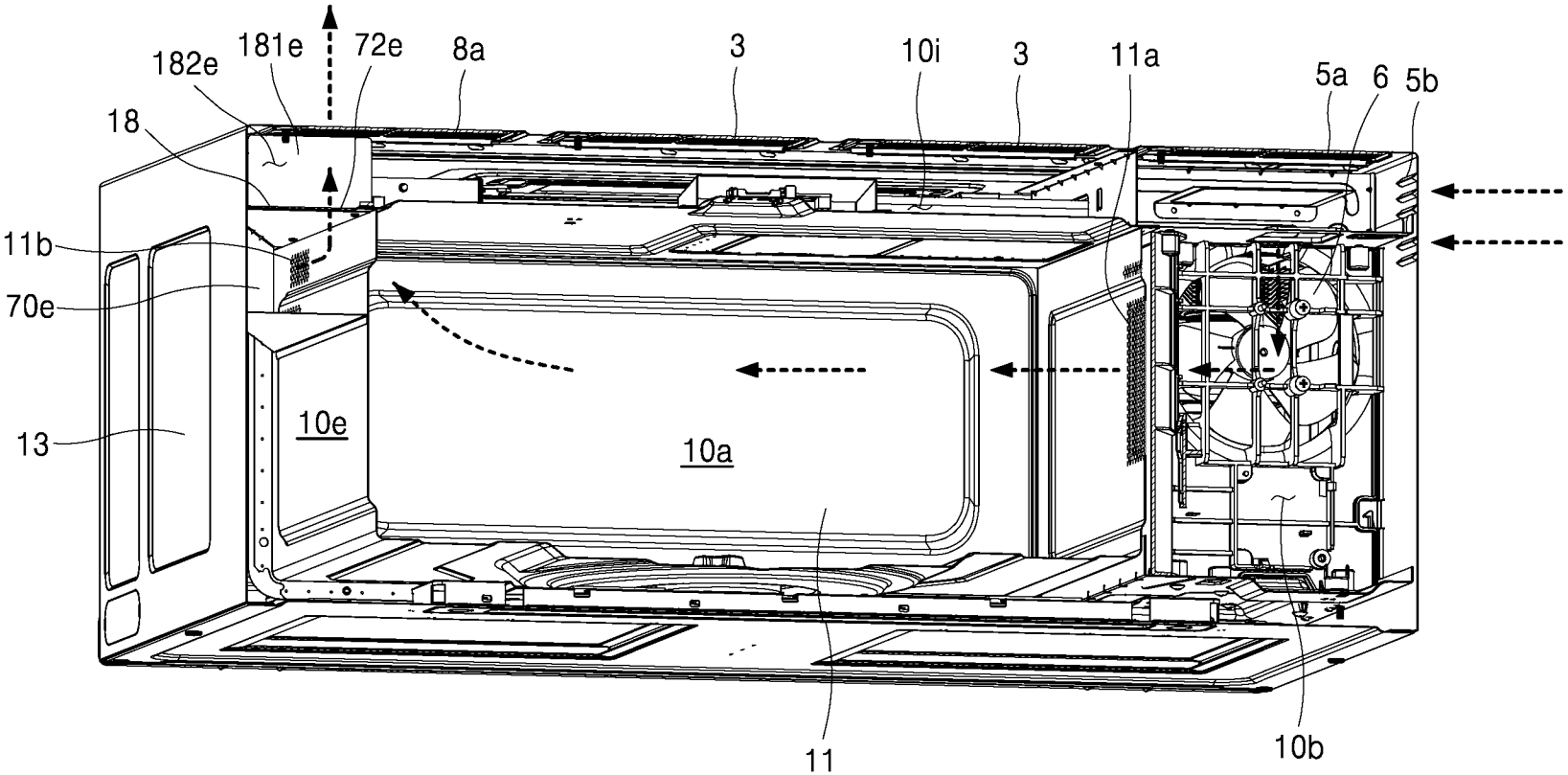
FIGS. 69 and 70 are front cross-sectional views illustrating another example of an air flow state through the side space.
Figure 70:
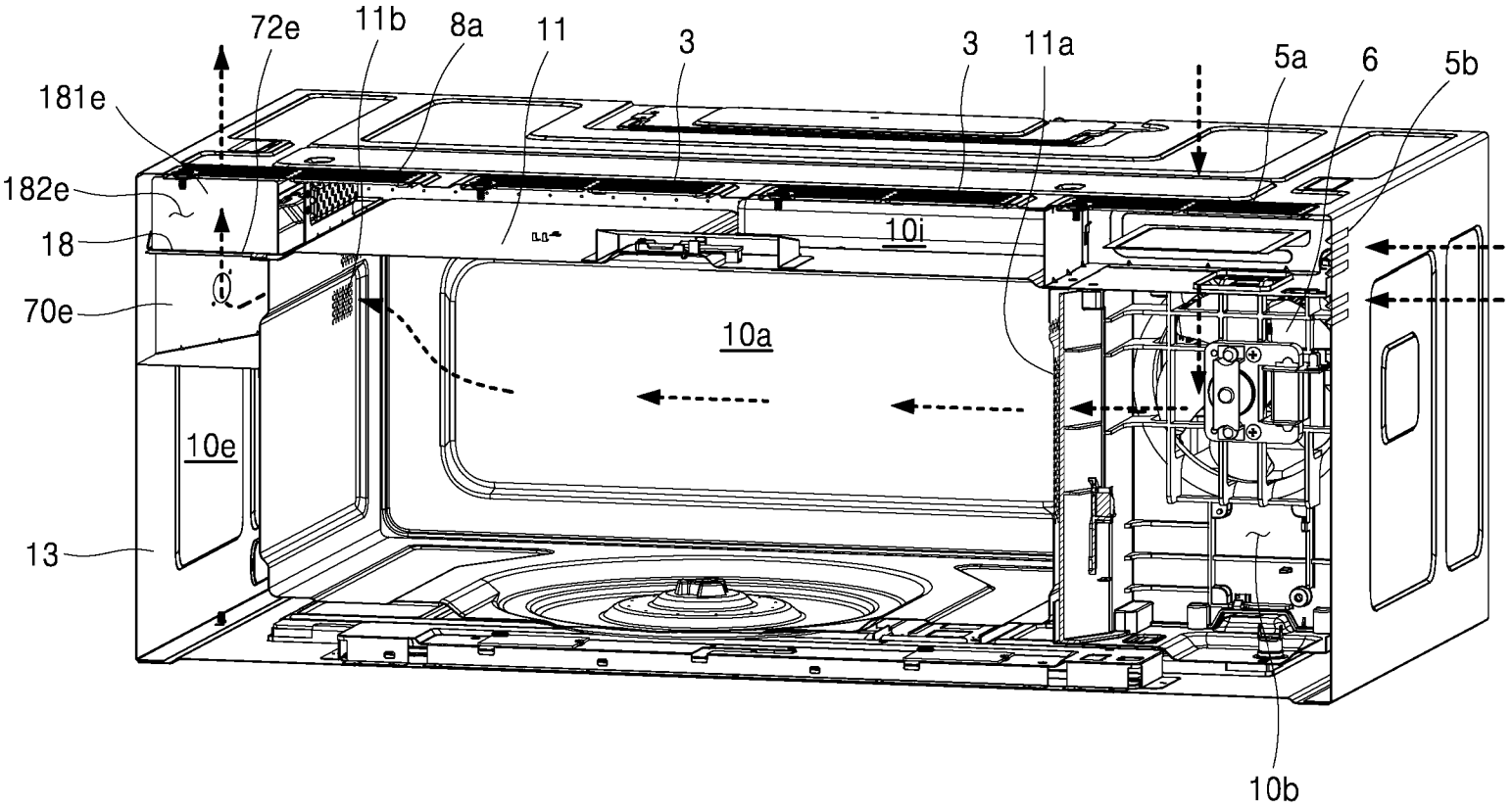

FIG. 65 is a perspective view illustrating a cooking appliance according to a sixth embodiment of the present disclosure, and FIG. 66 is a view illustrating a state in which a cabinet is removed from the cooking appliance illustrated in FIG. 65. Also, FIGS. 67 and 68 are front cross-sectional views illustrating an air flow state through a side space, and FIGS. 69 and 70 are front cross-sectional views illustrating another example of an air flow state through the side space.

Referring to FIGS. 65 to 68, the internal exhaust hole 11*b* may be disposed on a side surface of the cavity 11, and the external exhaust hole 8*a* may be disposed on an upper surface of the cabinet 13. As an example, a plurality of upper exhaust holes 3 are arranged along a lateral direction in an upper portion of a cooking appliance, and an upper inlet 5*a* and the external exhaust hole 8*a* may be disposed to be spaced apart laterally with the plurality of upper exhaust holes 3 interposed therebetween.

The cooking appliance of the present embodiment may include an extension plate 18 and a passage portion 182*e*. The extension plate 18 may form a horizontal wall covering the side space 10*e* from above, and the passage portion 182*e* may form a passage connecting between the internal exhaust hole 11*b* and the external exhaust hole 8 in the extension plate 18.

As an example, the passage portion 182*e* may be formed in a shape in which a portion of the extension plate 18 is penetrated in a vertical direction. Such a passage portion 182*e* may form a passage connecting between the side space 10*e* and the external exhaust hole 8*a* on the extension plate 18.

The passage portion 182*e* may be formed at a position adjacent to the external exhaust hole 8*a*. For example, the external exhaust hole 8*a* and the passage portion 182*e* are disposed at a position adjacent to an upper surface and a front surface of a cooking appliance, and may be disposed to be connected to each other in a vertical direction.

Also, the cooking appliance of the present embodiment may further include a guide duct 70*e* disposed in the side space 10*e*. A flow path d connected to the internal exhaust hole 11*b* may be formed in an inside of the guide duct 70*e*.

In the guide duct 70*e*, a duct inlet and a duct discharge hole 72*e* may be provided. A duct inlet is provided to be able to open the flow path d toward the internal exhaust hole 11*b* at one side in a longitudinal direction of the flow path d. And the duct discharge hole 72*e* is provided to be able to open the flow path d toward at least any one of the passage portion 182*e* and the external exhaust hole 8*a*.

In the present embodiment, a shape in which the flow path d is opened upwardly toward the passage portion 182*e* by a duct discharge hole 72*a*, and a duct discharge hole 72*a*, the passage portion 182*e*, and the external exhaust hole 8*a* are connected vertically is exemplified.

Also, the cooking appliance of the present embodiment may further include a guide wall 181*e*. The guide wall 181*e* protrudes upwardly from the extension plate 18, and may block between the extended upper space 10*i* and the passage portion 182*e*.

External air may flow into an inside of a cooking appliance through an upper inlet 5*a* as illustrated in FIGS. 67 and 68, or may flow into an inside of a cooking appliance through a side inlet 5*b* as illustrated in FIGS. 69 and 70.

Air having flowed into the cooking chamber 10*a* in an inside of a cooking appliance may be discharged to the side space 10*e* through the internal exhaust hole 11*b* together with steam, gas, etc. generated in the cooking chamber 10*a* in a cooking process of a cooking appliance. An in-chamber discharge air discharged in this way flows into an inside of the guide duct 70*e*.

Such an in-chamber discharge air flows frontward along a flow path d formed in an inside of the guide duct 70*e*, and may be discharged upwardly from the guide duct 70*e* through the duct discharge hole 72*e*. An in-chamber discharge air discharged from the guide duct 70*e* in this way flows upwardly and passes through the passage portion 182*e*, and then may be discharged to an exterior of a cooking appliance through the external exhaust hole 8*a*.

According to an exhaust structure of a shape as described above, an in-chamber discharge air may be discharged upwardly from the cooking chamber 10*a* through a side surface of the cavity 11, and then be discharged toward above a cooking appliance through an upper surface of the cabinet 13. In this case, not only an in-chamber discharge air but also a hood discharge air can be discharged together through the external exhaust hole 8*a*.

If the extension plate 18 is not provided in an inside of the main body 10, and accordingly the extended upper space 10*j* is not formed in an inside of the main body 10, a region occupied by the exhaust space 10*i*, 10*j* is inevitably reduced to only the upper space 10*i*.

Also, if the extension plate 18 is not provided in an inside of the main body 10, the external exhaust hole 8*a* is directly connected to the side space 10*e*. In this case, a suction force of the rear fan assembly 100 acting on the side space 10*e* may affect surroundings of the external exhaust hole 8*a*.

In this case, it becomes very difficult for air having flowed from the blower 100, 200 to the exhaust space 10*i*, 10*j* to be discharged to an exterior of a cooking appliance through the external exhaust hole 8*a*. As a result, only steam and gas discharged from a cooking chamber are mainly discharged through the external exhaust hole 8*a*, and a cooking gas suctioned by the blower 100, 200 can hardly be discharged.

In contrast, in the cooking appliance of the present embodiment, the side space 10*e* and the extended upper space 10*j* are separated by the extension plate 18, and a region occupied by the exhaust space 10*i*, 10*j* can be expanded to not only the upper space 10*i* but also the extended upper space 10*j*, which is a region disposed below the external exhaust hole 8*a*.

Accordingly, the cooking appliance of the present embodiment can discharge steam and gas discharged from the cooking chamber together with a cooking gas suctioned through the blower 100, 200 through the external exhaust hole 8*a*.

An exhaust path starting from a side surface and rising vertically upward as described above naturally increases an exhaust flow velocity by combining an updraft due to natural convection (chimney effect) with a mechanical blowing force, and through this, can reduce a load of an exhaust system and improve energy efficiency.

Furthermore, an exhaust structure of the present embodiment can safely discharge an in-chamber discharge gas to an upper portion of an appliance even in a closely-adhered built-in installation environment lacking free space on left and right side surfaces of a cooking appliance.

[Seventh Example of Exhaust Structure Through Side Space]

Figure 71:
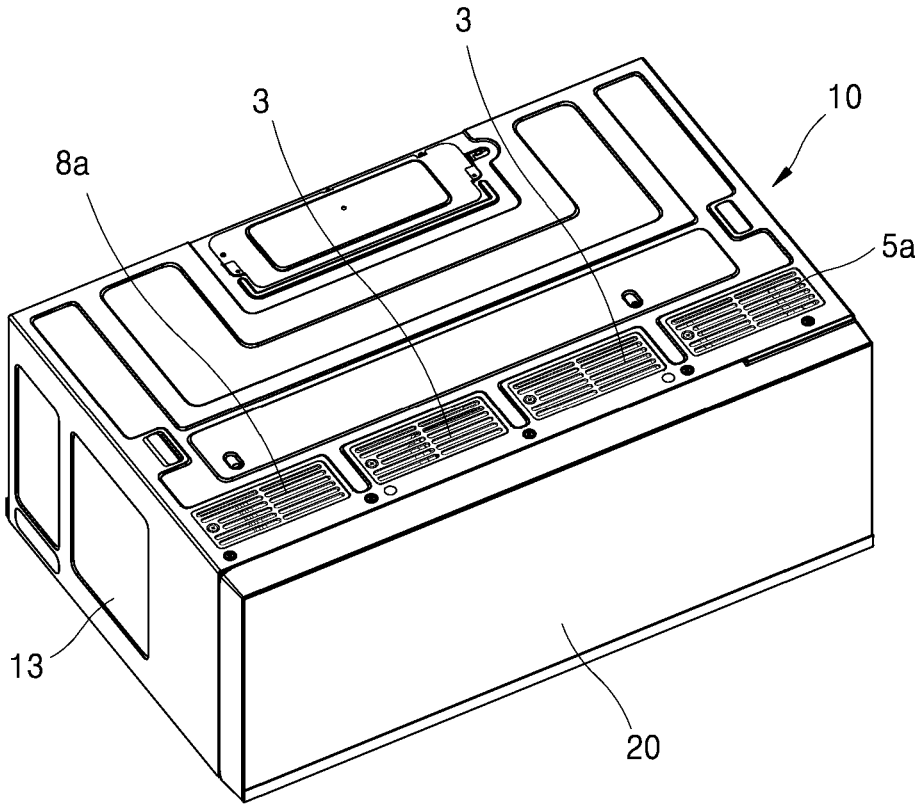
FIG. 71 is a perspective view illustrating a cooking appliance according to a seventh embodiment of the present disclosure.
Figure 72:
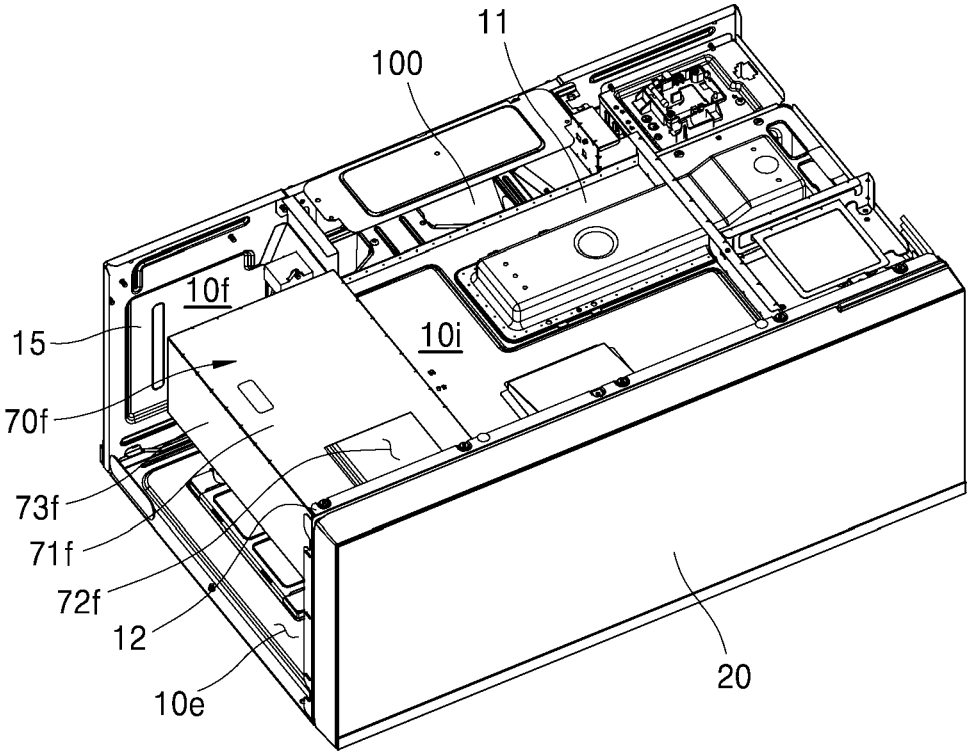
FIG. 72 is a view illustrating a state in which a cabinet is removed from the cooking appliance illustrated in FIG. 71.
Figure 74:
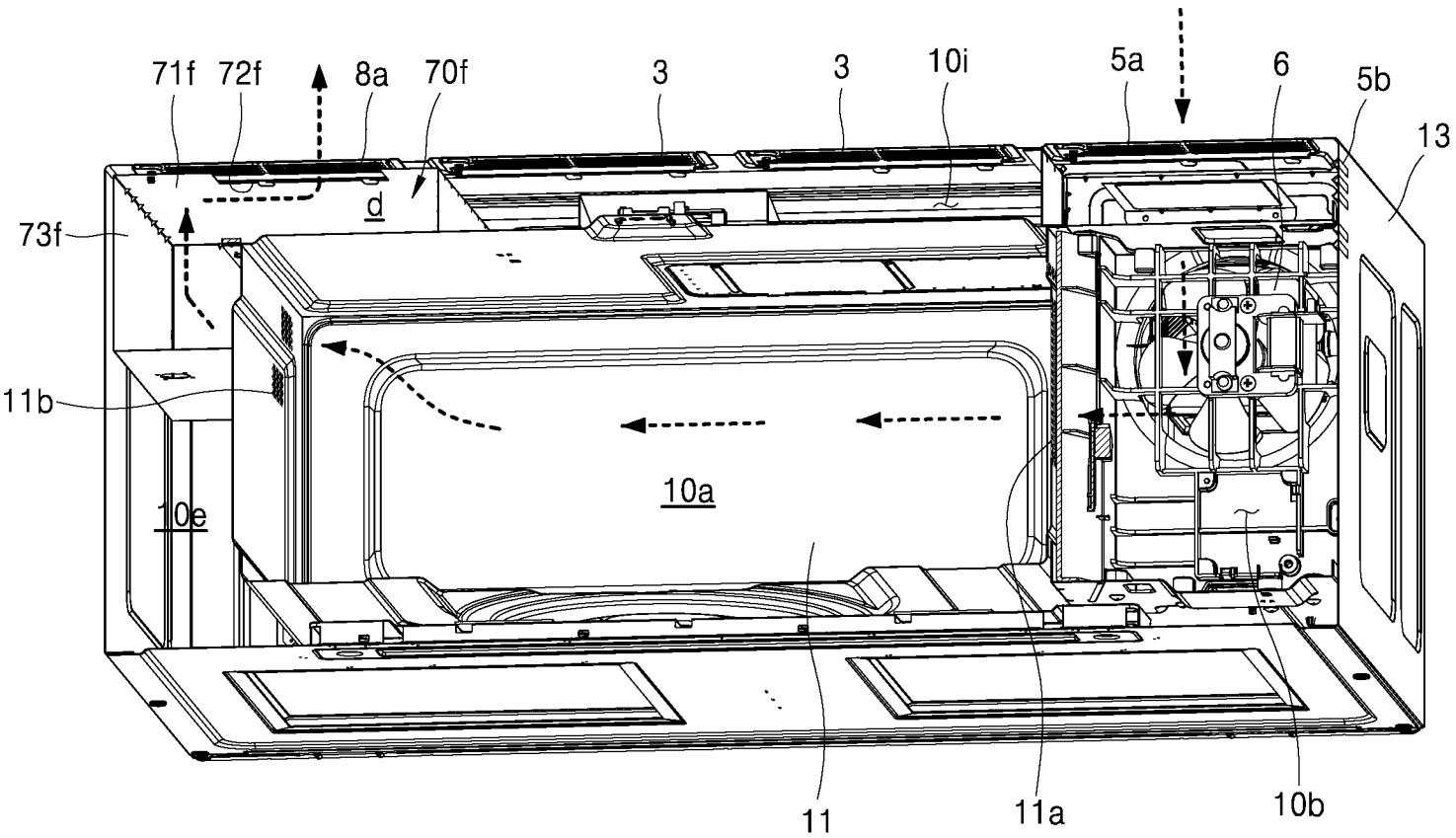
Figure 75:
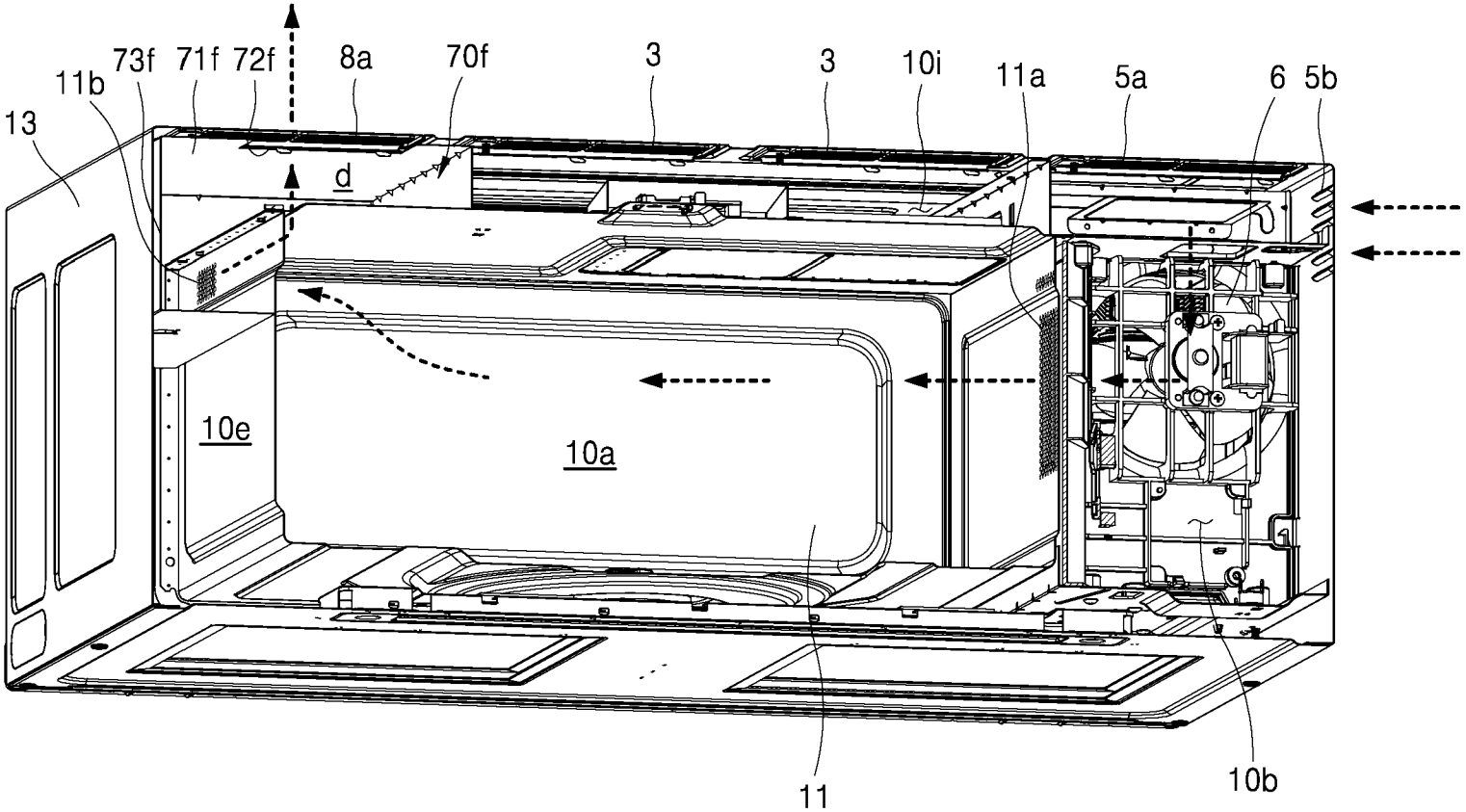
FIGS. 75 and 76 are front cross-sectional views illustrating another example of an air flow state through the side space.
Figure 76:
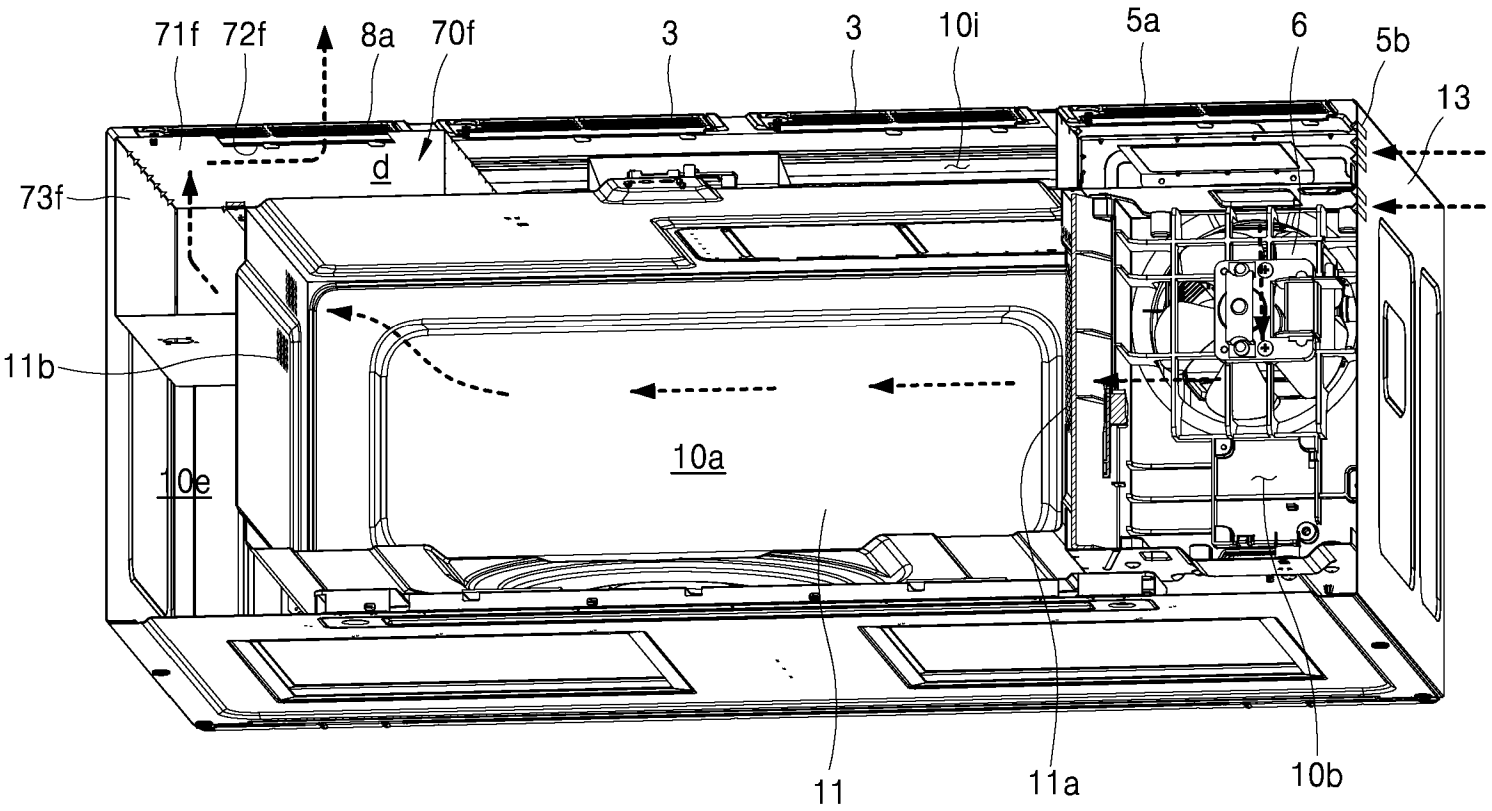

FIG. 71 is a perspective view illustrating a cooking appliance according to a seventh embodiment of the present disclosure, and FIG. 72 is a view illustrating a state in which a cabinet is removed from the cooking appliance illustrated in FIG. 71. Also, FIGS. 73 and 74 are front cross-sectional views illustrating an air flow state through a side space, and FIGS. 75 and 76 are front cross-sectional views illustrating another example of an air flow state through the side space.

Figure 73:
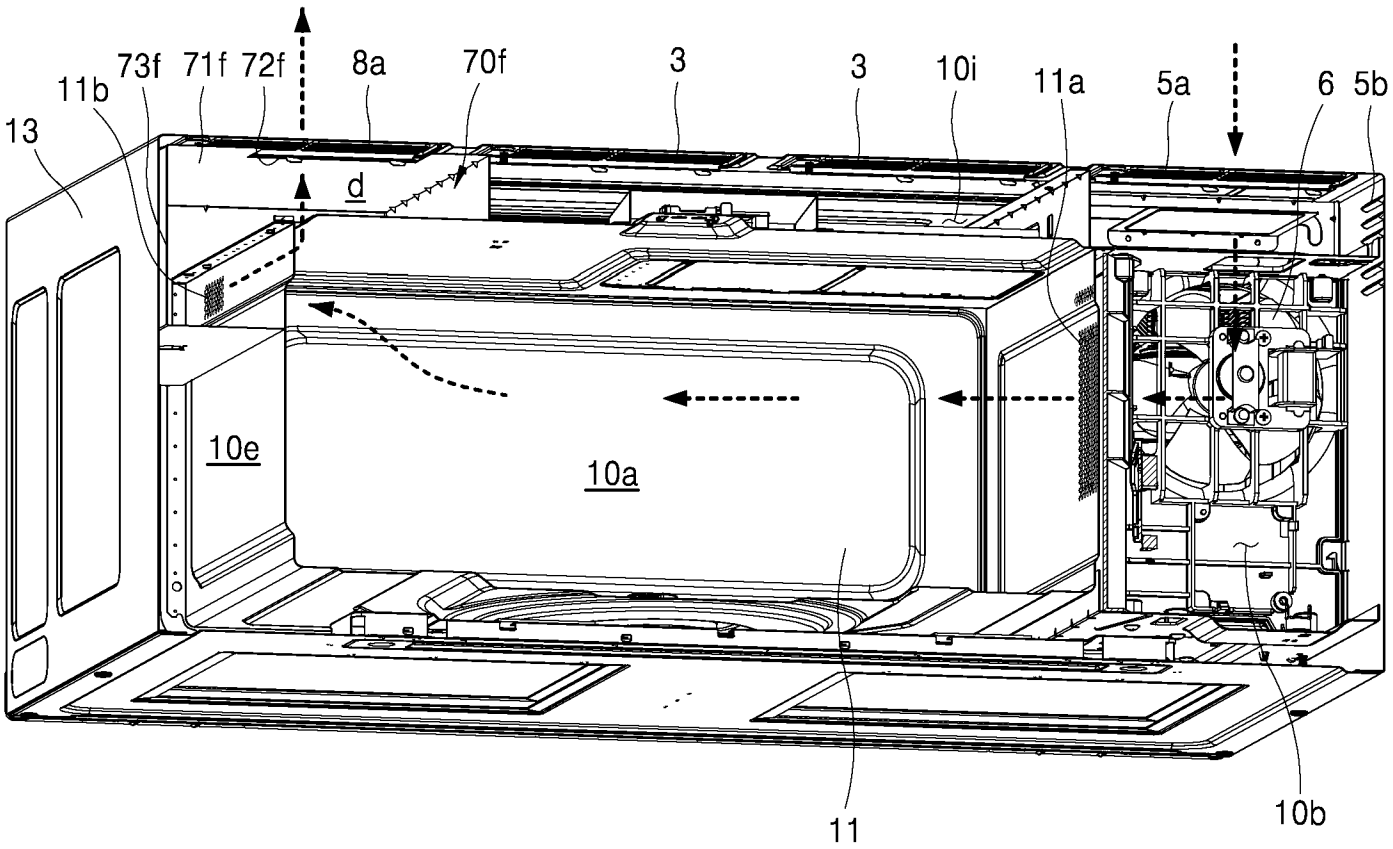
FIGS. 73 and 74 are front cross-sectional views illustrating an air flow state through a side space.

Referring to FIGS. 71 to 73, the cooking appliance of the present embodiment may include an internal exhaust hole 11*b* disposed on a side surface of the cavity 11, and a guide duct 70*f* guiding a flow of an in-chamber discharge air discharged from this internal exhaust hole 11*b* toward the external exhaust hole 8. In the present embodiment, the external exhaust hole 8 may be disposed on an upper surface of the cabinet 13.

The guide duct 70*f* may be formed in a shape similar to the guide duct 70*c* (refer to FIG. 54) exemplified in the fourth embodiment of the present disclosure, and may include a first duct portion 71*f* and a second duct portion 73*f*.

The first duct portion 71*f* is disposed in the upper space 10*i*, and the second duct portion 73*f* may be disposed below the first duct portion 71*f*. The second duct portion 73*f* is disposed in the side space 10*e*, and may form a flow path d surrounding the internal exhaust hole 11*b* in an inside. In an inside of the first duct portion 71*f*, a flow path d connected to an inside of the second duct portion 73*f* is formed.

In the guide duct 70*f* of the present embodiment, a duct discharge hole 72*f* may be disposed in the first duct portion 71*f*. Such a duct discharge hole 72*f* is provided to be able to open a flow path d inside the first duct portion 71*f* toward the external exhaust hole 8.

As an example, the duct discharge hole 72*f* may be formed to pass through vertically on an upper surface of the first duct portion 71*f* facing vertically with respect to the external exhaust hole 8. At least a portion of such a duct discharge hole 72*f* may overlap the external exhaust hole 8 in a vertical direction.

External air may flow into an inside of a cooking appliance through an upper inlet 5*a* as illustrated in FIGS. 73 and 74, or may flow into an inside of a cooking appliance through a side inlet 5*b* as illustrated in FIGS. 75 and 76.

Air having flowed into the cooking chamber 10*a* in an inside of a cooking appliance may be discharged to the side space 10*e* through the internal exhaust hole 11*b* together with steam, gas, etc. generated in the cooking chamber 10*a* in a cooking process of a cooking appliance. An in-chamber discharge air discharged in this way flows into an inside of the second duct portion 73*f*.

Such an in-chamber discharge air spreads into an inside of the first duct portion 71*f* and an inside of the second duct portion 73*f* and flows frontward, and then may be discharged upwardly from the guide duct 70*f* through a duct discharge hole 72*f* disposed on an upper surface of the first duct portion 71*f*.

An in-chamber discharge air discharged upwardly from the guide duct 70*f* in this way may be discharged to an exterior of a cooking appliance through the external exhaust hole 8 provided on an upper surface of a cooking appliance.

The guide duct 70*f* of the present embodiment can effectively improve exhaust performance of a cooking appliance without reducing a size of a flow path required for a flow of a hood discharge air, and without affecting a flow of a hood discharge air.

Also, the cooking appliance of the present embodiment including a guide duct 70*f* of a shape as described above can discharge both an in-chamber discharge air and a hood discharge air through an upper portion of a cooking appliance while physically isolating a flow path of a hood discharge air and a flow path of an in-chamber discharge air formed inside a cooking appliance.

Such a cooking appliance of the present embodiment can allow suction performance of a hood system and ventilation efficiency of a cooking chamber to be exhibited at respective design maximums without interference, even when it is difficult for the external exhaust hole 8 to be disposed on a side surface of the cooking appliance due to an installation environment.

The embodiments are described above with reference to a number of illustrative embodiments thereof. However, the embodiments are provided as examples, and numerous other modifications and equivalent embodiments can be drawn by one having ordinary skill in the art from the embodiments. Thus, the technical scope of protection of the subject matter of the disclosure is to be defined according to the following claims.

DESCRIPTION OF REFERENCE NUMERALS

1: Air intake hole
2: First exhaust hole
3: Second exhaust hole
3*a*: Common exhaust hole
4: Third exhaust hole
5*a*: Upper inlet
5*b*: Side inlet
6: Cooling fan
7: Humidity sensor
8: External exhaust hole
10: Main body
10*a*: Cooking chamber
10*b*, 10*c*, 10*d*: Electronic/electrical component chamber

10*b*: Lower electronic/electrical component chamber
10*c*: Upper electronic/electrical component chamber
10*d*: Intake chamber
10*e*: Side space
10*f*: Rear space
10*g*, 10*h*: Corner space
10*g*: Upper corner space
10*h*: Lower corner space
10*i*: Upper space
10*j*: Extended upper space
11: Cavity
11*a*: Internal inlet hole
11*b*: Internal exhaust hole
12: Front plate
12*a*: Upper end surface portion
13: Cabinet
14: Base plate
15: Rear plate
16: Flow path partition plate
17: Waveguide
18: Extension plate
18*a*: Side partition portion
18*b*: Rear partition portion
20: Door
25: Control panel
30: Flow path defining member
31: First flow path plate
32: Second flow path plate
33: Fastening plate
34: Extension plate
35*a*: First flow path defining member
35*b*: Second flow path defining member
36: Cover
37, 38: Connection flow path defining member
37: First partition portion
38: Second partition portion
39: Connection flow path portion
40: Support member
41: Lateral support portion
41*a*: Discharge hole
41*b*: Through hole
42: Front support portion
43: Upward support portion
45*a*: First support plate
45*b*: Second support plate
45*c*: Third support plate
50: Partition plate
52, 54: Passage hole
52: First passage hole
54: Second passage hole
55: Blocking plate
60: Screening member
66: Horizontal surface portion
67: Vertical surface portion
67*a*: Ventilation hole
70: Guide duct
80: Lamp cover
100, 200: Blower
100: Rear fan assembly
110: Fan housing
112: First suction hole
114: First discharge hole
120: Impeller
200: Corner fan assembly
210: Fan housing
212: Second suction hole
214: Second discharge hole
220: Impeller

What is claimed is:

1. A cooking appliance having a main body, the main body comprising:

a cabinet that defines an exterior surface;

a cavity that defines a cooking chamber, the cavity being provided within the cabinet, and a space portion being defined between the cavity and the cabinet;

a base plate disposed at a lower side of the cavity;

an intake port provided at the base plate and configured to draw in cooking gas into the main body;

an exhaust port provided at an upper surface of the cabinet and configured to discharge the cooking gas drawn into the main body to an outside of the main body; and a blower provided in the space portion and configured to draw in the cooking gas through the intake port to pass through the space portion and be discharged to the outside of the main body through the exhaust port, wherein the cabinet includes (i) a cool air inlet defining a passage through which air for cooling the cooking chamber is introduced into the space portion and (ii) an external exhaust outlet defining a passage through which air that has cooled the cooking chamber is discharged to the outside of the main body, wherein the cavity includes (i) an internal inlet through which the air introduced through the cool air inlet is introduced into the cooking chamber and (ii) an internal exhaust outlet through which the air introduced into the cooking chamber is discharged to the space portion, wherein the space portion includes a lateral space portion disposed between a first side surface of the cavity and a corresponding first side surface of the cabinet, wherein the external exhaust outlet is disposed at the first side surface of the cabinet to fluidly connect the lateral space portion to the outside of the main body, and wherein the main body of the cooking appliance further comprises a guide duct that defines a flow path from the internal exhaust outlet to the external exhaust outlet, at least a portion of the guide duct being disposed in the lateral space portion.

2. The cooking appliance of claim 1, wherein the external exhaust outlet is disposed closer to a front side of the first side surface of the cabinet than to a rear side thereof, and disposed closer to an upper side of the first side surface of the cabinet than a lower side thereof.

3. The cooking appliance of claim 1, wherein:

the internal exhaust outlet is disposed further rearward than the external exhaust outlet;

the guide duct includes a duct outlet that directs the flow path toward the external exhaust outlet; and at least a portion of the flow path is directed to move forward from the internal exhaust outlet toward the duct outlet.

4. The cooking appliance of claim 3, wherein:

the internal exhaust outlet is disposed closer to a rear side of the lateral space portion than to a front side thereof, the duct outlet is disposed closer to the front side of the lateral space portion than to the rear side thereof; and the guide duct extends across at least a portion of the internal exhaust outlet and at least a portion of the lateral space portion.

5. The cooking appliance of claim 4, further comprising a humidity sensor provided at the guide duct and configured to measure humidity of air in the flow path.

6. The cooking appliance of claim 1, wherein the guide duct includes a width-change section in which a width of the guide duct increases toward a front side of the main body.

7. The cooking appliance of claim 1, wherein the guide duct includes a duct outlet that directs the flow path toward the external exhaust outlet, and a surface of the guide duct having the duct outlet is angled such that the surface becomes closer to the cabinet toward a front side of the main body.

8. The cooking appliance of claim 1, wherein:

the space portion includes an upper space portion disposed at an upper side of the cavity, an upper boundary of the upper space portion being defined by the upper surface of the cabinet;

the internal exhaust outlet is provided at an upper surface of the cavity; and at least a portion of the guide duct is disposed in the upper space portion.

9. The cooking appliance of claim 1, wherein the internal exhaust outlet is provided at the first side surface of the cavity.

10. A cooking appliance having a main body, the main body comprising:

a cabinet that defines an exterior surface;

a cavity that defines a cooking chamber, the cavity being provided within the cabinet, and a space portion being defined between the cavity and the cabinet;

a base plate disposed at a lower side of the cavity;

an intake port provided at the base plate and configured to draw in cooking gas into the main body;

an exhaust port provided at an upper surface of the cabinet and configured to discharge the cooking gas drawn into the main body to an outside of the main body; and a blower provided in the space portion and configured to draw in the cooking gas through the intake port to pass through the space portion and be discharged to the outside of the main body through the exhaust port, wherein the cabinet includes (i) a cool air inlet defining a passage through which air for cooling the cooking chamber is introduced into the space portion and (ii) an external exhaust outlet defining a passage through which air that has cooled the cooking chamber is discharged to the outside of the main body, wherein the cavity includes (i) an internal inlet through which the air introduced through the cool air inlet is introduced into the cooking chamber and (ii) an internal exhaust outlet through which the air introduced into the cooking chamber is discharged to the space portion, wherein the space portion includes first and second lateral space portions respectively disposed at opposite lateral sides of the cavity, the external exhaust outlet being disposed at a first side surface of the cabinet corresponding to the first lateral space portion to fluidly connect the first lateral space portion to the outside of the main body, wherein an electrical component compartment is provided in the second lateral space portion, and wherein the main body of the cooking appliance further includes a guide duct that defines a flow path from the internal exhaust outlet to the external exhaust outlet, at least a portion of the guide duct being disposed in the first lateral space portion.

11. The cooking appliance of claim 10, wherein the external exhaust outlet is disposed closer to a front side of the first side surface of the cabinet than to a rear side thereof, and disposed closer to an upper side of the first side surface of the cabinet than a lower side thereof.

12. The cooking appliance of claim 10, wherein the internal exhaust outlet is provided at a first side surface of the cavity corresponding to the first lateral space portion.

13. The cooking appliance of claim 11, wherein the internal exhaust outlet is provided at a first side surface of the cavity corresponding to the first lateral space portion and overlaps the external exhaust outlet in a vertical direction such that at least a portion of the air flowing from the internal exhaust outlet to the external exhaust outlet travels in a horizontal direction.

14. The cooking appliance of claim 10, wherein:

the internal exhaust outlet is disposed further rearward than the external exhaust outlet, the guide duct includes a duct outlet opening the flow path toward the external exhaust outlet, and the flow path is configured to guide an air flow moving forward from the internal exhaust outlet toward the duct outlet.

15. The cooking appliance of claim 10, wherein:

the space portion includes an upper space portion disposed at an upper side of the cavity, the upper surface of the cabinet defines an upper boundary of the upper space portion, the internal exhaust outlet is formed on an upper surface of the cavity, and at least a portion of the guide duct is disposed in the upper space portion.

16. The cooking appliance of claim 10, wherein the main body of the cooking appliance further includes a cooling fan that is disposed in the electrical component compartment, the cooling fan being configured to drive air through the electrical component compartment and the cool air inlet into the cooking chamber.

17. A cooking appliance having a main body, the main body comprising:

a cabinet that defines an exterior surface, the cabinet including:

a cool air inlet, an external exhaust outlet at a side surface of the cabinet, and at least one exhaust port at an upper surface of the cabinet;

a cavity that defines a cooking chamber, the cavity being provided within the cabinet; and a base plate disposed below the cavity and defining an intake port configured to draw in cooking gas into the main body, wherein the main body defines (i) a flow of hood discharge air that enters the main body through the intake port and is discharged through the at least one exhaust port and (ii) a flow of cooking chamber discharge air that enters the main body through the cool air inlet and passes through the cooking chamber to be discharged through the external exhaust outlet, and wherein the hood discharge air is discharged through an upper part of the main body, and the cooking chamber discharge air is discharged through a lateral part of the main body.

18. The cooking appliance of claim 17, further comprising a blower that is configured to drive the flow of the hood discharge air, wherein a space portion is defined between the cavity and the cabinet, and the space portion includes a rear space portion disposed between a rear surface of the cavity and a rear surface of the cabinet, the blower being provided in the rear space portion.

19. The cooking appliance of claim 17, further comprising a blower that is configured to drive the flow of the hood discharge air, wherein a space portion is defined between the cavity and the cabinet, the space portion including a lateral space portion disposed between a side surface of the cavity and a side surface of the cabinet, the blower being provided in the lateral space portion.

20. A cooking appliance having a main body, the main body comprising:

a cabinet that defines an exterior surface;

a cavity that defines a cooking chamber, the cavity being provided within the cabinet, and a space portion being defined between the cavity and the cabinet;

a base plate disposed at a lower side of the cavity;

an intake port provided at the base plate and configured to draw in cooking gas into the main body;

an exhaust port provided at an upper surface of the cabinet and configured to discharge the cooking gas drawn into the main body to an outside of the main body; and a blower provided in the space portion and configured to draw in the cooking gas through the intake port to pass through the space portion and be discharged to the outside of the main body through the exhaust port, wherein the cabinet includes (i) a cool air inlet defining a passage through which air for cooling the cooking chamber is introduced into the space portion and (ii) an external exhaust outlet defining a passage through which air that has cooled the cooking chamber is discharged to the outside of the main body, wherein the space portion includes first and second lateral space portions respectively disposed at opposite lateral sides of the cavity, the external exhaust outlet being disposed at a first side surface of the cabinet corresponding to the first lateral space portion to fluidly connect the first lateral space portion to the outside of the main body, wherein an electrical component compartment is provided in the second lateral space portion, wherein a portion of the air introduced through the cool air inlet cools the electrical component compartment and the cooking chamber and is exhausted to the first side surface of the cabinet through the external exhaust outlet, and another portion of the air introduced through the cool air inlet moves toward the blower and is discharged to the upper surface of the cabinet through the exhaust port.

* * * * *